US010532578B2

(12) United States Patent
Koganehira et al.

(10) Patent No.: US 10,532,578 B2
(45) **Date of Patent: *Jan. 14, 2020**

(54) PRINTING APPARATUS

(71) Applicant: SEIKO EPSON CORPORATION, Tokyo (JP)

(72) Inventors: Shuichi Koganehira, Nagano (JP); Yasuhiko Kosugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 24 days.

This patent is subject to a terminal disclaimer.

(21) Appl. No.: 15/352,958

(22) Filed: Nov. 16, 2016

(65) Prior Publication Data

US 2017/0157942 A1 Jun. 8, 2017

(30) Foreign Application Priority Data

Dec. 7, 2015 (JP) ..... 2015-238447
Dec. 7, 2015 (JP) ..... 2015-238448
Dec. 7, 2015 (JP) ..... 2015-238449

(51) Int. Cl.
*B41J 29/38* (2006.01)
*B41J 2/175* (2006.01)

(52) U.S. Cl.
CPC ..... *B41J 2/17566* (2013.01); *B41J 2/1752* (2013.01); *B41J 2/1753* (2013.01); *B41J 2/17533* (2013.01); *B41J 2/17546* (2013.01); *B41J 2002/17569* (2013.01)

(58) Field of Classification Search
USPC ..... 347/7
See application file for complete search history.

(56) References Cited

U.S. PATENT DOCUMENTS 6,406,120 B2 * 6/2002 Pauschinger .... G07B 17/00314 347/19
2002/0091585 A1 7/2002 Asauchi et al.
2004/0156645 A1 * 8/2004 Nakazato ..... G03G 15/0849 399/27

(Continued)

FOREIGN PATENT DOCUMENTS

JP 2002-273989 A 9/2002
JP 2008-254395 A 10/2008

(Continued)

*Primary Examiner* — Lam S Nguyen
(74) *Attorney, Agent, or Firm* — Global IP Counselors, LLP

(57) ABSTRACT

A printing apparatus (200) includes a slot (230) to and from which a memory unit (100) storing permitted usage amount information can be attached and removed, and a processing unit (210) that carries out a process for updating estimated ink amount information. The processing unit (210) carries out a charging process using a first memory unit (100-1), and in the case where a second memory unit (100-2) has been attached to the slot (230) after the charging process, the processing unit (210) does not carry out a charging process using the second memory unit (100-2) until a consumed ink amount expressed by the estimated ink amount information exceeds a prescribed threshold (WTH). The processing unit (210) carries out the charging process using the second memory unit (100-2) in the case where the consumed ink amount has exceeded the prescribed threshold (WTH).

19 Claims, 21 Drawing Sheets

(56) References Cited

U.S. PATENT DOCUMENTS

| | | | | |
|---|---|---|---|---|
| 2008/0071605 | A1 | 3/2008 | Asauchi et al. | |
| 2009/0034994 | A1* | 2/2009 | Chihara | G03G 21/1882 399/24 |
| 2011/0316905 | A1* | 12/2011 | Miyazawa | B41J 2/17546 347/6 |
| 2014/0063089 | A1 | 3/2014 | Kosugi | |

FOREIGN PATENT DOCUMENTS

| | | | |
|---|---|---|---|
| JP | 2011-073208 | A | 4/2011 |
| JP | 2014-046545 | A | 3/2014 |
| JP | 2014-046611 | A | 3/2014 |
| JP | 2014-058098 | A | 4/2014 |

* cited by examiner

| ADDRESS | bit7 | bit6 | bit5 | bit4 | bit3 | bit2 | bit1 | bit0 |
|---|---|---|---|---|---|---|---|---|
| 00h | ..... | | | | | | | |
| 01h | ..... | | | | | | | |
| ⋮ | ⋮ | | | | | | | |
| ad1 | ID | | | | | | | |
| ad2 | COLOR INFORMATION | | ..... | | | | | |
| ad3 | PERMITTED USAGE AMOUNT INFORMATION | | | | | | | |
| ad4 | BACKUP INFORMATION | | | | | | | |
| ⋮ | ⋮ | | | | | | | |

FIG. 2

PRINTING APPARATUS

BACKGROUND

1. Technical Field

The present invention relates to printing apparatuses.

2. Related Art

User-replaceable ink cartridges (an example of an ink holding unit) used in ink jet printers, which are an example of a printing apparatus, are sometimes provided with storage devices for managing a consumed ink amount, or in other words, an amount of ink consumed from the ink cartridge. In printing apparatuses where an ink tank (an example of an ink holding unit) provided in the printing apparatus is filled with ink, too, a memory unit including a storage device is sometimes installed in the printing apparatus in order to manage the consumed ink amount. Information such as the color of the ink, the consumed ink amount, and so on is stored in this storage device.

JP-A-2014-46545 discloses a technique in which each time a total consumed ink amount on a printing apparatus main unit (called simply a "main unit" hereinafter) side exceeds a first threshold (WTH1), information of the main unit-side total consumed ink amount managed on the main unit side is written into a memory unit. JP-A-2014-46545 also discloses a technique where the stated write is carried out before the main unit-side total consumed ink amount exceeds a second threshold (WTH2), and in the case where WTH2 has been exceeded, the memory unit is set to an invalid state and no additional writes are carried out.

Meanwhile, JP-A-2008-254395 discloses a technique in which an identification number and a capacity of a set memory card are stored in a storage unit of a printing apparatus. In JP-A-2008-254395, the storage unit of the printing apparatus stocks liquid stock amount information so that a liquid stock amount is added on the basis of the information in the set memory card, regardless of whether it is before or after ink has been refilled. JP-A-2011-73208 also discloses a technique in which an ink amount in a separate memory is added to an amount of ink that can be used by a printer.

Finally, JP-A-2014-46611 discloses a technique in which a printing apparatus, to which a chip unit (equivalent to a memory unit) is attached, displays information based on an ink amount stored in a storage member, information based on the chip unit, and the like.

According to the technique of JP-A-2014-46545, a process for writing into the memory unit is carried out until the main unit-side total consumed ink amount exceeds WTH2, and thus printing operations will stop if a user removes the memory unit before the main unit-side total consumed ink amount exceeds WTH2. Thus in order to print continuously, the user is forced to replace the memory unit during a specific period, namely after the main unit-side total consumed ink amount has exceeded WTH2 but before printing operations stop in response to a determination that the ink has run out (that is, a case where the main unit-side total consumed ink amount has exceeded a third threshold WTH3). This places a heavy burden on the user. The printing operations will stop unless this replacement is made, and there is thus a problem that it is difficult to use the printing apparatus continuously for long periods of time.

According to the techniques disclosed in JP-A-2008-254395 and JP-A-2011-73208, information in a plurality of memory cards or in a separate memory card can be added to the liquid stock amount on the main unit side, and printing can be carried out continuously until the amount of ink corresponding to the ink amount stored on the main unit side runs out. However, in the case where an error occurs in the printing apparatus main unit and the ink amount information is lost, the information loss may render the stocked (charged) ink unusable, which is an undesirable situation.

Unlike the technique disclosed in JP-A-2014-46545, with the techniques disclosed in JP-A-2008-254395 and JP-A-2011-73208, it is conceivable that the information managed on the main unit and the information in the memory unit will not match. Accordingly, to determine whether the information in the memory unit is appropriately transferred to the main unit, it is necessary for the user to know both the state of the printing apparatus main unit and the state of the memory unit. However, no technique for presenting both pieces of information to the user is disclosed.

Meanwhile, JP-A-2014-46611 does not assume that the information in a plurality of memory cards or separate memories is written (added) to the storage unit on the main unit side. Thus with respect to the amount of ink, it is not assumed that the information in the storage member on the main unit side and the information in the chip unit will diverge, and the only action taken is a display making a notification of an attachment malfunction for the chip unit. Furthermore, there is only a single display region, and no mention is made of dividing the display region between the main unit side and the chip unit side.

Thus what is needed is a printing apparatus that makes it possible to print continuously with little burden on a user, and can properly manage ink even during breakdowns. Additionally, what is needed is the ability for a printing apparatus to appropriately manage information regarding ink, display both printing apparatus-side information and information in a removable memory unit in an easy-to-understand manner, and so on.

SUMMARY

Having been conceived in order to solve at least one of the aforementioned problems, an advantage of the invention is that a printing apparatus can be implemented as the following aspects or application examples.

Application Example 1

A printing apparatus according to this application example includes a slot to and from which a memory unit storing permitted usage amount information of ink held in an ink holding unit can be attached and removed, and a processing unit that carries out a process for updating estimated ink amount information that is information for estimating an amount of the ink in the ink holding unit. In the case where a first memory unit has been attached to the slot, the processing unit carries out a charging process that updates the estimated ink amount information using the permitted usage amount information in the first memory unit. In the case where a second memory unit has been attached to the slot after the charging process, the processing unit does not carry out the charging process using the second memory unit until a consumed ink amount expressed by the estimated ink amount information exceeds a prescribed threshold, and in the case where the consumed ink amount has exceeded the prescribed threshold, the processing unit carries out the charging process using the second memory unit.

According to the configuration of this application example, in the case where the second memory unit has been attached after the charging process using the first memory unit, the processing unit determines whether or not to carry out the charging process using the second memory unit in accordance with a relationship between the estimated ink amount information and the prescribed threshold. Through this, the first memory unit can be removed after the charging process, the charging process using the second memory unit can be reserved, and automatic charging (the charging process using the second memory unit) in the case where the estimated amount of ink in the ink holding unit that is consumed has exceeded the prescribed threshold can be carried out, which makes it possible to realize continuous printing operations with little burden on the user.

Application Example 2

A printing apparatus according to this application example includes a slot to and from which a memory unit storing permitted usage amount information of ink held in an ink holding unit can be attached and removed, and a processing unit that carries out a process for updating estimated ink amount information that is information for estimating an amount of the ink in the ink holding unit. In the case where the memory unit has been attached to the slot, the processing unit carries out a charging process that updates the estimated ink amount information using the permitted usage amount information in the memory unit. The processing unit carries out a process for displaying state information of the permitted usage amount information of the memory unit in a first display region of a display unit and carries out a process for displaying state information of the estimated ink amount information updated by the processing unit in a second display region of the display unit.

According to the configuration of this application example, the processing unit carries out a process for displaying the state information of the permitted usage amount information of the memory unit in the first display region and a process for displaying the state information of the estimated ink amount information on a printing apparatus main unit side in the second display region. Through this, the memory unit-side information and the main unit-side information can be displayed using mutually different regions, and thus information regarding the ink can be presented to the user in an easy-to-understand manner.

Application Example 3

In the printing apparatus according to the aforementioned application examples, in the case where the memory unit has been attached to the slot, the processing unit may carry out a charging process that updates the estimated ink amount information using the permitted usage amount information in the memory unit; and in the case where the charging process has been carried out, the processing unit may carry out a process for displaying information expressing that the memory unit has become invalid in the first display region, and may carry out a process for displaying information expressing that the estimated ink amount information has been updated by the permitted usage amount information in the second display region.

Through this, a change on the main unit side and a change on the memory unit side resulting from the charging process can be presented in an easy-to-understand manner using the respective display regions.

Application Example 4

In the printing apparatus according to the aforementioned application examples, the processing unit may carry out a process for displaying information identifying whether or not the charging process has succeeded in the display unit.

Through this, whether or not the charging process has succeeded can be presented to the user.

Application Example 5

In the printing apparatus according to the aforementioned application examples, in the case where a second memory unit has been attached to the slot after the charging process using a first memory unit, the processing unit may not carry out the charging process using the second memory unit until a consumed ink amount expressed by the estimated ink amount information exceeds a prescribed threshold, and in the case where the consumed ink amount has exceeded the prescribed threshold, the processing unit may carry out the charging process using the second memory unit.

Through this, a reservation for the charging process using the second memory unit (a reservation process) and the charging process using the second memory unit in the case where the estimated consumed ink amount in the ink holding unit has exceeded the prescribed threshold (automatic charging) can be executed.

Application Example 6

In the printing apparatus according to the aforementioned application examples, the processing unit may carry out a process for displaying information expressing that the second memory unit is in a reserved state in the display unit until the consumed ink amount expressed by the estimated ink amount information exceeds the prescribed threshold.

Through this, information regarding the reservation process can be presented to the user.

Application Example 7

In the printing apparatus according to the aforementioned application examples, the processing unit may carry out the process for displaying information expressing that the second memory unit is in the reserved state in the first display region of the display unit.

Through this, information regarding the reservation process can be presented to the user by using the first display region.

Application Example 8

In the printing apparatus according to the aforementioned application examples, the processing unit may carry out a process for displaying information identifying whether or not a reservation by the second memory unit has succeeded in the display unit.

Through this, information regarding whether or not the reservation has succeeded can be presented to the user as the information regarding the reservation process.

Application Example 9

In the printing apparatus according to the aforementioned application examples, in the case where the memory unit is not attached to the slot, the processing unit may display information expressing that the memory unit is not attached in the display unit.

Through this, that the memory unit is not attached to the slot can be presented to the user.

Application Example 10

A printing apparatus according to this application example includes a slot to and from which a memory unit storing permitted usage amount information of ink held in an ink holding unit can be attached and removed, and a processing unit that carries out a process for updating estimated ink amount information that is information for estimating an amount of the ink in the ink holding unit. In the case where a first memory unit has been attached to the slot, the processing unit carries out a charging process that updates the estimated ink amount information using the permitted usage amount information in the first memory unit. In the case where a second memory unit has been attached to the slot after the charging process, the processing unit does not carry out the charging process using the second memory unit until a consumed ink amount expressed by the estimated ink amount information exceeds a prescribed threshold, and in the case where the consumed ink amount has exceeded the prescribed threshold, the processing unit carries out the charging process using the second memory unit. The processing unit carries out a process for displaying information expressing that the second memory unit is in a reserved state in the display unit until the consumed ink amount expressed by the estimated ink amount information exceeds the prescribed threshold.

According to the configuration of this application example, in the case where the second memory unit has been attached after the charging process using the first memory unit, the processing unit determines whether or not to carry out the charging process using the second memory unit in accordance with a relationship between the estimated ink amount information and the prescribed threshold. Through this, a reservation can be made using the second memory unit, which makes it possible to realize continuous printing operations with little burden on the user. Furthermore, the processing unit carries out a process for displaying information expressing the reserved state. It is assumed that information will not be transferred to the main unit side while in the reserved state, and thus while it would be difficult for the user to understand the state of the memory unit, information regarding that memory unit can be presented to the user appropriately.

Application Example 11

The printing apparatus according to the aforementioned application examples may further include a storage unit that stores a charged flag and a reserved flag. In the case where the charging process using the first memory unit has been carried out, the processing unit sets the charged flag to on, and in the case where the second memory unit has been attached to the slot before the consumed ink amount exceeds the prescribed threshold, the processing unit sets the reserved flag to on.

Through this, by storing the states to which the charged flag and the reserved flag have been set and setting the flags at prescribed timings, an appropriate charging process and reservation process can be realized.

Application Example 12

In the printing apparatus according to the aforementioned application examples, in the case where the charging process using the second memory unit is carried out, the processing unit may set the reserved flag to off.

Through this, by setting the reserved flag at a prescribed timing, an appropriate charging process and reservation process can be realized.

Application Example 13

In the printing apparatus according to the aforementioned application examples, in the case where the consumed ink amount expressed by the estimated ink amount information has exceeded the prescribed threshold in a state where the second memory unit set to a valid state is attached to the slot, the processing unit may carry out the charging process using the second memory unit; and in the case where the consumed ink amount expressed by the estimated ink amount information has exceeded the prescribed threshold in a state where the second memory unit set to an invalid state is attached to the slot, the processing unit may not carry out the charging process using the second memory unit.

Through this, whether or not the charging process using the second memory unit can be executed can be determined in accordance with whether the second memory unit is in a valid state or an invalid state.

Application Example 14

In the printing apparatus according to the aforementioned application examples, the ink holding unit may be an ink tank that can be filled with ink from the exterior.

Through this, the ink holding unit can be realized by an ink tank.

Application Example 15

In the printing apparatus according to the aforementioned application examples, the ink tank may be a tank that can be filled with ink from an ink refill receptacle, and the memory unit may be packaged with the ink refill receptacle.

Through this, a printing apparatus that uses ink within an ink refill receptacle packaged with a memory unit in association with each other can be realized.

Application Example 16

In the printing apparatus according to the aforementioned application examples, in the case where the charging process using the memory unit has been carried out, the processing unit may set the memory unit to an invalid state.

Through this, reuse of the memory unit after the charging process can be suppressed.

Application Example 17

In the printing apparatus according to the aforementioned application examples, the processing unit may carry out a process for writing the estimated ink amount information as backup information into a region, of storage regions in the first memory unit, that is different from a region in which the permitted usage amount information is stored, after the charging process using the first memory unit.

According to this configuration, the processing unit writes the estimated ink amount information as backup information into a region, of storage regions in the memory unit with which the charging process has been carried out, that is different from the region in which the permitted usage amount information used in the charging process is stored. Through this, even in a case such as where an error has occurred in the printing apparatus and the estimated ink amount information has been lost, the information can be restored or the like as appropriate using the backup information in the memory unit.

Application Example 18

In the printing apparatus according to the aforementioned application examples, in the case where the first memory unit that had been attached to the slot has been removed and it has been detected that the second memory unit has been attached to the slot, the processing unit may carry out a process for writing the estimated ink amount information as backup information into a region, of storage regions in the second memory unit, that is different from a region in which the permitted usage amount information is stored.

Through this, even in the case where a different memory unit from the memory unit used in the charging process has been attached, the estimated ink amount information can be backed up as appropriate using that different memory unit.

Application Example 19

In the printing apparatus according to the aforementioned application examples, in the case where the charging process using the memory unit has been carried out, the processing unit may set the memory unit to an invalid state by writing invalidating data into a region, of storage regions in the memory unit, in which the permitted usage amount information is stored.

Through this, it is possible to set the memory unit to the invalid state using the storage region in which the permitted usage amount information is stored.

Application Example 20

The printing apparatus according to the aforementioned application examples may further include a storage unit that stores the estimated ink amount information, and the backup information may be information used to restore the estimated ink amount information in the case where an error has arisen in the estimated ink amount information in the storage unit.

Through this, the backup information can be used as information for restoration in the case where an error has occurred in the estimated ink amount information in the storage unit of the printing apparatus.

BRIEF DESCRIPTION OF THE DRAWINGS

The invention will be described with reference to the accompanying drawings, wherein like numbers reference like elements.

FIG. 2 is an address map of storage regions in a memory unit according to the first embodiment.

DESCRIPTION OF EXEMPLARY EMBODIMENTS

Embodiments will be described hereinafter. Note that the embodiments described hereinafter is not intended to limit the invention as described in the claims in any way. Furthermore, it is not necessarily the case that all of the elements described in the embodiments are requisite elements of the invention.

First Embodiment

1. Technique According to Embodiment

Figure 6:
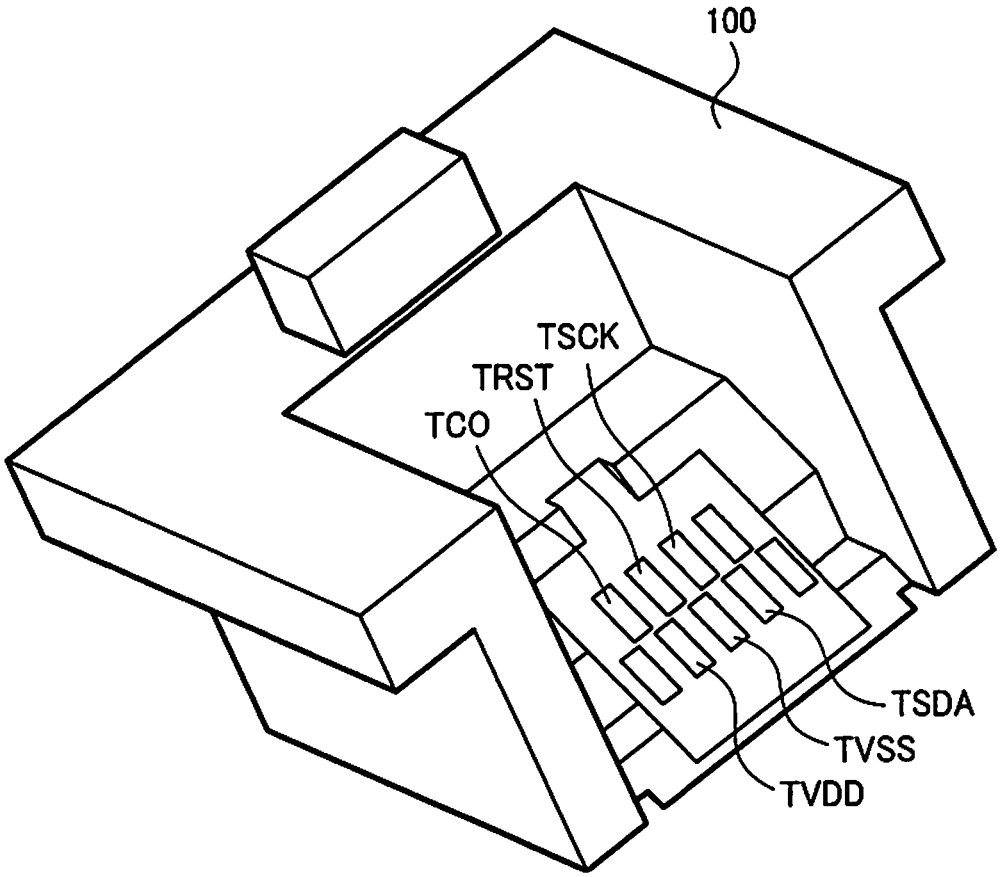
FIG. 6 is a perspective view illustrating an example of the configuration of a memory unit according to the first embodiment.

First, a technique according to the embodiment will be described in comparison to past techniques. Printing apparatuses that carry out a counting process (soft counting process) that counts a cumulative value of an amount of ink consumed while the printing apparatus is operating and find an estimated consumed ink amount for ink within an ink tank are widely known. Furthermore, printing apparatuses in which an ink refill receptacle (ink pack 310) filled with ink and a memory unit 100 that stores information regarding the ink with which the ink refill receptacle has been filled, such as information of the color, volume, and the like of the ink, are provided to a user of the printing apparatus as separate units are widely known, as illustrated in FIG. 6 of JP-A-2014-46545.

In printing apparatuses, managing the amount of ink remaining in an ink holding unit is extremely important for carrying out printing processes correctly, and a consumed ink amount found through a counting process may be used in this management. To be more specific, an amount of ink permitted to be used is defined by permitted usage amount information stored in the memory unit 100, and printing operations are carried out until it is determined that the amount of ink defined by the permitted usage amount information has been consumed. In the case where it has been determined that the amount of ink defined by the permitted usage amount information has been consumed, the user may be instructed to refill the ink, the printing operations may be stopped, or the like.

However, in the case where the ink pack 310 and the memory unit 100 are separate units, the timing at which the ink holding unit (ink tank) of the printing apparatus is refilled with ink from the ink pack 310 and the timing at which the memory unit 100 is attached to the printing apparatus will not necessarily match. Accordingly, the amount of ink determined to be usable on the printing apparatus main unit (called simply a "main unit" hereinafter) side may differ from the actual amount of ink in the ink tank.

JP-A-2014-46545 discloses a technique presuming management for suppressing such a difference. Specifically, the consumed ink amount is managed by reading and writing total consumed ink amount information each time a difference in consumed ink amounts exceeds WTH1 in order to ensure the total consumed ink amount information is compatible between the memory unit 100 and the printing apparatus main unit. With the technique according to JP-A-2014-46545, a user can use the printing apparatus through the following usage method: (1) the ink is refilled from the ink pack 310, and the memory unit 100 is attached; (2) printing is carried out, while writing the total consumed ink amount into the memory unit, until the total consumed ink amount on the main unit side reaches or exceeds WTH2; and (3) the process returns to (1) when the total consumed ink amount is less than WTH3 but greater than or equal to WTH2, where the ink is refilled from a new ink pack 310 supplied by a vendor, a new memory unit 100 included with the ink pack 310 is attached, and the main unit-side total consumed ink amount is overwritten with a memory unit-side total consumed ink amount from the memory unit 100.

However, investigations by the applicants for this application revealed that actual usage situations differ from that described above. As disclosed in JP-A-2014-46545, the printing apparatus executes printing operations under the condition that a new, valid memory unit 100 has been attached. Accordingly, if the memory unit 100 is not properly attached, the printing cannot be executed even if the ink tank is filled with ink from the ink pack 310.

Printing operations can be carried out in some form even when the ink the ink tank is actually filled with is not ink supplied by the printing apparatus vendor (that is, is not ink supplied as part of an ink pack set 300), as long as there is a valid memory unit 100. In the case where ink supplied by the vendor is not used, the memory unit 100 in the ink pack set 300 is relatively expensive, whereas the ink pack 310 is relatively cheap.

The result is that differences arise between the ways in which the memory unit 100 and the ink pack 310 are managed. For example, in the case where the printing apparatus is to be used in a factory, the users of the printing apparatus are an administrator and an ordinary worker working under the administrator. Because the ink pack 310 does not require strict management, an ordinary worker can handle the ink pack 310 without restrictions, and can therefore refill the ink in the ink tank at the appropriate time. As opposed to this, the memory unit 100 is managed by the administrator.

In such a case, the ink tank can be refilled with the ink held in the ink pack 310 at any time as long as the ink does not overflow from the ink tank. However, the memory unit 100 can only be attached during the limited amount of time when the administrator is working. Recently, inks contained in ink packs 310 have risen to such high volumes as 1 L. Printing apparatuses themselves have increased in size as well, and thus printing can only be carried out continuously for approximately 12 hours, for example, even if the ink tank is filled with all of the ink from the ink pack 310. As such, in the case where a management system such as that described above is employed, it is necessary for a small number of administrators to attach the memory unit 100 to the printing apparatus at least every 12 hours. This increases the burden on users when using the printing apparatus to print continuously.

As described above, according to the technique disclosed in JP-A-2014-46545, when printing continuously, the timing at which the memory unit 100 is replaced is restricted. As a result, there is a problem in that continuous printing is burdensome for users or is simply difficult to carry out.

In response to such an issue, a technique can be considered in which when a memory card or a separate memory (called simply a "memory card" hereinafter, including the separate memory) is attached, a volume (ink volume) stored in the memory card is added to a liquid stock amount on the main unit side, as disclosed in JP-A-2008-254395, JP-A-2011-73208, or the like. According to JP-A-2008-254395 and JP-A-2011-73208, the information in the memory card is moved to the main unit side, and thus printing operations can continue even after the memory card is removed from the printing apparatus. Furthermore, even in the case where a plurality of memory cards have been attached, the volume in each memory card is added on the main unit side and managed, and thus continuous printing is possible thereafter for a relatively long period of time even if a new memory card is not mounted.

However, according to JP-A-2008-254395 or JP-A-2011-73208, it is conceivable that the memory card from which the stored volume has been added to the liquid stock amount on the main unit side has been set to an invalid state. This is because not doing so would enable a single memory card to be used repeatedly, which is unreasonable. Accordingly, it is assumed that memory cards whose volumes have been added to the main unit side will not be used thereafter, and information regarding the amount of ink actually consumed relative to the volume stored in the memory card cannot be held.

As a result, in the case where an error occurs on the main unit side and information of the liquid stock amount managed on the main unit side has been lost, information indicating how much volume has been added and how much of that volume has been consumed cannot be recovered. If the usable ink amount is set to 0 after the printing apparatus is restored (repaired), a user who has only used some of the ink corresponding to the volume stored in the memory card may be adversely affected. However, setting the liquid stock amount to the total amount of the volume stored in the memory card (or to the maximum value that can be added on the main unit side) instead may compensate the user excessively. In other words, the techniques according to JP-A-2008-254395 and JP-A-2011-73208 have a problem in that it is difficult to respond appropriately when a malfunction occurs.

Additionally, neither JP-A-2008-254395 nor JP-A-2011-73208 disclose a technique for presenting specific information to the user. For example, in the case where a memory card has been attached but the information has not been added on the main unit side, it is likely that the user will wish to know the cause of that problem. A case where the added amount is at its limit on the main unit side or a case where there is a problem in the memory card can be given as examples of the causes of such a problem.

In the case where the problem is in the memory card, it is assumed that the user will wish to identify the cause of the problem, namely whether the attachment state is poor and there is a problem with the connection, whether the memory card has been attached to the wrong color slot, or whether the memory card has been used and is invalid. In other words, even if the information in the memory card is to be moved to the main unit side through the charging process, displaying just the state on the main unit side is insufficient. It is important to display the states on both the main unit side and the memory card side.

Note that JP-A-2014-46611 discloses a technique in which information based on an ink amount stored in a storage member of the printing apparatus and information based on a chip unit (corresponding to a memory unit) is displayed. However, the display regarding the chip unit is basically a display communicating that there is an attachment problem, and furthermore, the main unit-side information and the chip unit-side information are not separated in the display region. This is because in JP-A-2014-46611, charging operations are not a prerequisite, and there is thus little need to take into consideration discrepancies between the ink amount stored in the printing apparatus and the ink amount stored on the chip unit side. As such, the presentation of information regarding the chip unit basically only considers whether or not the chip unit has been mounted correctly.

2. Example of System Configuration of Printing Apparatus

Figure 1:
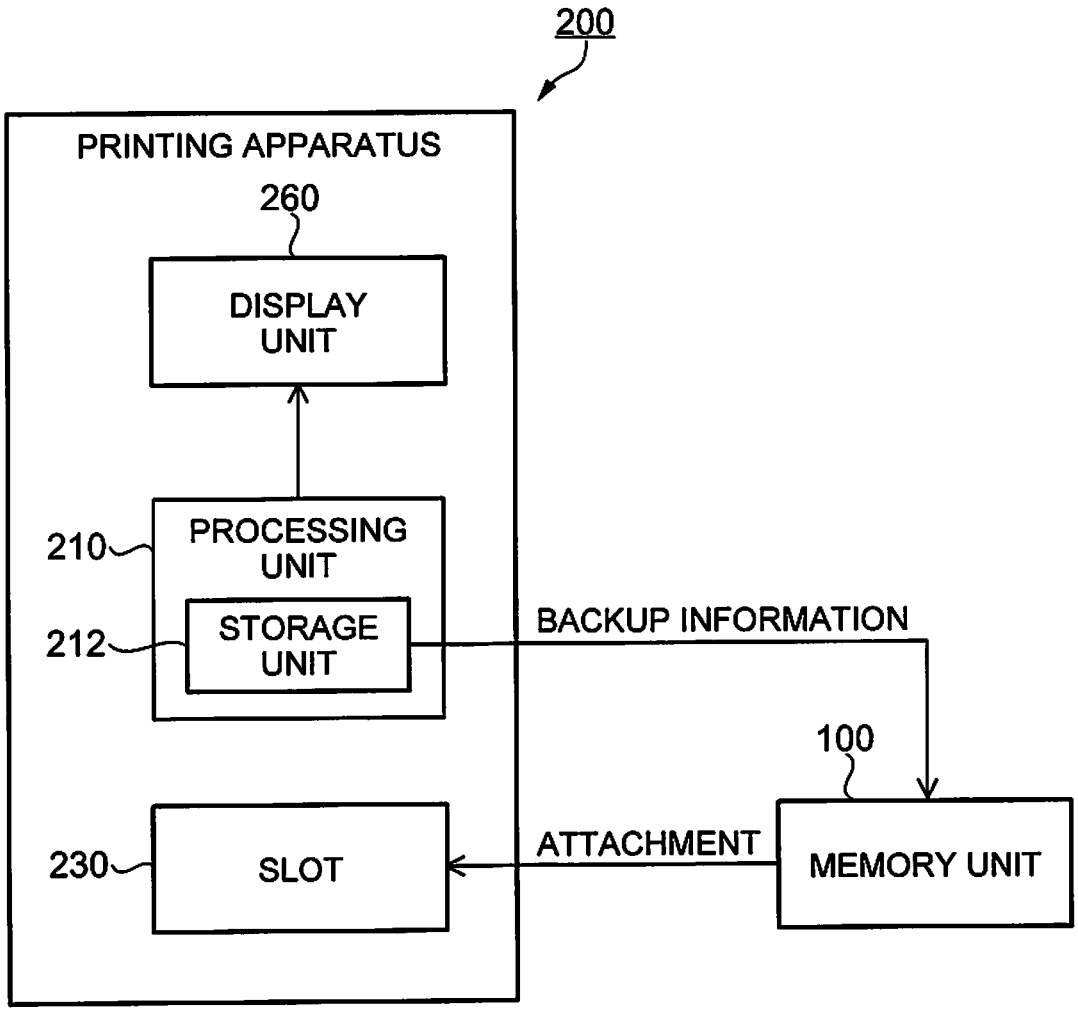
FIG. 1 is a diagram illustrating an example of the system configuration of a printing apparatus according to a first embodiment of the invention.

An example of the system configuration of the printing apparatus according to the first embodiment will be described hereinafter with reference to FIGS. 1 and 2. FIG. 1 is a diagram illustrating an example of the system configuration of the printing apparatus according to the first embodiment. As illustrated in FIG. 1, a printing apparatus 200 according to the first embodiment includes a slot 230 to and from which a memory unit 100 can be attached and removed, a processing unit 210, and a display unit 260 that is part of a UI unit 250 (see FIG. 3).

The memory unit 100 stores permitted usage amount information of the ink (information based on an amount of ink with which an ink refill receptacle, which will be mentioned later, has been filled). In the following, a memory unit with which a charging process (described later) is carried out will be referred to as a first memory unit 100-1, and a memory unit 100 for reservation purposes (described later) will be referred to as a second memory unit 100-2.

Figure 3:
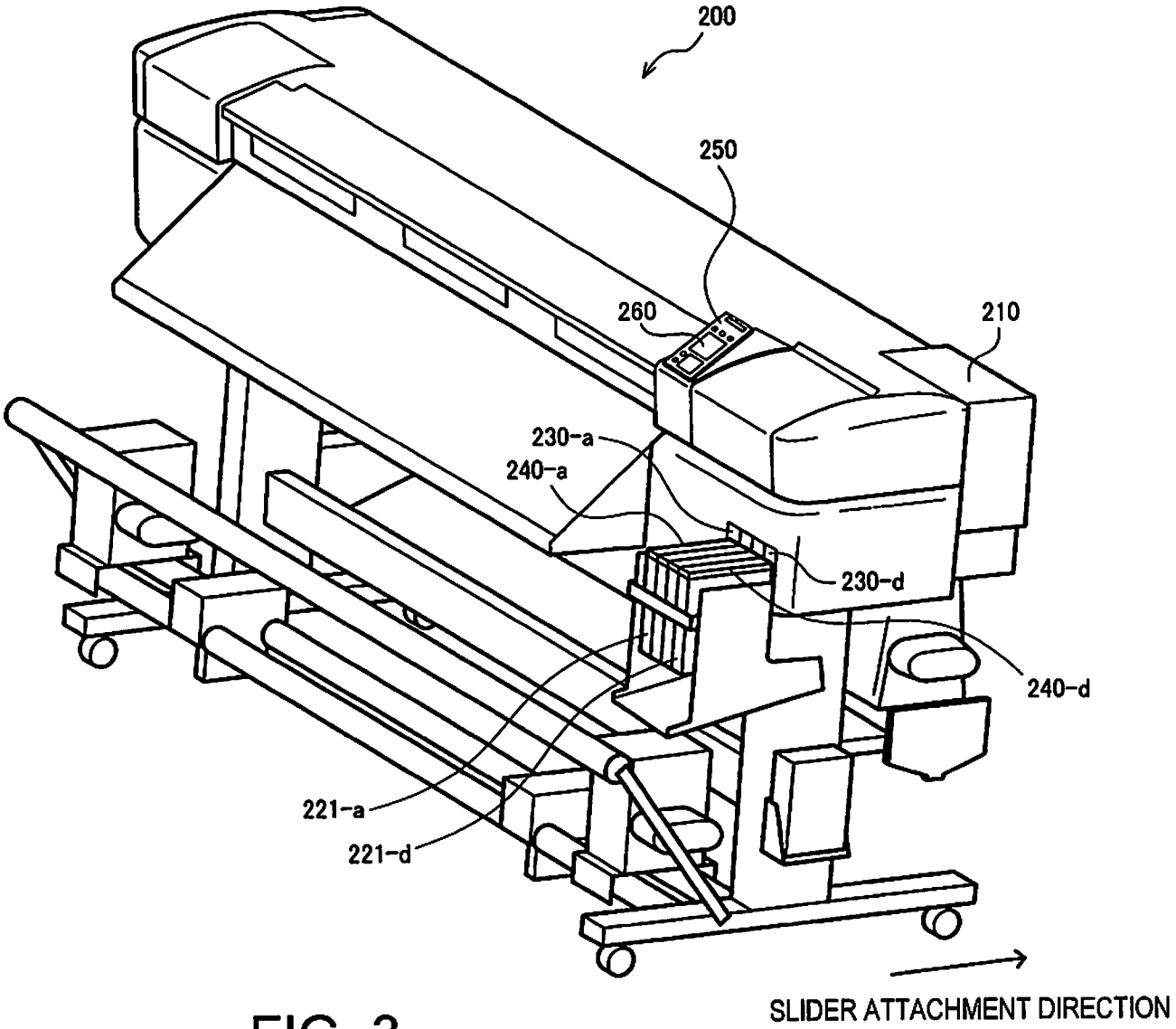
FIG. 3 is a perspective view illustrating an example of the configuration of a printing apparatus according to the first embodiment.

The processing unit 210 carries out a process for updating estimated ink amount information (information indicating an estimated amount of ink within an ink holding unit 220), which is information for estimating the amount of ink in the ink holding unit 220 (see FIG. 3). In other words, in the case where the first memory unit 100-1 has been attached to the slot 230, the processing unit 210 carries out a charging process for updating the estimated ink amount information on the basis of the permitted usage amount information from the first memory unit 100-1.

In the case where the second memory unit 100-2 is attached to the slot 230 after the charging process carried out using the first memory unit 100-1, the processing unit 210 does not carry out a charging process using the second memory unit 100-2 until the consumed ink amount expressed by the estimated ink amount information exceeds a prescribed threshold (WTH). In the case where the consumed ink amount has exceeded the prescribed threshold, the processing unit 210 carries out the charging process using the second memory unit 100-2.

Then, after the charging process, the processing unit 210 carries out a process for writing the estimated ink amount information as backup information into a region, of storage regions in the memory unit 100, that is different from a region in which the permitted usage amount information is stored. FIG. 2 is an address map of the storage region in the memory unit according to the first embodiment. As illustrated in FIG. 2, the storage region of the memory unit 100 has a region that stores the backup information (the region specified by address ad4), in a different region from a region that stores the permitted usage amount information (the region specified by address ad3).

Figure 11:
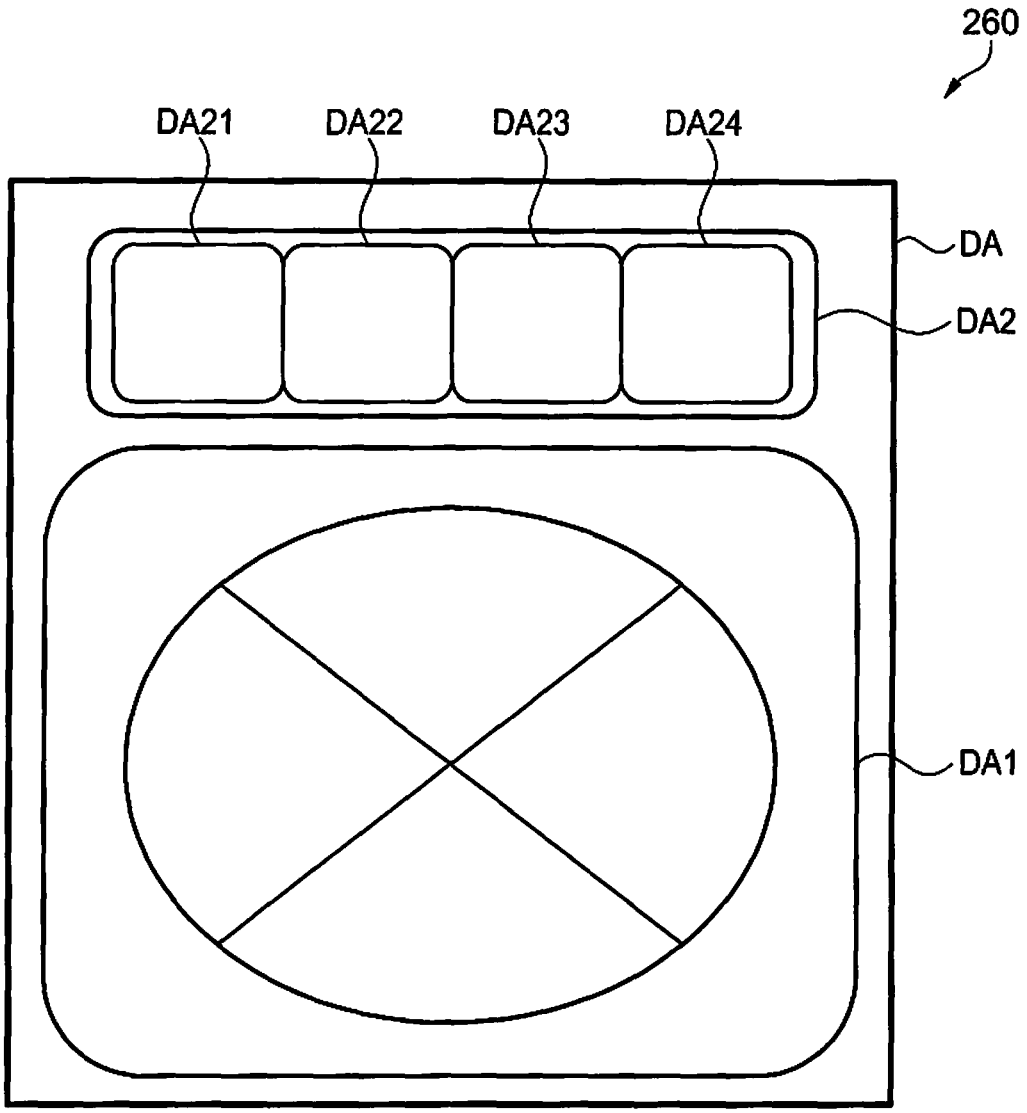
FIG. 11 is a diagram illustrating an example of a screen displayed in a display unit in accordance with a state of the printing apparatus, according to the first embodiment of the invention.

Furthermore, the processing unit 210 carries out a process for displaying state information of the permitted usage amount information from the memory unit 100 in a first display region DA1 of the display unit 260 (see FIG. 11), and carries out a process for displaying state information of the estimated ink amount information updated by the processing unit 210 in a second display region DA2 of the display unit 260 (see FIG. 11).

Although the display unit 260 is assumed to be provided in the printing apparatus 200 and be a display unit realized by a liquid crystal display, an organic EL display, or the like, the display unit 260 may be a display unit of another device connected to the printing apparatus 200 (a PC or a smartphone connected to the printing apparatus over a wireless LAN, for example). Here, the "process for displaying" is, for example, a process of generating data to be displayed in the display unit 260 in accordance with the attachment state of the memory unit 100 and the estimated ink amount information, a process of outputting that data to the display unit 260, and a process of controlling the display in the display unit 260. In the case where the display unit is another device outside the printing apparatus that is connected to the printing apparatus, the "process for displaying" is a process of generating data to be displayed in the display unit 260 in accordance with the attachment state of the memory unit 100 and the estimated ink amount information and a process of outputting that data to the display unit 260.

In this manner, the processing unit 210 displays the permitted usage amount information from the memory unit 100 and the estimated ink amount information from the printing apparatus 200 in mutually different display regions of the display unit 260 (the first display region DA1 and the second display region DA2). The two different pieces of information can thus be presented to the user in an easy-to-understand manner.

Here, the permitted usage amount information is information stored in the memory unit 100, and is information expressing an amount of ink the user who holds that memory unit 100 is permitted to use (a permitted usage amount). More specifically, the permitted usage amount information is stored as information of an initial fill amount of ink held in an ink pack 310 (see FIG. 8) with which the memory unit 100 is included and a consumed ink amount indicating an amount already consumed relative to that initial fill amount. The consumed ink amount is stored as data indicating a percentage of ink consumed relative to the initial fill amount of the ink. 0% is stored as the consumed ink amount at the point in time when the user purchases an ink pack set 300 (see FIG. 8).

By purchasing the ink pack set 300, the user also purchases the right to use only the ink contained in the ink pack 310. The printing apparatus 200 executes a process for continuing/stopping printing operations of the printing apparatus 200 using the permitted usage amount information from the memory unit 100.

Meanwhile, the estimated ink amount information is information for estimating the amount of ink in the ink holding unit 220, and is stored in a rewritable and non-volatile manner in a storage unit 212 of the printing apparatus 200. In this embodiment, the estimated ink amount information is expressed by the consumed ink amount. Here, the consumed ink amount is a percentage of the total amount of ink consumed (also called "main unit-side total consumed ink amount information WD") relative to the initial fill amount read out from the attached memory unit 100. As will be described later, the main unit-side total consumed ink amount information WD is replaced with the consumed ink amount from the memory unit 100 in the charging process carried out when the memory unit 100 is attached. The processing unit 210 of the printing apparatus 200 controls the continuing/stopping of the operations of the printing apparatus 200 on the basis of the estimated ink amount information.

In other words, the estimated ink amount information is expressed as information indicating an amount of ink consumed relative to a usable ink amount (permitted usage amount; initial fill amount). The amount of ink consumed after the memory unit 100 has been attached and the main unit has been charged with the permitted usage amount information from the memory unit 100 is counted, and information expressing what percent of the initial fill amount the consumed ink amount found through the counting process represents is taken as the main unit-side total consumed ink amount information WD.

The total consumed ink amount information WD can be expressed, for example, as a relative value (0-100%), with the amount of ink held in the ink pack 310 (here, the capacity of the ink pack 310 is assumed to be 1 L) representing 100%. The processing unit 210 reads out the initial fill amount of the ink pack 310 from the memory unit 100, calculates the relative value from the initial fill amount and the amount of ink consumed, and takes the result of that calculation as the consumed ink amount.

However, an actual printing apparatus 200 has an allowance with respect to the ink consumption efficiency (printing efficiency). In other words, there are printing apparatuses 200 in which the actual amount of ink consumed (called an "actual consumed ink amount" hereinafter) is comparatively high or printing apparatuses 200 in which the actual consumed ink amount is comparatively low. As such, there are cases where the actual consumed ink amount and the consumed ink amount found through the counting process do not match even when printing processes are carried out using the same print data.

Accordingly, this embodiment assumes a case in which a printing apparatus 200 whose ink consumption efficiency is a lower limit value of a predetermined range (that is, a printing apparatus having the highest actual consumed ink amount) is used in a usage environment recommended by the vendor of the printing apparatus, and expresses the consumed ink amount as a relative value, using the consumed ink amount estimated for when the ink held in the ink pack 310 is consumed as 100%.

Doing so makes it possible even for a printing apparatus 200 having the worst ink consumption efficiency to print until the consumed ink amount reaches 100%, and a process for displaying a message prompting the user to refill the ink can be carried out upon the consumed ink amount reaching 100%.

Such being the case, when a printing apparatus 200 having a standard ink consumption efficiency is used in a standard environment, the consumed ink amount for when the amount of ink contained in the ink pack 310 is actually consumed (a consumed ink amount percentage) will be greater than 100%, for example, 117%. The vendor of the printing apparatus stores the total consumed ink amount information WD for when all of the ink contained in the ink pack 310 has been consumed by the printing apparatus 200 having a standard ink consumption efficiency (117%, here) in the storage unit 212 of the processing unit 210 in advance. The processing unit 210 calculates the total consumed ink amount information WD from this value, the initial fill amount (expressed in units of weight) read out from the memory unit 100, and a total consumed ink amount (expressed in units of weight), and stores the calculated information in the storage unit 212.

Although the ink pack 310 is a 1 L ink pack, there may be slight variations in the amount contained therein from ink pack 310 to ink pack 310. However, variations in the initial fill amounts stored as the initial fill amounts in the memory units 100 of the ink packs 310 are small compared to the allowance in the ink consumption efficiency. Accordingly, the total consumed ink amount information WD may be calculated assuming that the total consumed ink amount information WD set in advance by the vendor for when all of the 1 L of ink contained in the ink pack 310 has been consumed by the printing apparatus 200 having a standard ink consumption efficiency (that is, 117%) corresponds to the initial fill amount.

However, rather than storing a percentage of the main unit-side consumed ink amount itself, the initial fill amount and a weight of the total consumed ink amount may be stored on the main unit side as the estimated ink amount information. In this case, the processing unit 210 may calculate the total consumed ink amount information WD as appropriate on the basis of this information.

The charging process according to this embodiment is a process in which a process for updating the total consumed ink amount information WD (consumed ink amount) of the main unit-side estimated ink amount information on the basis of the consumed ink amount in the permitted usage amount information stored in the memory unit 100 attached to the slot 230 at that time is carried out, and the initial fill amount stored in the memory unit 100 is set in the storage unit 212 as information with which the main unit-side processing unit 210 calculates the total consumed ink amount information WD.

Note that in the case where the main unit-side estimated ink amount information and the permitted usage amount information in the memory unit 100 have the same format, as is the case in this embodiment, the consumed ink amount of the estimated ink amount information may simply be replaced with the consumed ink amount in the permitted usage amount information in the updating process. However, in the case where the estimated ink amount information and the permitted usage amount information have different formats, such as a case where the memory unit 100 stores a percentage and the main unit stores a weight of the ink that has been consumed, a process for replacing the estimated ink amount information may be carried out on the basis of a result of carrying out some kind of conversion process on the permitted usage amount information. "Replace" refers to a process that also includes post-conversion replacement in this embodiment.

Additionally, the storage region of the memory unit 100 may be managed on the basis of addresses, and the "region different from the region in which the permitted usage amount information is stored" may be a region specified by an address different from the address at which the permitted usage amount information is stored. In FIG. 2, addresses are provided on a byte-by-byte basis, and what types of information are stored in the respective addresses, and how many bits are used are shown.

In the example illustrated in FIG. 2, ID information of the memory unit 100 is stored using 8 bits of a storage region corresponding to address ad1 (for example, a region that takes ad1 as a starting address). Color information expressing the color of the ink is stored using 2 bits of a storage region corresponding to address ad2. The permitted usage amount information is stored using 8 bits of a storage region corresponding to address ad3. Finally, the backup information is stored using 8 bits of a storage region corresponding to address ad4.

Note that the information stored in the memory unit 100 illustrated in FIG. 2 is merely an example, and other information may be stored in the memory unit 100. Additionally, the size (number of bits) of each piece of information stored in the memory unit 100 is not limited to that illustrated in FIG. 2, and a variety of variations are possible. For example, in the case where the permitted usage amount information is expressed by the initial fill amount and the consumed ink amount relative to the initial fill amount, the region for storing the permitted usage amount information may be divided into two regions, namely a first region and a second region, with the first region storing the initial fill amount and the second region storing the consumed ink amount. Additionally, in the case where the estimated ink amount information of the printing apparatus 200 is expressed by a usable ink amount (initial fill amount) and the consumed ink amount, the region storing the backup information may be divided into two regions, with the first region storing the initial fill amount and the second region storing the consumed ink amount.

According to the technique of this embodiment, first, upon the first memory unit 100-1 being attached, the processing unit 210 carries out the charging process for updating the estimated ink amount information on the basis of the permitted usage amount information from that first memory unit 100-1. In other words, the processing unit 210 transfers the permitted usage amount information (the "volume" and "ink volume" described in JP-A-2008-254395 and JP-A-2011-73208) from the first memory unit (the first memory unit 100-1) to the main unit side, in the same manner as in JP-A-2008-254395 and JP-A-2011-73208. As a result, the user can remove the first memory unit 100-1 from the slot 230 after the charging process, and printing operations of the printing apparatus 200 do not stop even without a memory unit 100 attached.

Normally, a memory unit 100 with which a charging process has been carried out has had the necessary information transferred to the main unit side, and it is thus assumed that no further data will be read therefrom or written thereto. However, in this embodiment, if the first memory unit 100 is attached to the slot 230, the estimated ink amount information is written into the memory unit 100 at an appropriate timing even after the charging process, as a backup for cases where the main unit malfunctions. By writing the backup information from the memory unit 100 into the main unit, the user can recover the estimated ink amount information corresponding to the actual consumed ink amount even if the estimated ink amount information on the main unit side has been lost due to a malfunction. Furthermore, a memory unit 100 that would otherwise be unnecessary can be repurposed as a backup memory, which is advantageous in that it eliminates the need to prepare a separate external storage device specifically for backups.

The timing at which to execute the backup is set as appropriate, such as each time no less than a predetermined amount of ink has been consumed in normal printing operations (for example, each time 1% of the ink has been consumed), when a print job is finished, when maintenance is carried out, or the like.

Here, a technique for writing the backup information into the storage region where the permitted usage amount information is stored can also be considered. However, in the case where a value in a correct range is written into that region as the permitted usage amount (for example, greater than or equal to 0% and less than WTH %, for a usage percentage), there is a risk that a charged memory unit 100 will be reused as a result.

For example, if ink has been consumed up to 20% of the initial fill amount after the charging process has been carried out, the estimated ink amount information (consumed ink amount) will be information indicating 20%, and that information will be written into the memory unit 100. In the case where this write is made into the region storing the permitted usage amount information (and particularly, the consumed ink amount), the technique according to JP-A-2014-46545 will determine that only 20% of the initial fill amount for that memory unit 100 has been used, and that the remainder (80% of the initial fill amount) can be used by attaching that memory unit 100 to the printing apparatus 200. In other words, despite the rights held by the memory unit 100 (the right to print an amount equivalent to the permitted usage amount) having been completely transferred to the main unit side by the charging process, there is a risk that the memory unit 100 will be considered to have valid rights and be able to be reused.

Of course, it is conceivable to provide a region, in another storage region of the memory unit 100, for writing a flag expressing an invalid (charged) state, and then making a determination on the basis of that flag during use, thus making it possible to prohibit used memory units 100 from being reused regardless of the value of the permitted usage amount information. However, whether or not to refer to such a flag is determined by the specifications of the printing apparatus, and thus in the case where a memory unit 100 is shared between the printing apparatus 200 according to this embodiment and another printing apparatus (the printing apparatus disclosed in JP-A-2014-46545, for example), it is unclear whether or not such reuse can be reliably prohibited.

With respect to this point, in this embodiment, the storage region for the permitted usage amount information and the storage region into which the backup information is written are different, as illustrated in FIG. 2. As such, the likelihood of the backup information being mistakenly recognized as the permitted usage amount information of the memory unit 100 can be suppressed, making it possible to use the memory unit 100 correctly.

As illustrated in FIG. 1, the printing apparatus 200 includes the storage unit 212 that stores the estimated ink amount information. The backup information, meanwhile, is information used to restore the estimated ink amount information in the case where an error has arisen in the estimated ink amount information in the storage unit 212. In other words, in the process for restoring the estimated ink amount information, a process for writing the backup information stored into the memory unit 100 into the region, of the storage regions in the storage unit 212 of the printing apparatus 200, that stores the estimated ink amount information may be carried out. As will be described later, it is assumed that all memory units 100, rather than just units used in charging processes, will be replaced as appropriate, but the backup information of the memory unit 100 attached at the time of the malfunction may be used to restore the estimated ink amount information.

Meanwhile, in this embodiment, the charging processes are carried out on the basis of the memory unit 100 attached to the slot 230, and thus the memory unit 100 can be removed after the charging process. Accordingly, the writing of the backup information described above is carried out after the charging process in the case where the memory unit 100 is attached, and is not carried out when the memory unit 100 is not attached.

However, the printing apparatus 200 considered in this embodiment is required to carry out operations continuously for long periods of time, as described above. To accomplish this, removing a charged memory unit 100 and then immediately attaching the next memory unit 100 is a typical usage situation. This is because, as in JP-A-2008-254395 and JP-A-2011-73208, even in the case where charging processes can be carried out using a plurality of memory units 100, and in the case where the reservation process (described later) can be carried out, there is no particular reason to remove one memory unit 100 and not attach a new memory unit 100.

Accordingly, in the case where the memory unit 100 that had been attached to the slot 230 (the first memory unit 100-1) has been removed and it has been detected that another memory unit 100 (the second memory unit 100-2) has been attached to the slot 230, the processing unit 210 carries out a process for writing the estimated ink amount information into a region, of the storage regions in the second memory unit 100-2, that is different from the region in which the permitted usage amount information is stored, as the backup information.

Doing so makes it possible to appropriately store the backup information even in the case where the memory unit 100 has been replaced. In other words, the writing of the backup information by the processing unit 210 may be carried out for the memory unit 100 attached to the slot 230 at that time. As described above, in the case where the printing apparatus 200 is used continuously for a long period of time, the printing operations will not be continued unless a memory unit 100 is inserted into the slot 230, and thus implying this technique makes it possible to store the backup information appropriately for more periods.

Note that in the case where the first memory unit 100 (the first memory unit 100-1) has been removed after the charging process for that first memory unit 100-1 and the different second memory unit 100-2 has been attached, the charging process using the second memory unit 100-2 is executed immediately according to JP-A-2008-254395 and JP-A-2011-73208. However, according to this embodiment, in the case where the second memory unit 100-2 has been attached, that second memory unit 100-2 is held to a reservation for the charging process. The charging process using the second memory unit 100-2 is then carried out at a time when it has been determined that an amount of ink corresponding to the first memory unit 100-1 has been consumed. By doing so, two or more memory units 100 will not be subjected to the charging process simultaneously, and thus the permitted usage amount information of many memory units 100 need not be restored at the time of a malfunction. In other words, the information can be combined with the backup information to make responding to malfunctions easier.

Meanwhile, for a user who uses many printing apparatuses 200, it is conceivable that the user cannot estimate how much printing he or she has carried out with which printing apparatus 200 in advance. In such a case, the user will want to move the permitted usage amount information charged for a given printing apparatus 200 to another printing apparatus 200. In such a case, according to the techniques disclosed in JP-A-2008-254395 and JP-A-2011-73208, the charged memory unit 100 cannot be reused, and thus it is necessary to realize a method for exchanging the charged permitted usage amount information (estimated ink amount information) between the printing apparatuses 200. With respect to this point, with the technique according to this embodiment, a memory unit 100 that has been attached to the slot 230 but has not yet been subjected to the charging process (that is, is in a reserved state, which will be described later) is not invalidated, and thus it is easy to remove the memory unit 100 from the slot 230 and use that memory unit 100 with another printing apparatus 200. In other words, with the technique according to this embodiment, the memory unit 100 can be used in a flexible manner.

In this manner, in the case where the reservation process is also carried out in addition to the charging process, it is possible that the memory unit 100 attached to the slot 230 will not only be in a charged state, but will also be in a reserved state (that is, a state in which the charging process is reserved). In other words, when the memory unit 100 is attached to the slot 230, there are both cases where the charging process has already been carried out and the memory unit 100 is invalid, and cases where the memory unit 100 is in a reserved state and is still valid. Whether the memory unit 100 is valid or invalid directly relates to whether or not the memory unit 100 has any value, and thus it can be said that presenting this information to the user in an easy-to-understand manner is important.

Additionally, in the case where a memory unit 100 is to be shared between the printing apparatus according to JP-A-2014-46545 and the printing apparatus 200 according to this embodiment, there may be a memory unit 100 that has been partially used by the printing apparatus according to JP-A-2014-46545 (for example, in which a value greater than 0% but less than WTH % has been written as the permitted usage amount information). In this case, among valid memory units 100, there will be memory units having a high amount of remaining usable ink (the consumed ink amount in the permitted usage amount information), and memory units having a low amount of such ink. In this case, the specific consumed ink amount cannot be understood from information simply indicating whether or not the memory unit 100 is attached, whether or not the memory unit 100 is in a reserved state, and so on, and it is thus desirable to carry out a more detailed display.

In other words, in the case where the reservation process is carried out, displaying information using the first display region DA1 and the second display region DA2 of the display unit 260 (see FIG. 11) has a significant merit, and using the technique according to this embodiment makes it possible to present information necessary to the user in an easy-to-understand manner.

In this embodiment, in the case where the second memory unit 100-2 is attached to the slot 230 after the charging process carried out using the first memory unit 100-1, the processing unit 210 carries out a process for displaying information expressing that the second memory unit 100-2 is in the reserved state in the display unit 260 until the consumed ink amount expressed by the estimated ink amount information exceeds the prescribed threshold WTH. By doing so, the fact that the memory unit 100 is in the reserved state can be appropriately presented to the user by the printing apparatus 200 carrying out the reservation process.

Hereinafter, examples of the configurations of the printing apparatus 200 and the memory unit 100 will be described, the concepts of the charging process and the reservation process according to the embodiment will be described, and then specific examples of the information displayed in the display unit 260 will be described using a case where the reservation process is carried out as an example. Furthermore, specific flows of the charging process and reservation process according to this embodiment will be described as well.

3. Example of Configurations of Printing Apparatus and Memory Unit

First, examples of the configurations of the printing apparatus 200 and the memory unit 100 according to the first embodiment will be described with reference to FIGS. 3 to 9. FIG. 3 is a perspective view illustrating an example of the configuration of the printing apparatus 200 according to the first embodiment. The printing apparatus 200 according to this embodiment includes: four ink tanks (also called "ink holding units") 221-*a* to 221-*d*; four slots 230-*a* to 230-*d*; four memory units 100-*a* to 100-*d* (see FIG. 9); four sliders 240-*a* to 240-*d*; the processing unit 210; the UI unit 250; and a printing execution unit (not shown) that includes a print head. Although there are four ink tanks 221 in this embodiment, the number is not limited thereto, and there may be two or three ink tanks 221, or five or more.

Note that in the following descriptions, the four ink tanks 221-*a* to 221-*d* will be referred to as ink tanks 221 as appropriate when it is not necessary to distinguish between individual ink tanks. The same applies to the slots 230-*a* to 230-*d*, the memory units 100-*a* to 100-*d*, and the sliders 240-*a* to 240-*d*.

The four ink tanks 221-*a* to 221-*d* are filled with ink contained in corresponding ink packs 310 (see FIG. 8) supplied by the vendor of the printing apparatus. For example, the ink tank 221-*a* is filled with black (BK) ink, the ink tank 221-*b* with yellow (Y) ink, the ink tank 221-*c* with magenta (M) ink, and the ink tank 221-*d* with cyan (C) ink. These inks are contained in separate ink packs 310, which are then supplied to the user. The user can fill (refill) the ink tank 221 corresponding to a needed color from the ink pack 310 for that color.

With the ink tanks 221, the amount of ink within the ink tanks can be seen by the user. For example, as illustrated in FIG. 3, a configuration in which the ink within the ink tanks 221 can be seen is achieved by making the ink tanks 221 at least partially exposed to the exterior so as to be visible to the user and forming the parts visible to the user from transparent members. A lower limit line (not shown) may be provided on the ink tanks 221. The lower limit line is a line-shaped mark provided in the horizontal direction on the surface of the ink tank 221 from which the ink therein can be seen. If the ink amount has dropped as far as the lower limit line (that is, if a surface of the ink has dropped as far as the position of the lower limit line), the ink tank can be filled with all of the ink in the ink pack 310. The user can refill the ink as appropriate even during printing by visually confirming the relationship between the ink amount and the lower limit line.

The printing apparatus 200 includes the user interface unit (also called "UI unit" hereinafter) 250. The UI unit 250 is an input device through which the user makes various instructions, settings, and the like, and includes the display unit 260, a user operation input receiving unit, and so on. The display unit 260 can display information related to ink refilling and the like to the user. Accordingly, the user can refill the ink tank 221 with ink from the ink pack 310 while checking the UI unit 250 of the printing apparatus 200 and the ink in the ink tank 221. While there are cases where the user visually confirms that the ink surface has fallen below the lower limit line and refills the ink, a case where the user receives a warning from the UI unit 250 and refills the ink is also conceivable.

A sensor that detects the presence/absence of ink is present in a flow channel between the ink tank 221 and the print head, and the printing apparatus 200 always stops operations for ejecting ink from the print head when the sensor detects that there is no ink, regardless of the value of the total consumed ink amount information WD in the main unit. Accordingly, even if the user forgets to refill the ink tank 221 with ink, malfunctions in the print head caused by blank printing by the print head (ink ejection operations being carried out in a state where there is no ink in the print head) can be prevented.

The plurality of slots 230-*a* to 230-*d* are for attaching the sliders 240-*a* to 240-*d*, which can be attached to and removed from the printing apparatus 200, to the printing apparatus 200, and are provided corresponding to the aforementioned ink tanks 221-*a* to 221-*d*. For example, the four slots 230-*a* to 230-*d* are provided above the corresponding black, yellow, magenta, and cyan ink tanks 221-*a* to 221-*d*.

The memory units 100-*a* to 100-*d* are included with the ink packs 310 (see FIG. 8) and are supplied to the user, and are mounted by the user to the sliders 240-*a* to 240-*d* in a removable state. The sliders 240-*a* to 240-*d* to which the memory units 100-*a* to 100-*d* are attached are in turn attached to the slots 230-*a* to 230-*d*, and the memory units 100 are attached to the slots 230 as a result. The memory units 100 are attached to their corresponding slots 230 and thus cannot be seen in FIG. 3. The memory units 100-*a* to 100-*d* have storage devices 110-*a* to 110-*d*, respectively (see FIG. 9).

Upon the memory unit 100 being attached to the slot 230, or in other words, upon the memory unit 100 being attached to the printing apparatus 200, the processing unit 210 of the printing apparatus 200 can access the storage device 110 of the memory unit 100.

The storage device 110 includes the storage regions illustrated in FIG. 2. Communication ID information used by the processing unit 210 to specify a communication partner, ink color information corresponding to the color of the ink in the included ink pack 310, and the permitted usage amount information corresponding to the ink fill amount of the included ink pack 310 (that is, the aforementioned initial fill amount and consumed ink amount) are written into the storage region of the storage device 110 when the device is shipped from the factory.

The storage device 110 may also store validity/invalidity information (discussed later) indicating whether the memory unit 100 is valid and can be used by the printing apparatus 200 or is invalid, information indicating the printing apparatuses 200 with which the memory unit 100 is compatible, and so on. With respect to the validity/invalidity information, validity information indicating that the memory unit 100 is valid is written when the memory unit 100 is shipped from the factory. The storage device 110 can be constituted of a non-volatile memory such as an EEPROM (Electrically Erasable PROM).

The processing unit 210 includes a CPU 211, the storage unit 212, and a communication processing unit 213 (see FIG. 9), and executes printing processes of the printing apparatus 200, communication processes with the memory units 100, and so on. Specifically, the processing unit 210 controls the reading out or writing of data from or to the memory units 100-*a* to 100-*d* attached to the slots 230-*a* to 230-*d*. The processing unit 210 also carries out a process for detecting whether or not the memory units 100-*a* to 100-*d* are attached to the slots 230-*a* to 230-*d*.

The processing unit 210 carries out the counting process (a soft counting process) for finding the total consumed ink amount for each ink color relative to the ink weight of a single ink pack 310 during printing. In other words, at the time of the charging process, the processing unit 210 carries out a process for calculating the total consumed ink amount information WD, which is a percentage of the total consumed ink amount relative to the initial fill amount stored in the storage unit 212 from the memory unit 100, for each ink color (providing WDa to WDd, which correspond to the respective colors), and updating the total consumed ink amount information WD in its own storage unit 212 each time a predetermined amount of ink is consumed by printing being executed.

In addition to the amount of ink consumed by printing, the consumed ink amount counted by the processing unit 210 also includes a consumed ink amount used in maintenance of the print head, such as cleaning the print head. The processing unit 210 updates the total consumed ink amount information WD as appropriate when maintenance is executed.

The storage unit 212 stores the initial fill amount corresponding to each ink color, the total consumed ink amount information WD corresponding to each ink color, and the prescribed threshold WTH for the total consumed ink amount information WD at which automatic charging is to be carried out, as well as a second threshold WTH' for the total consumed ink amount information WD at which printing can be continued with only a charge in the case where there is no reservation (where $WTH'=WTH+\alpha$ and $\alpha>0$; WTH' is set to a higher value than the permitted usage amount), a charged flag, and a reserved flag, which will be described later. The storage unit 212 is constituted of a non-volatile memory.

The UI unit 250 is an input device through which the user makes various instructions, settings, and the like, and includes the display unit 260 for making various notifications to the user.

Figure 4:
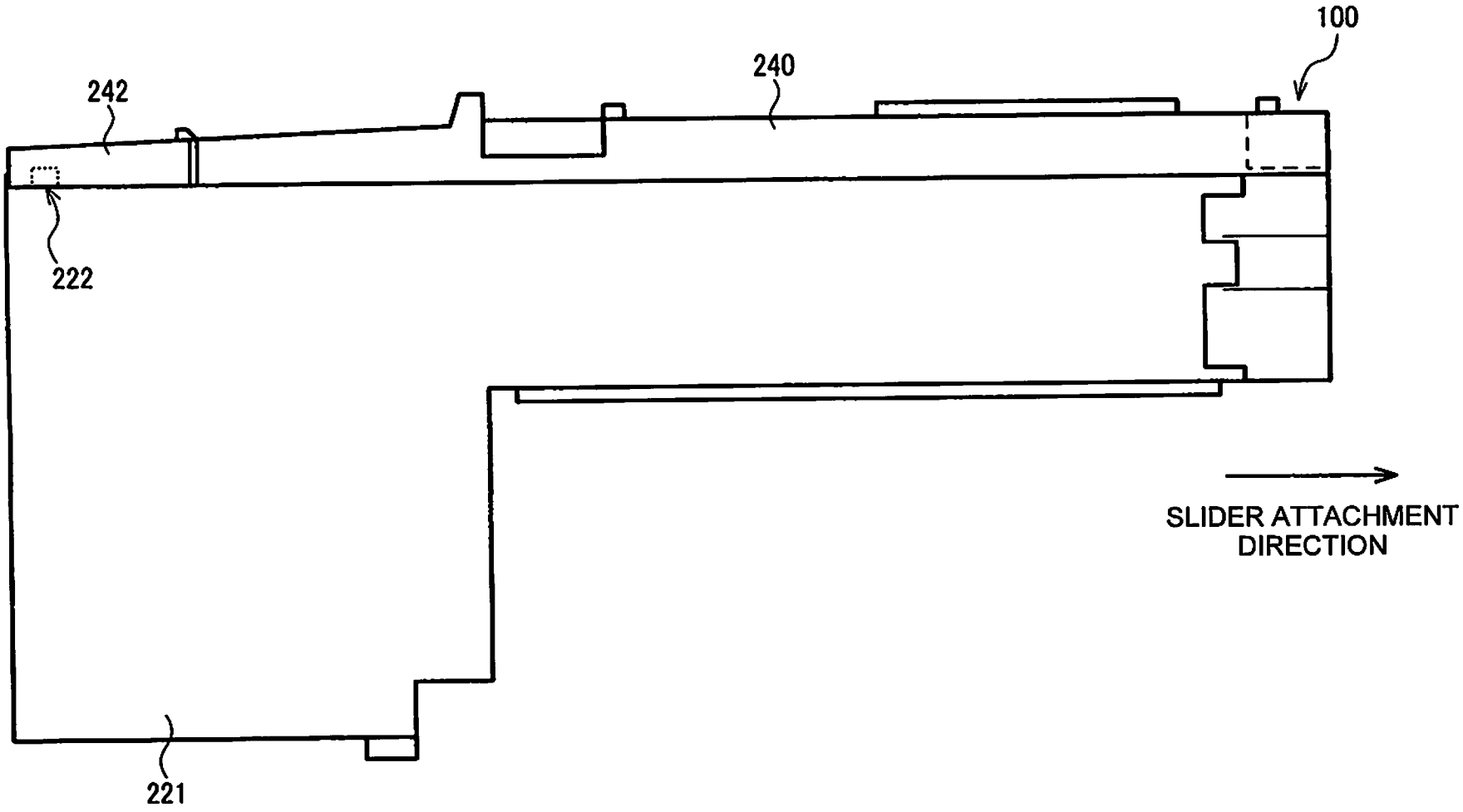
FIG. 4 is a side view illustrating an example of the configuration of an ink holding unit (ink tank) and a slider according to the first embodiment.

FIG. 4 is a side view illustrating an example of the configuration of the ink tank 221 and the slider 240 according to the first embodiment. As illustrated in FIG. 4, the ink tank 221 includes an ink supply opening 222. The user can fill the ink tank 221 with the ink contained in the ink pack 310 from the ink supply opening 222. The ink tank 221 is fixed to the slot 230 of the printing apparatus 200 (see FIG. 3). The user can fill the ink tank 221 with ink while the ink tank 221 is fixed to the printing apparatus 200. The ink tank 221 can be filled with ink while the slider 240 is attached to the slot 230 by opening an ink supply opening cover 242 provided in the slider 240.

The slider 240 can be attached to and removed from the printing apparatus 200 by sliding an upper portion of the ink tank 221. When attaching the memory unit 100 to the slot 230, the user pulls the slider 240 out from the slot 230, attaches the memory unit 100 to an attachment direction-side tip portion of the slider 240, and reinserts the slider 240 into the slot 230 in the attachment direction. FIG. 4 illustrates a state in which the memory unit 100 is attached to the slider 240.

Figure 5:
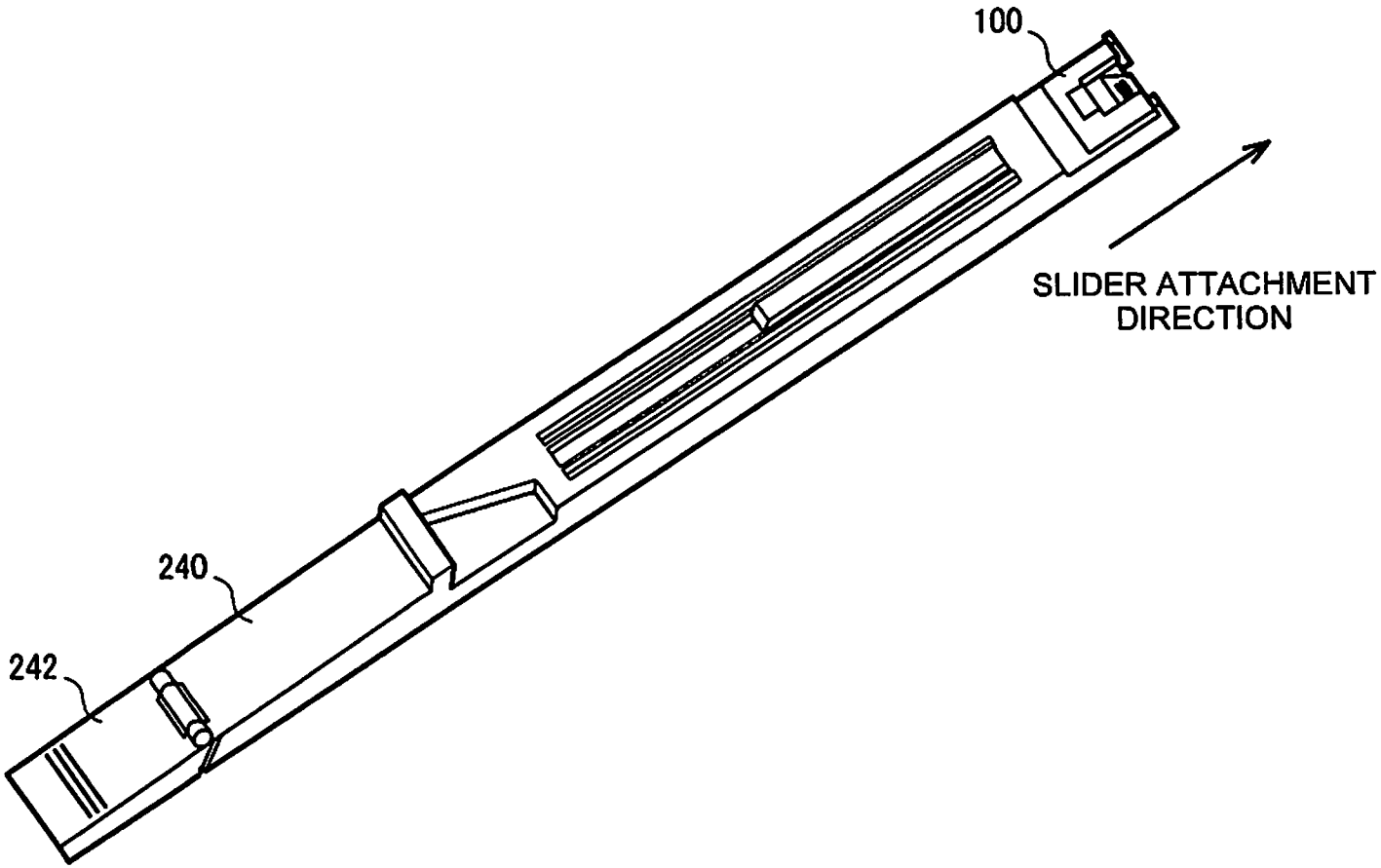
FIG. 5 is a perspective view illustrating an example of the configuration of the slider according to the first embodiment.

FIG. 5 is a perspective view illustrating an example of the configuration of the slider 240 according to the first embodiment. As illustrated in FIG. 5, the memory unit 100 is attached to the attachment direction-side tip portion of the slider 240. Here, "attached" means that the memory unit 100 is placed on a predetermined location of the slider 240. It is not necessary that the memory unit 100 be fixed to a predetermined location of the slider 240.

FIG. 6 is a perspective view illustrating an example of the configuration of the memory unit 100 according to the first embodiment. As illustrated in FIG. 6, the memory unit 100 includes the storage device 110 (see FIG. 9), a reset terminal TRST, a clock terminal TSCK, a data terminal TSDA, a first power source terminal TVDD, a second power source terminal TVSS, and an attachment detection terminal TCO. Attaching the memory unit 100 to the slot 230 electrically connects these terminals to main unit-side terminals CRST, CSCK, CSDA, CVDD, CVSS, and CCO, respectively, of the printing apparatus 200, which are provided in the slot 230. Note that the reset terminal TRST, clock terminal TSCK, data terminal TSDA, first power source terminal TVDD, and second power source terminal TVSS are also collectively called "storage device terminals". Additionally, the number and arrangement of the terminals is not limited to those illustrated in FIG. 6, and a variety of numbers and arrangements are possible.

Figure 7:
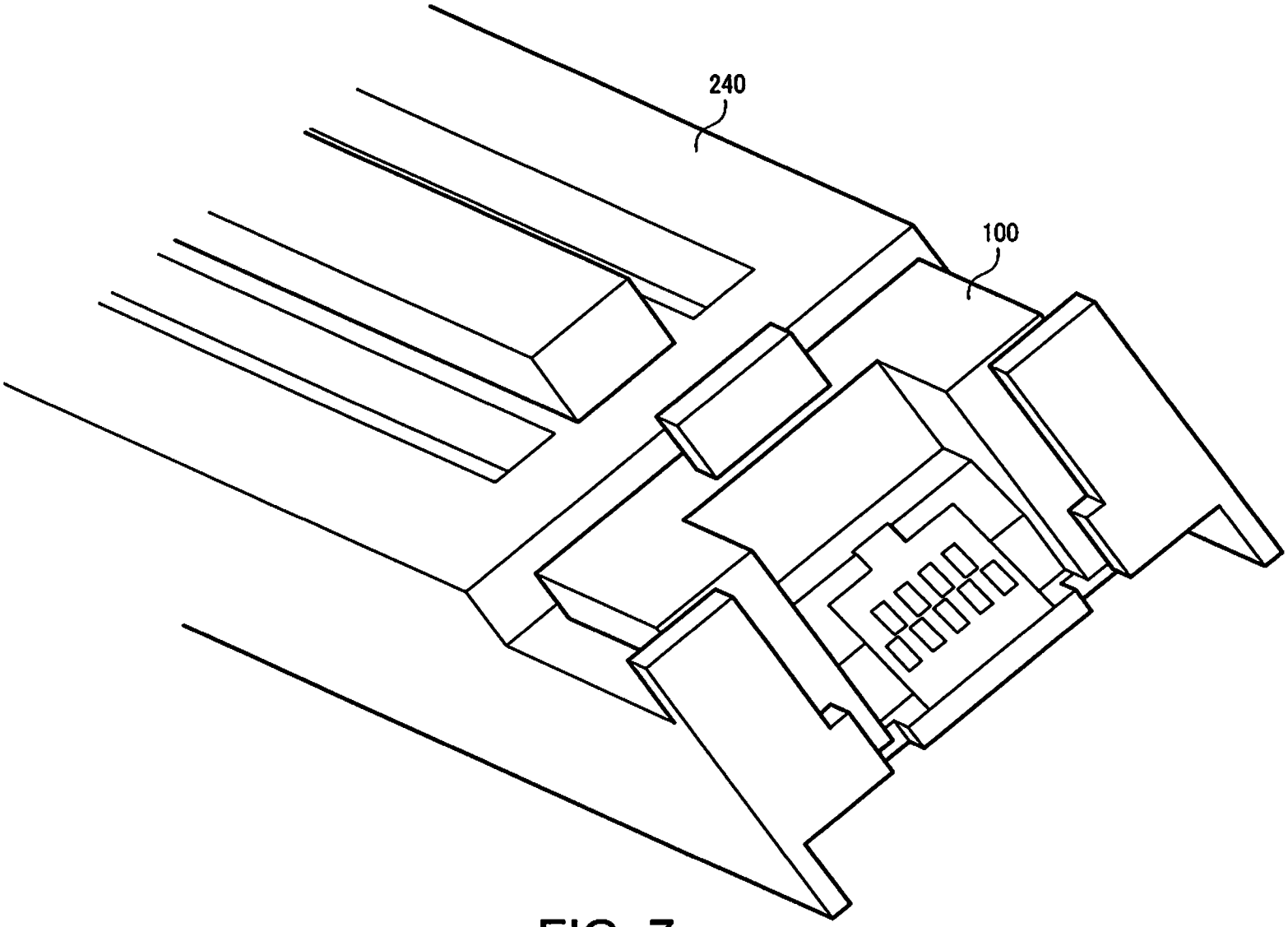
FIG. 7 is a perspective view illustrating an example of the configuration of a tip portion of the slider in which the memory unit according to the first embodiment is installed.

FIG. 7 is a perspective view illustrating an example of the configuration of the tip portion of the slider 240 to which the memory unit 100 is attached, according to the first embodiment. As illustrated in FIG. 7, the memory unit 100 is attached to the attachment direction-side tip portion of the slider 240.

Figure 8:
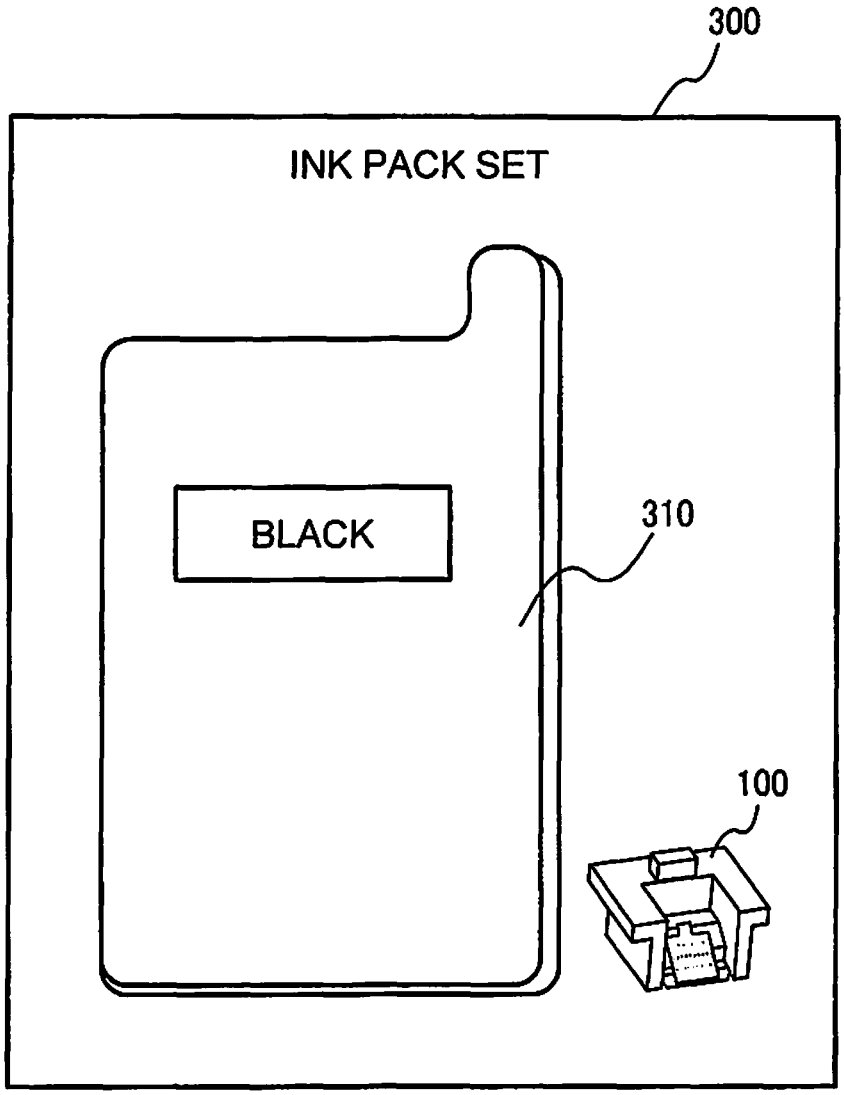
FIG. 8 is a schematic diagram illustrating an example of the configuration of an ink pack set according to the first embodiment.

FIG. 8 is a schematic diagram illustrating an example of the configuration of the ink pack set 300 according to the first embodiment. As illustrated in FIG. 8, the ink pack set 300 includes the ink packs 310 (also called ink refill receptacles) and the memory units 100, and these are packaged together. For example, a black ink pack set 300 includes ink packs 310 containing black ink and a memory unit 100 in which black ink color information is stored, and these items are packaged together. The ink packs 310 are bags (pouches), formed from a laminated film, for example, that have been filled with ink. The ink pack set 300 is supplied to the user of the printing apparatus 200 by the printing apparatus vendor.

Figure 9:
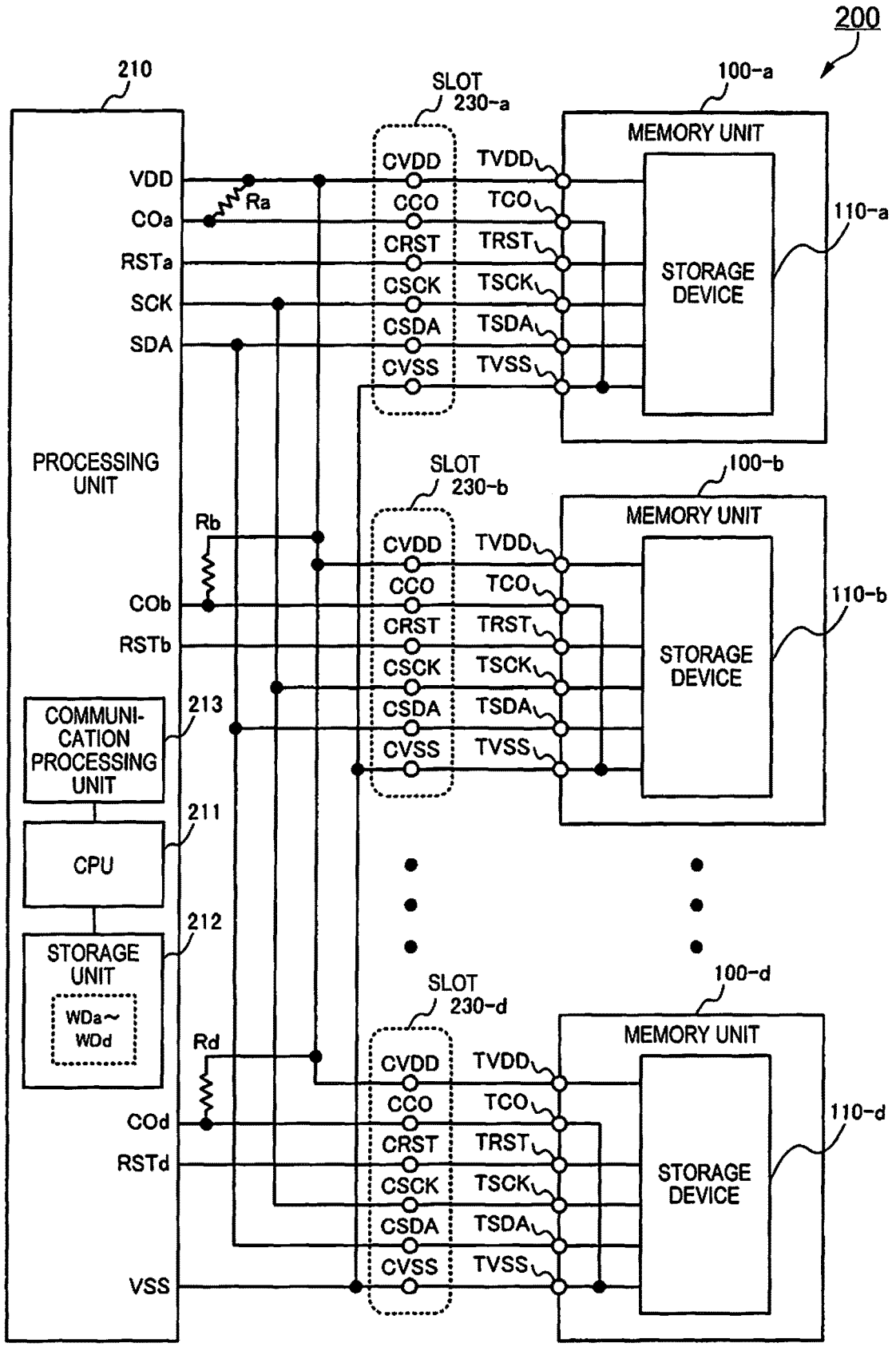
FIG. 9 is a block diagram illustrating an example of the configuration of a plurality of slots, a plurality of memory units, and a processing unit of the printing apparatus according to the first embodiment.

FIG. 9 is a block diagram illustrating an example of the configurations of the plurality of slots 230-*a* to 230-*d* of the printing apparatus 200, the plurality of memory units 100-*a* to 100-*d*, and the processing unit 210, according to the first embodiment.

As illustrated in FIG. 9, the memory units 100-*a* to 100-*d* each include the reset terminal TRST, the clock terminal TSCK, the data terminal TSDA, the first power source terminal TVDD, and the second power source terminal TVSS as the storage device terminals. The storage device terminals are electrically connected to the storage device 110 in each memory unit 100.

Each of the memory units 100-*a* to 100-*d* also includes the attachment detection terminal TCO. In each memory unit 100, the attachment detection terminal TCO is electrically connected to the second power source terminal TVSS.

By attaching the memory unit 100-*a* to the slot 230-*a*, the storage device terminals TRST, TSCK, TSDA, TVDD, TVSS, and the attachment detection terminal TCO, are electrically connected to the main unit-side terminals CRST, CSCK, CSDA, CVDD, CVSS, and CCO, respectively, provided in the slot 230-*a*. The same applies to the memory units 100-*b* to 100-*d*.

Of the main unit-side terminals provided in the slots 230-*a* to 230-*d*, the clock terminal CSCK, the data terminal CSDA, the first power source terminal CVDD, and the second power source terminal CVSS are connected in common to a clock terminal SCK, a data terminal SDA, a first power source terminal VDD, and a second power source terminal VSS, respectively, of the processing unit 210. The processing unit 210 outputs a clock signal SCK to the clock terminal CSCK, a first power source voltage (a high potential-side power source voltage) VDD to the first power source terminal CVDD, and a second power source voltage (a low potential-side power source voltage) VSS to the second power source terminal CVSS. Additionally, the processing unit 210 outputs a data signal SDA to the data terminal CSDA, and receives the data signal SDA from the data terminal CSDA.

The processing unit 210 outputs reset cancel signals RSTa to RSTd to the reset terminals CRST provided in the slots 230-*a* to 230-*d*. A storage device 110 to which the processing unit 210 is outputting a reset cancel signal is a storage device 110 that is to be accessed by the processing unit 210.

The processing unit 210 includes the CPU 211, the storage unit 212, and the communication processing unit 213. The processing unit 210 executes processes for communicating with the memory units 100 via the communication processing unit 213.

The processing unit 210 can detect whether a memory unit 100 is attached to a slot 230 using the attachment detection terminal TCO. For example, in the case where the memory unit 100-*a* being attached to the slot 230-*a* is detected, the processing unit 210 outputs the first power source voltage VDD to the first power source terminal CVDD and detects whether or not the memory unit 100-*a* is attached on the basis of a voltage level of an attachment detection signal COa. The main unit-side attachment detection terminal CCO of the slot 230-*a* is connected to the first power source terminal CVDD via a resistance element Ra, and thus the voltage level of the attachment detection signal COa is H level (high-potential level; VDD level) in the case where the memory unit 100-*a* is not attached to the slot 230-*a*.

On the other hand, in the case where the memory unit 100-*a* is attached to the slot 230-*a*, the main unit-side attachment detection terminal CCO, the attachment detection terminal TCO of the memory unit 100-*a*, and the second power source terminal TVSS are electrically connected, and thus the voltage level of the attachment detection signal COa is L level (low-potential level; VSS level). Accordingly, the processing unit 210 determines that the memory unit is not attached in the case where the attachment detection signal COa is H level, and determines that the memory unit is attached in the case where the attachment detection signal COa is L level. In this manner, the processing unit 210 can detect whether or not the memory units 100-*a* to 100-*d* are attached to the slots 230-*a* to 230-*d*, respectively.

In the configuration example illustrated in FIG. 9, the processing unit 210 can select a single memory unit 100 and read out or write therefrom or thereto by activating one of the reset cancel signals RSTa to RSTd (that is, canceling the reset).

4. Concept of Charging Process and Reservation Process

Figure 10:
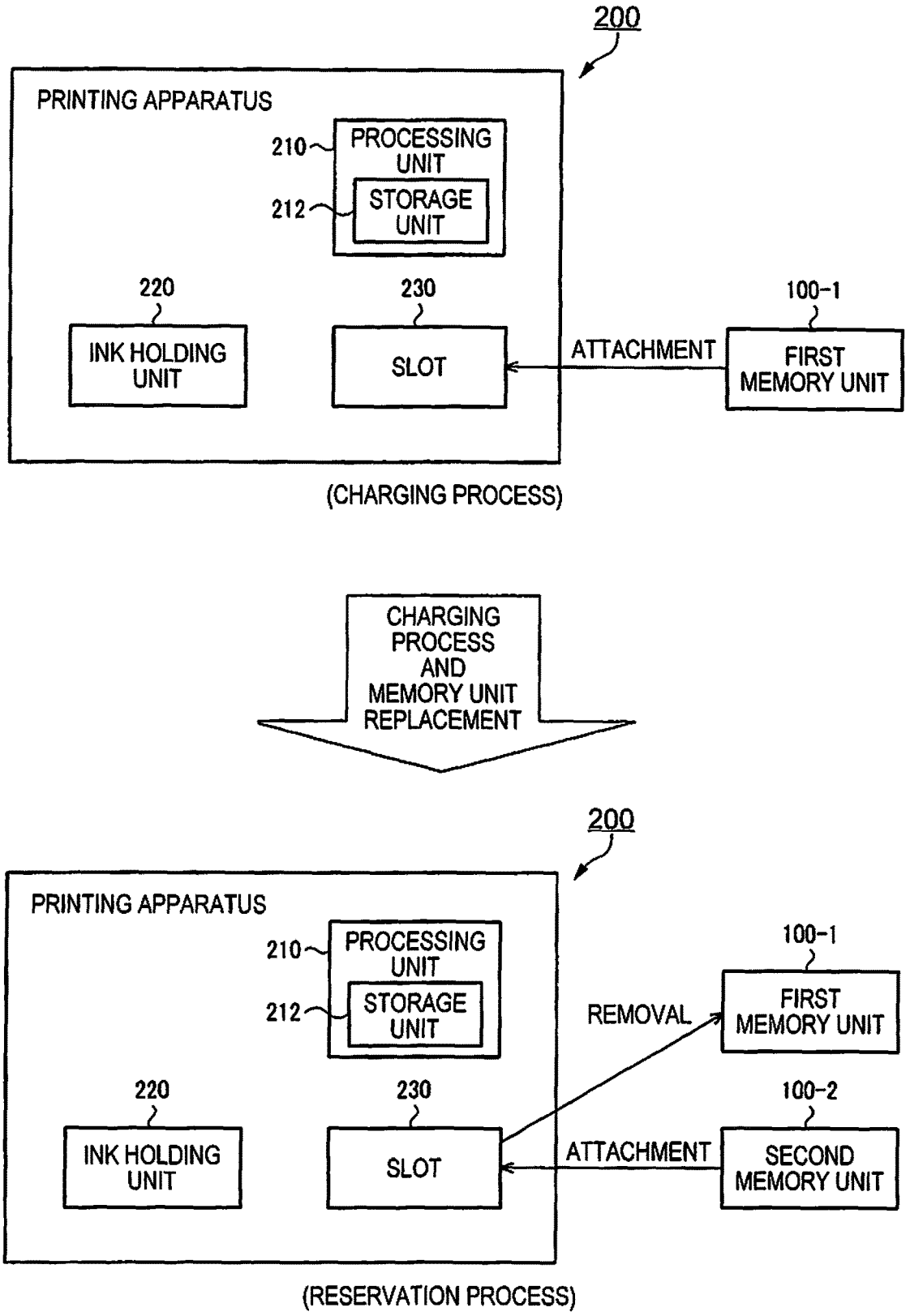
FIG. 10 is a schematic diagram illustrating the concepts of a charging process and a reservation process according to the first embodiment.

Next, the concepts of the charging process and reservation process according to this embodiment will be described with reference to FIG. 10. FIG. 10 is a schematic diagram illustrating the concepts of the charging process and the reservation process according to the first embodiment. In this embodiment, in the case where the second memory unit 100-2 is attached to the slot 230 after the charging process carried out using the first memory unit 100-1, the processing unit 210 does not carry out a charging process using the second memory unit 100-2 until the consumed ink amount expressed by the estimated ink amount information exceeds the prescribed threshold (WTH). In the case where the consumed ink amount has exceeded the prescribed threshold, the processing unit 210 carries out the charging process using the second memory unit 100-2.

First, as indicated in the upper section of FIG. 10, upon the first memory unit 100-1 being attached to the slot 230 in a state where the charging process has not been carried out, the charging process for updating the estimated ink amount information stored in the storage unit 212 of the printing apparatus 200 is executed on the basis of the permitted usage amount information from the first memory unit 100-1. After the charging process, printing operations can be carried out without the ink-consuming operations of the printing apparatus 200 being affected, even if the first memory unit 100-1 is removed.

As indicated in the lower section of FIG. 10, upon the second memory unit 100-2 being attached to the slot 230 while the printing apparatus 200 is carrying out ink-consuming operations based on the permitted usage amount information from the first memory unit 100-1, the processing unit 210 executes a reservation process for putting the second memory unit 100-2 into a reserved state. In other words, the user of the printing apparatus 200 can implement the charging process, the reservation process, and so on by attaching or removing the memory units 100 to or from the slot 230 as appropriate.

Note that in the case where the first memory unit 100-1 is attached while the ink-consuming operations based on the ink permitted usage amount information from the first memory unit 100-1 are being executed, the consumed ink amount in the first memory unit 100-1 may be updated so as to synchronize the consumed ink amount in the first memory unit 100-1 with the total consumed ink amount stored in the storage unit 212.

In other words, according to this embodiment, in the case where another memory unit (the second memory unit 100-2) has been attached after the charging process, the charging process using the second memory unit 100-2 is not executed immediately, as in JP-A-2008-254395 and JP-A-2011-73208. Instead, a determination is made as to whether or not to carry out the charging process in accordance with the estimated ink amount information in the main unit.

Here, even if the second memory unit 100-2 is attached, the charging process will not be carried out until the consumed ink amount in the estimated ink amount information for the main unit exceeds the prescribed threshold WTH (this corresponds to the permitted usage amount information). As such, even if, in such a state, the main unit-side storage unit 212 malfunctions or the like and an error occurs in the main unit-side estimated ink amount information, only the permitted usage amount information from the first memory unit 100-1 will be lost, and the second memory unit 100-2 will not be affected. In other words, prior to the charging process, the second memory unit 100-2 is still in a usable state, and is not affected by the malfunction.

In consideration of enabling the user to use a permitted usage amount corresponding to the permitted usage amount information of the first memory unit 100-1 completely, the prescribed threshold WTH may be set to a value expressing the permitted usage amount or a value having a prescribed margin added thereto. For example if the total consumed ink amount information WD corresponding to the permitted usage amount information in the first memory unit 100-1 is 117%, a value such as 117% to 120% may be used as the prescribed threshold WTH.

Additionally, if the total consumed ink amount information WD exceeds the prescribed threshold WTH, the processing unit 210 of the printing apparatus 200 automatically executes the charging process for the second memory unit 100-2 without an instruction from the user. This automatically-executed charging process is an automatic switch from ink-consuming operations of the printing apparatus 200 based on the permitted usage amount information from the first memory unit 100-1 to ink-consuming operations of the printing apparatus 200 based on the permitted usage amount information from the second memory unit 100-2, and will also be referred to as "automatic charging" in this specification hereinafter. In this manner, if the second memory unit 100-2 is attached to the slot 230, the charging process will be executed automatically even without user participation, which is advantageous for the user in that the timing for attaching the second memory unit 100-2 is not restricted.

Attaching the second memory unit 100-2 prior to the total consumed ink amount information WD charged using the first memory unit 100-1 exceeding the prescribed threshold WTH can be thought of as reserving the charging process, in the sense that the charging process is subject to execution once the conditions thereof are met. As such, in the specification hereinafter, the second memory unit 100-2 attached prior to the total consumed ink amount information WD in the estimated ink amount information charged using the first memory unit 100-1 exceeding the prescribed threshold WTH will be referred to as being in a "reserved state". The processing executed by the processing unit 210 for putting the second memory unit 100-2 in the reserved state will be referred to as a "reservation process".

In this embodiment, an amount of ink corresponding to two pieces of permitted usage amount information, namely one from the memory unit 100 already subjected to the charging process (the first memory unit 100-1) and one from the memory unit 100 in the reserved state (the second memory unit 100-2), can be used continuously. As such, filling the ink holding unit 221 with ink as appropriate makes it possible to print continuously for a longer amount of time (24 hours, for example) than the usage time provided by a single memory unit 100.

Note that FIG. 3 illustrates an example of a printing apparatus 200 having ink holding units 220 for four colors and a plurality of slots 230 corresponding to the respective colors, where the memory units 100 can be attached to and removed from corresponding slots. However, the above-described first memory unit 100-1 and second memory unit 100-2 indicate memory units 100 corresponding to a prescribed single color, and the slot 230 also indicates a single slot for a prescribed color. For example, the technique according to this embodiment defines a process carried out in the case where a black memory unit 100 has been attached to a black slot 230, and another black memory unit 100 has then been attached to the black slot 230 after the initial memory unit 100 has been removed.

5. Examples of Information Displayed in Display Unit

Assuming the foregoing, examples of information displayed in the display unit 260 according to the first embodiment will be described with reference to FIGS. 11 to 16. FIGS. 11 to 16 are diagrams illustrating examples of screens displayed in the display unit 260 in accordance with a state of the printing apparatus, according to the first embodiment of the invention. Note that examples of display screens displayed for one specific color of ink will be described in the following. Specifically, FIGS. 11 to 16 illustrate state information of a black memory unit 100 and state information of an estimated remaining ink amount in a black ink tank 221. In the case of a printing apparatus 200 that uses a plurality of color inks, one of the screens illustrated in FIGS. 11 to 16 may be displayed for each color of ink, arranged side-by-side, for example.

As illustrated in FIGS. 11 to 16, the display unit 260 has a display region DA. The first display region DA1 and the second display region DA2 are regions corresponding to parts of the display region DA. Although FIGS. 11 to 16 illustrate the first display region DA1 and the second display region DA2 as being mutually different regions, a variation in which part of the first display region DA1 and part of the second display region DA2 overlap or the like is also possible.

Figure 12:
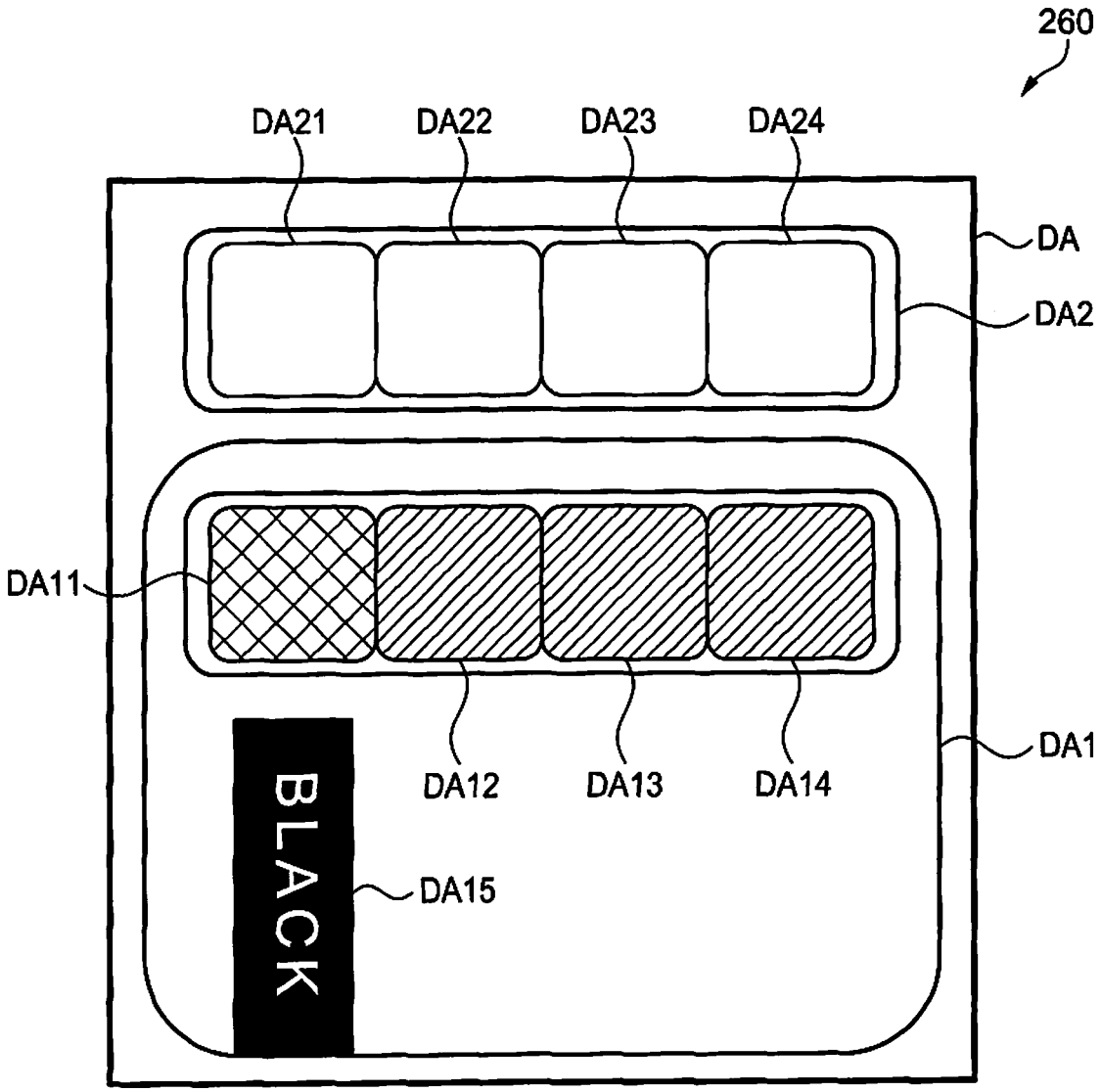
FIG. 12 is a diagram illustrating an example of a screen displayed in the display unit in accordance with a state of the printing apparatus, according to the first embodiment of the invention.

The state information of the permitted usage amount information of the memory unit 100 is displayed in the first display region DA1. The state information of the permitted usage amount information is information expressing a state of the permitted usage amount information. Specifically, this may be information expressing a numerical value of the permitted usage amount information (particularly the consumed ink amount, or a remaining ink amount, which will be described later). For example, as illustrated in FIG. 12, a remaining ink amount range (0% to 120%, for example) may be divided into four stages, and the range to which the current remaining ink amount value belongs may be displayed by a color or the like in each region. Alternatively, a numerical value may be displayed directly, whether the ink is unused or used, or the like may be displayed as the state information of the permitted usage amount information.

The state information of the estimated ink amount information updated by the processing unit 210 is displayed in the second display region DA2. The state information of the estimated ink amount information may be information expressing a numerical value of the estimated ink amount information (the consumed ink amount), and the same kind of display as that used for the permitted usage amount information can be applied in this case as well. A specific display example including the state information will be described hereinafter with reference to FIGS. 11 to 16.

FIG. 11 illustrates an example of a display screen corresponding to a state prior to the charging process. A graphic indicating that the charging process has failed despite a memory unit 100 being attached is displayed in the first display region DA1. Accordingly, here, a graphic in which an X is drawn within a circle, for example, is displayed in the first display region DA1 instead of the consumed ink amount, the remaining ink amount, or the like. Another graphic, text, or the like may be used to indicate a state in which the charging process has failed.

Note that because printing operations cannot be carried out in a state where the charging process has not been carried out, a state in which the charging process has failed despite a memory unit 100 being attached is a more serious state then a state in which the reservation process has failed, which will be described later. Accordingly, in a state where the charging process has failed, it is desirable to use a display form that easily communicates a warning display to the user, such as displaying the graphic in red.

Additionally, because a correct memory unit 100 has not been attached to the slot 230, the example here illustrates a case where the charging process has failed. Accordingly, in FIG. 11, the graphic is displayed in the first display region DA1 in order to make it clear that the reason the charging process failed is a problem caused by the memory unit 100. Note that the display of the graphic or the like indicating that the charging process has failed is not limited to the first display region DA1, and may be carried out in a region, of the display region DA, aside from the first display region DA1.

The second display region DA2 is divided into 4 regions DA21 to DA24. As will be described later using FIGS. 12 and 13, it is assumed that as the state information of the estimated ink amount information, the number of the four regions DA21 to DA24 to which a color (a color aside from a background color) is added is increased the greater the remaining ink amount is (that is, the lower the consumption of the ink relative to the permitted usage amount is) in the second display region DA2.

As described above, in FIG. 11, the charging process has not yet been carried out, and thus ink cannot be used. In such a pre-charging process state, a display indicating that the remaining ink amount of the estimated ink amount information is 0 is sufficient, and thus in the example illustrated in FIG. 11, all four regions DA21 to DA24 are displayed without color (are displayed as white blanks, for example).

FIG. 12 illustrates an example of a display screen corresponding to a state prior to the charging process, in which a correct memory unit 100 has been attached to the slot 230. In the case where the attached memory unit 100 (first memory unit 100-1) is correct, the state information of the permitted usage amount information from that memory unit 100 is displayed in the first display region DA1. In FIG. 12, it is assumed that an unused memory unit 100 has been attached, and thus remains in a state where all of the initial fill amount can be used. This may be displayed in the first display region DA1.

Here, it is assumed, for the state information of the permitted usage amount information as well, that part of the first display region DA1 is divided into four regions DA11 to DA14 and the number of regions displayed with a color is increased the greater the unused portion of the initial fill amount (remaining ink amount) is. If the memory unit 100 is unused, the entire initial fill amount can be used, and thus all four regions DA11 to DA14 may be displayed with a color, as indicated in FIG. 12.

Although an example in which the display color of the four regions DA11 to DA14 of the first display region DA1 and the four regions DA21 to DA24 of the second display region DA2 is changed according to the remaining ink amount is described here, the display format is not limited thereto. In the regions DA11 to DA14 and the regions DA21 to DA24, it is sufficient for the remaining ink amount to be identifiable from a displayed image, and thus the display format may be changed depending on whether the remaining ink amount is high or low, for example. Specifically, a variety of display format changes can be used, such as flashing the display region, changing text, numbers, icons, or the like that are displayed, and so on.

Additionally, in this embodiment, the first display region DA1 can be thought of as a region that presents information regarding the memory unit 100. Accordingly, other information regarding the memory unit 100 may be presented in the first display region DA1 in addition to the state information of the permitted usage amount information. In the example illustrated in FIG. 12, an information bar DA15 for the ink color corresponding to the memory unit 100 is displayed in a region of the first display region DA1 separate from the four regions DA11 to DA14. In the second display region DA2, all four regions DA21 to DA24 are displayed as white blanks in the same manner as in FIG. 11, because the charging process has not yet been carried out.

Note that the charging process is started upon a correct memory unit 100 being attached in a state prior to the charging process, as will be described later with reference to FIG. 17. In terms of the processing flow illustrated in FIG. 17, a determination of NO is made in step S103, and step S104 to step S106 are executed. Once the charging process is complete, the display transitions to that illustrated in FIG. 13 (described later), and it is thus assumed that the display illustrated in FIG. 12 is only carried out for a short period of time. Accordingly, a variation that completely omits the display illustrated in FIG. 12 is also possible.

Figure 13:
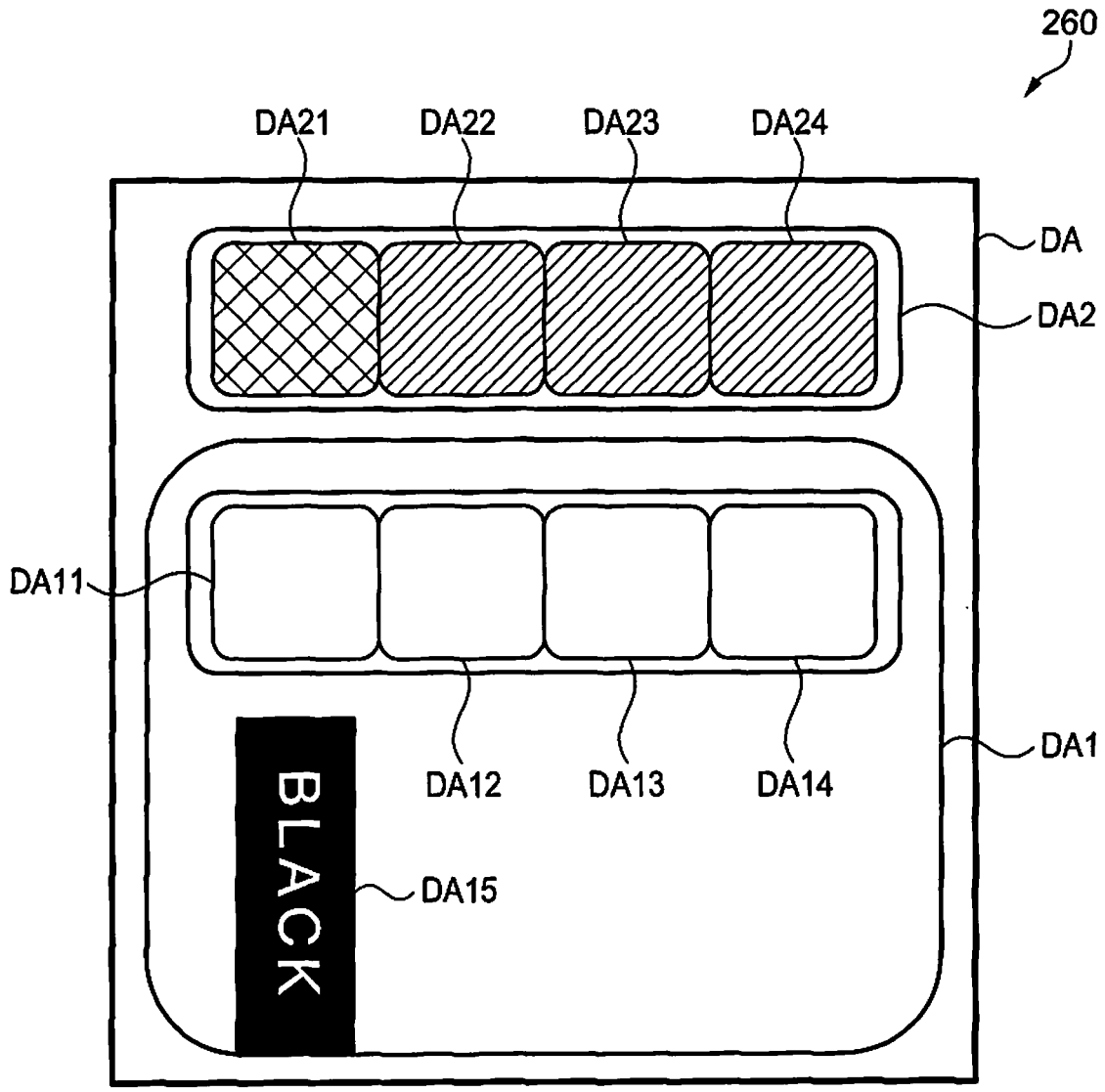
FIG. 13 is a diagram illustrating an example of a screen displayed in the display unit in accordance with a state of the printing apparatus, according to the first embodiment of the invention.

FIG. 13 illustrates an example of a display screen corresponding to a state in which the charging process is complete and the memory unit 100 used in the charging process (the first memory unit 100-1) has not yet been removed from the slot 230. As a result of the charging process, the permitted usage amount information in the first memory unit 100-1 is moved to the printing apparatus 200, and thus in the resulting state, all of the initial fill amount is used (unusable; a remaining ink amount of 0%). Thus as illustrated in FIG. 13, all four regions DA11 to DA14 are displayed as white blanks in the first display region DA1.

Meanwhile, the estimated ink amount information in the storage unit 212 of the printing apparatus 200 is updated (replaced) by the permitted usage amount information as a result of the charging process. In other words, the estimated ink amount information is overwritten by information expressing that the permitted usage amount is the maximum value (the information displayed in the regions DA11 to DA14 in FIG. 12). Accordingly, all four regions DA21 to DA24 are displayed with colors in the second display region DA2.

Note that the transition from FIG. 12 to FIG. 13 may be carried out instantly (that is, without displaying a screen therebetween), or may be carried out with some sort of animation display. For example, a transition maybe carried out in which FIG. 12 is taken as a starting state, and the colored regions of the regions DA11 to DA14 are gradually reduced in size while the colored regions of the regions DA21 to DA24 are gradually increased in size, ultimately ending at the state illustrated in FIG. 13. Such animation display makes it possible to use the display screen in the display unit 260 to communicate to the user, in an easy-to-understand manner, that the information from the memory unit 100 is being transferred to the main unit side.

Considering the display illustrated in FIG. 13 conceptually, it can be said that in the case where the charging process has been carried out, the processing unit 210 carries out a process for displaying, in the first display region DA1, information expressing that the first memory unit 100-1 has been invalidated, and a process for displaying, in the second display region DA2, information expressing that the estimated ink amount information has been updated (replaced) by the permitted usage amount information.

Specifically, displaying all four regions DA11 to DA14 as white blanks expresses that there are no unused portions of the initial fill amount remaining, or in other words, that the first memory unit 100-1 has been invalidated. Meanwhile, in FIG. 13, of the regions DA21 to DA24, using a color to display only the regions (all four regions DA21 to DA24 in the above example) corresponding to the regions among the regions DA11 to DA14 illustrated in FIG. 12 that had colors (all four regions DA11 to DA14 in the above example) expresses that the estimated ink amount information has been replaced with the permitted usage amount information.

Doing so makes it possible to use the first display region DA1 and the second display region DA2 to appropriately present, to the user, the change on the main unit side and the change on the memory unit 100 side resulting from the charging process. In other words, the internal operations of the printing apparatus 200 resulting from the charging process, namely the information from the memory unit 100 being moved to the main unit side and the memory unit 100 being invalidated, can be presented to the user in a manner that is easy to understand visually.

Note that the "information expressing that the memory unit 100 has been invalidated" and the "information expressing that the estimated ink amount information has been replaced with the permitted usage amount information" are not limited to the formats illustrated in FIG. 13. With respect to the "information expressing that the memory unit 100 has been invalidated", for example, a region displaying whether the memory unit 100 is valid or invalid may be provided in the first display region DA1, and the memory unit 100 being invalidated may be displayed using that region. For example, text reading "valid" or "invalid" may be displayed, graphics indicating "○" or "x" may be displayed, or colors corresponding to valid and invalid may be displayed in that region.

A variety of variations are also possible with respect to the "information expressing that the estimated ink amount information has been replaced with the permitted usage amount information". For example, text expressing that the information has been replaced (for example, "replacement complete") may be displayed in the second display region DA2, an arrow pointing from the first display region DA1 toward the second display region DA2 may be displayed, or the like.

Additionally, the processing unit 210 carries out a process for displaying, in the display unit 260, information identifying whether or not carrying out the charging process has resulted in the charging process being successful. Whether or not the charging process was successful affects whether or not printing operations can be executed, and it is therefore important to carry out such a display.

Note that the display illustrated in FIG. 13 can be thought of as indicating that the charging process was successful. This is because the process for replacing the estimated ink amount information with the permitted usage amount information and the process for invalidating the memory unit 100 are processes specifically executed in the charging process, and thus the charging process can be identified as having been successful in the case where a display is made indicating the results of those processes. However, the details of the display indicating whether or not the charging process was successful are not limited to those illustrated in FIG. 13. A variety of variations are possible, such as displaying text reading "charge successful" or "charge failed" in one of the regions of the display unit 260, displaying a graphic such as "○" or "x", or the like, for example.

Figure 14:
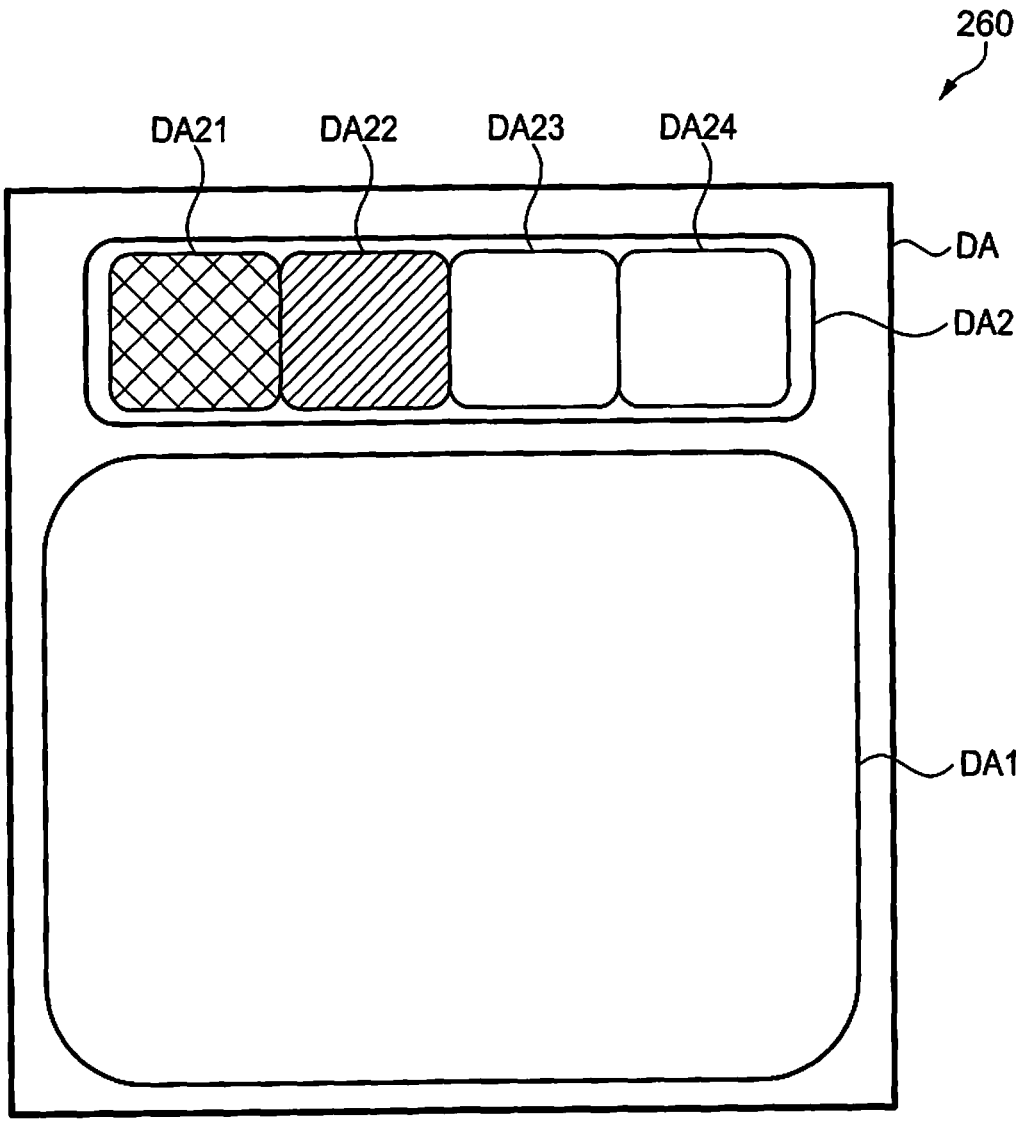
FIG. 14 is a diagram illustrating an example of a screen displayed in the display unit in accordance with a state of the printing apparatus, according to the first embodiment of the invention.

Additionally, in the case where there is no memory unit 100 attached to the slot 230, the processing unit 210 displays, in the display unit 260, information expressing that no memory unit 100 is attached. FIG. 14 illustrates an example of a display screen corresponding to a state after the charging process, in which no memory unit 100 is attached to the slot 230. In FIG. 14, the first display region DA1 is kept blank, with no information displayed therein, which indicates that no memory unit 100 is attached.

Figure 15:
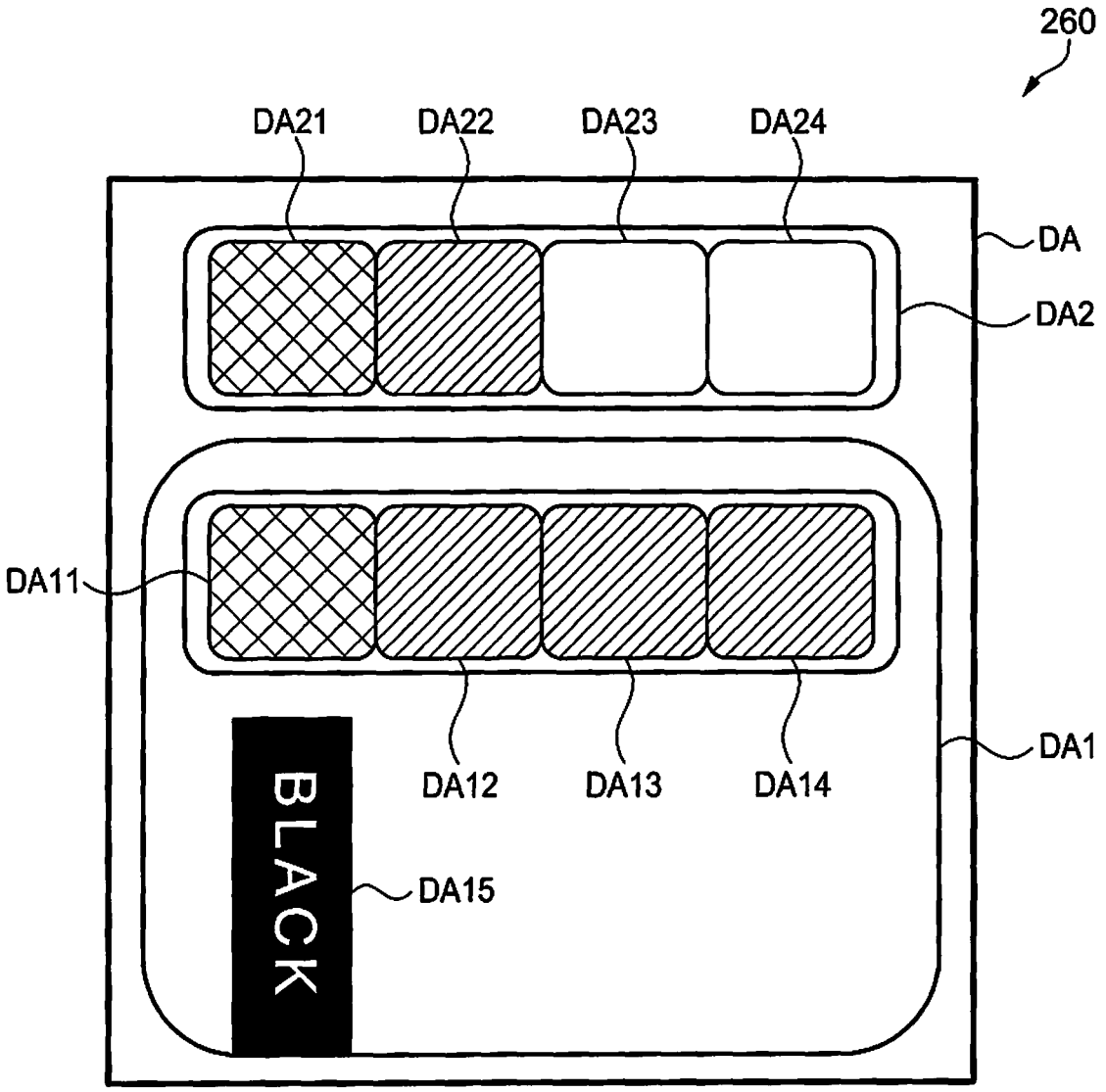
FIG. 15 is a diagram illustrating an example of a screen displayed in the display unit in accordance with a state of the printing apparatus, according to the first embodiment of the invention.
Figure 16:
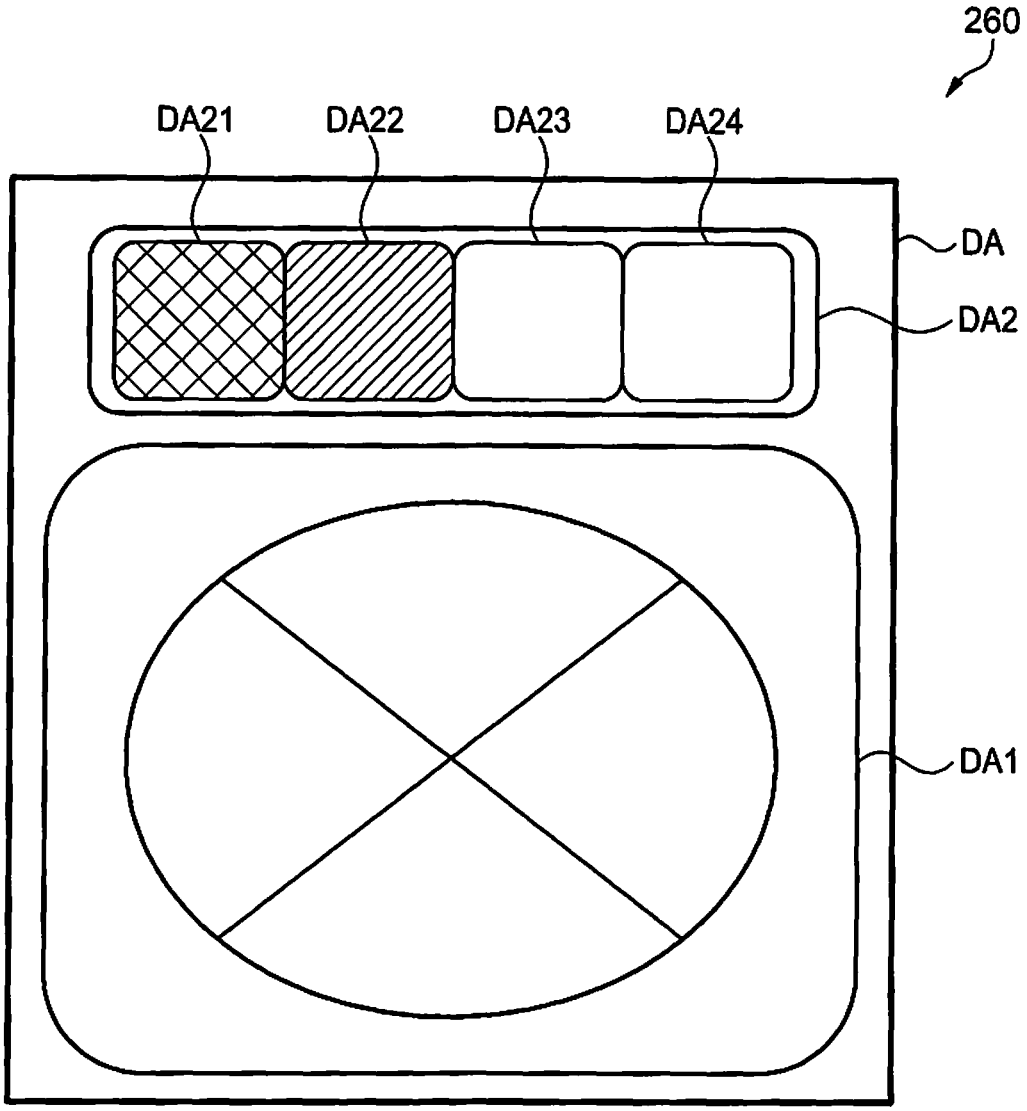
FIG. 16 is a diagram illustrating an example of a screen displayed in the display unit in accordance with a state of the printing apparatus, according to the first embodiment of the invention.

As illustrated in FIG. 13, if the memory unit 100 for charging (the first memory unit 100-1) remains attached, the information from the memory unit 100 continues to be displayed in the first display region DA1 even if the memory unit 100 is invalid. If an incorrect memory unit 100 is attached, a display indicating that the charging process, the reservation process, or the like has failed is made in the first display region DA1, as illustrated in FIG. 11, FIG. 16 (described later), and so on. Meanwhile, if a correct memory unit 100 is attached after the charging process, the state information of the permitted usage amount information is displayed in the first display region DA1, as illustrated in FIG. 15 (described later).

In the case of such an embodiment, not displaying anything in the first display region DA1 makes it possible to understand that there is no memory unit 100 for which a display should be made, which in turn makes it possible to make clear to the user that no memory unit 100 is attached. However, a variation is also possible in which, for example, information reading "no memory unit attached" is displayed in one of the regions of the display unit 260.

Meanwhile, FIG. 14 is a diagram illustrating a change in the state information of the estimated ink amount information displayed in the second display region DA2 in the case where the estimated ink amount information has been updated through the printing operations. For example, in the case where 0% to 120% is assumed for the estimated ink amount information, the region DA21 corresponds to a remaining ink amount of 0% to 30% (a consumed ink amount of 90% to 120%), the region DA22 corresponds to a remaining ink amount of 30% to 60% (a consumed ink amount of 60% to 90%), the region DA23 corresponds to a remaining ink amount of 60% to 90% (a consumed ink amount of 30% to 60%), and the region DA24 corresponds to a remaining ink amount of 90% to 120% (a consumed ink amount of 0% to 30%).

In other words, in the case where the consumed ink amount has risen due to printing operations and the consumed ink amount estimated through the counting process has reached a value between 60% and 90%, the region DA21 and the region DA22 are displayed with a color while the region DA23 and the region DA24 are displayed as white blanks, as illustrated in FIG. 14. By doing so, the state of the estimated ink amount information, which is updated by the counting process carried out by the processing unit 210, can be displayed appropriately in the second display region DA2.

Here, it is assumed that the display color used in the case where the region DA21 (DA11) is displayed with a color is different from the display color used in the case where the regions DA22 to DA24 (DA12 to DA14) are displayed with a color. This indicates that a consumed ink amount of 90% to 120% is a range in which a charging process (automatic charging) using the memory unit 100 (the second memory unit 100-2) can occur for the purpose of reservation.

In other words, much of the ink for which the charging has been carried out has already been consumed, and thus if a reservation process has not been carried out, the user should be prompted to carry out the reservation process as soon as possible, whereas if a reservation has already been made, the user should be notified that the automatic charging may be executed. In any event, it is necessary to make some sort of warning display for the user, and thus in FIG. 14, the display color of the region DA21 is different from the display color of the regions DA22 to DA24. Another technique can of course be used for the warning display, and thus all of the regions DA21 to DA24 may use the same display format.

FIG. 15 illustrates an example of a display screen in the case where a correct memory unit 100 has been attached after the charging process, or in other words, in the case where the reservation process was successful. Here, an unused memory unit 100 has been attached as the memory unit 100 for reservation purposes (the second memory unit 100-2), and thus the first display region DA1 has the same display as that illustrated in FIG. 12. However, only a reservation process for the charging process has been carried out for the second memory unit 100-2, and the charging process is not carried out. Accordingly, unlike FIG. 12, which assumes a transition to FIG. 13, the display in the first display region DA1 in FIG. 15 is continued until the charging process is actually executed.

In other words, the processing unit 210 carries out a process for displaying information expressing that the second memory unit 100-2 is in the reserved state in the display unit 260 until the consumed ink amount expressed by the estimated ink amount information exceeds the prescribed threshold WTH.

By doing so, the fact that the information from the memory unit 100 for reservation purposes (the second memory unit 100-2) has not yet been transferred to the printing apparatus 200 can be made clear. As indicated by the second display region DA2 in FIG. 14, FIG. 15, or the like, the estimated ink amount information on the main unit side changes in response to the execution of printing operations. As such, in the case where only the estimated ink amount information is displayed while in the reserved state, there is a risk that the user will mistakenly assume that the permitted usage amount information of the second memory unit 100-2 has been consumed despite that permitted usage amount information actually remaining unused. This is because it is often the case that the estimated ink amount information on the main unit side and the permitted usage amount information in the memory unit 100 are interconnected, as with the printing apparatus according to JP-A-2014-46545. With respect to this point, using the display illustrated in FIG. 15 makes it possible to clarify that the information consumed is the information on the main unit side and that the information in the second memory unit 100-2 for reservation purposes has not been consumed, which in turn makes it possible for the user to use the printing apparatus 200 without worrying.

Here, as illustrated in FIG. 15, the processing unit 210 carries out a process for displaying, in the first display region DA1 of the display unit 260, information expressing that the second memory unit 100-2 is in a reserved state. This is because the information display for the memory unit 100 is consolidated in the first display region DA1, and thus using the first display region DA1 for the display related to the reserved state as well results in a well-consolidated and easy-to-understand display. However, the display indicating the reserved state may be carried out in the second display region DA2, another region of the display region DA, or the like.

As described above, FIG. 12 and FIG. 15 illustrate examples in which a correct memory unit 100 has been attached, FIG. 14 illustrates an example in which a memory unit 100 is not attached, and FIG. 11 illustrates an example in which an incorrect memory unit 100 has been attached before the charging process has been carried out. As another situation, it is possible that an incorrect memory unit 100 is attached in a state where charging is finished (a reservation standby state).

Accordingly, the processing unit 210 may carry out a process for displaying, in the display unit 260, information identifying whether or not the reservation made using the second memory unit 100-2 was successful.

FIG. 16 illustrates an example of a display screen in the case where the reservation process failed. In FIG. 16, the same type of graphic as that illustrated in FIG. 11, displayed when the charging process failed, is displayed in the first display region DA1. Specifically, a display such as that illustrated in FIG. 16 is carried out in the case where a memory unit 100 with which automatic charging cannot be carried out has been attached, such as a case where a cyan memory unit 100 has been attached to the black slot 230, a memory unit 100 set to be invalid has been attached, or the like. Doing so makes it possible to clarify that the reservation process was not carried out using the attached memory unit 100 (the second memory unit 100-2), which in turn makes it possible to prompt the user to replace the memory unit 100.

Note that even if the reservation process has failed, the charging process is complete, and thus the printing operations can be continued. With respect to this point, a state in which the reservation process has failed is not as serious as a state in which the charging process has failed, and thus the display may be made different from the display illustrated in FIG. 11, such as setting the color of the graphic to blue. Meanwhile, although the display illustrated in FIG. 15 may be made in the first display region DA1 in the case where the reservation process has succeeded, the display expressing that the reservation process has succeeded may be made in another region of the display unit 260.

6. Specific Flows of Charging Process and Reservation Process

Figure 18:
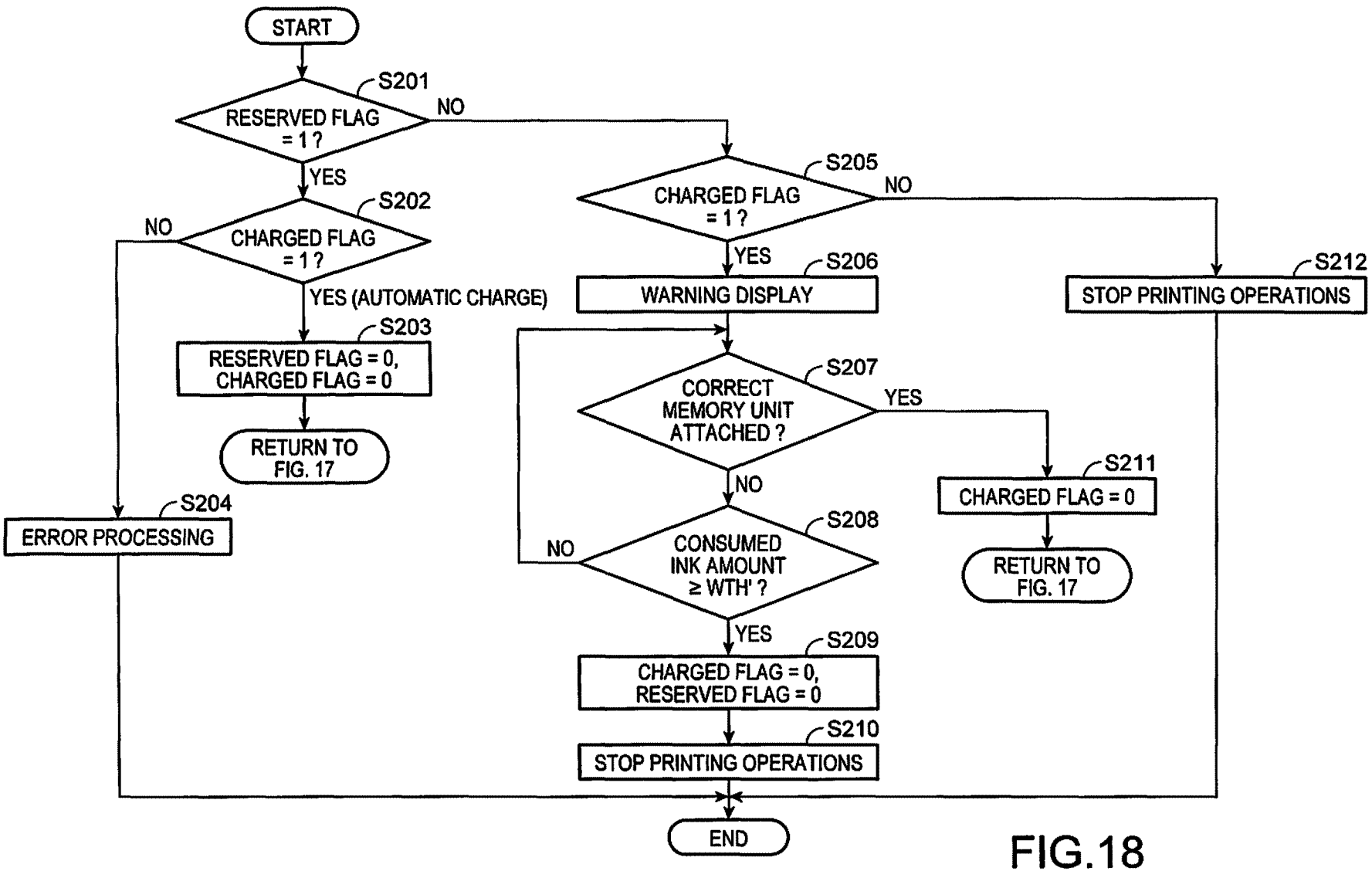
FIG. 18 is a flowchart illustrating a specific flow of the charging process and the reservation process according to the first embodiment.
Figure 19:
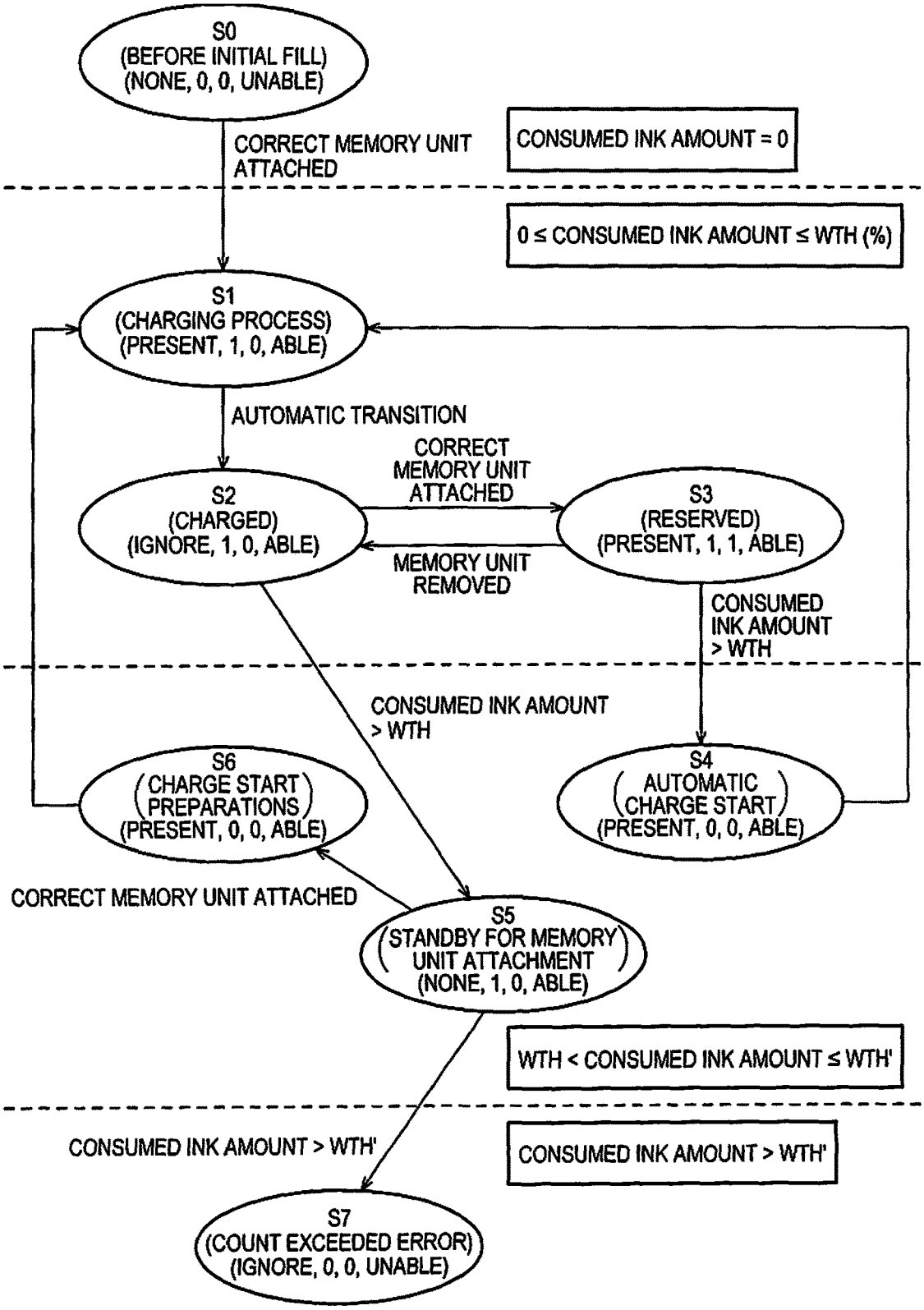
FIG. 19 is a state transition diagram illustrating the charging process and the reservation process according to the first embodiment.

Next, specific flows of the charging process and reservation process according to the first embodiment will be described with reference to FIGS. 17 to 19. FIGS. 17 and 18 are flowcharts illustrating specific flows of the charging process and the reservation process according to the first embodiment. FIG. 19 is a state transition diagram illustrating the charging process and the reservation process according to the first embodiment.

In this embodiment, the storage unit 212 stores the charged flag and the reserved flag. The charged flag is a flag indicating whether or not the main unit-side estimated ink amount information has been updated (charged) using the permitted usage amount information from a prescribed memory unit 100. Before the charging process is carried out, a value of 0 is stored in the area of the charged flag in the storage unit 212. Upon the charging process being carried out, a value of 1 is stored in the area of the charged flag in the storage unit 212, and the charged flag enters an on state as a result. The reservation process is carried out under the condition that charging is complete, and thus the charged flag may be thought of as a reservation standby flag.

The reserved flag is a flag indicating whether or not the second memory unit 100-2 has been attached and a charging process using the second memory unit 100-2 has been reserved (that is, the reservation process has been carried out) after a charging process carried out using the first memory unit 100-1. Before the reservation process is carried out, a value of 0 is stored in the area of the reserved flag in the storage unit 212. Upon the reservation process being carried out, a value of 1 is stored in the area of the reserved flag in the storage unit 212, and the reserved flag enters an on state as a result. Hereinafter, 1 or 0 being stored as a flag state will also be referred to as setting a flag of 1 or 0.

Figure 17:
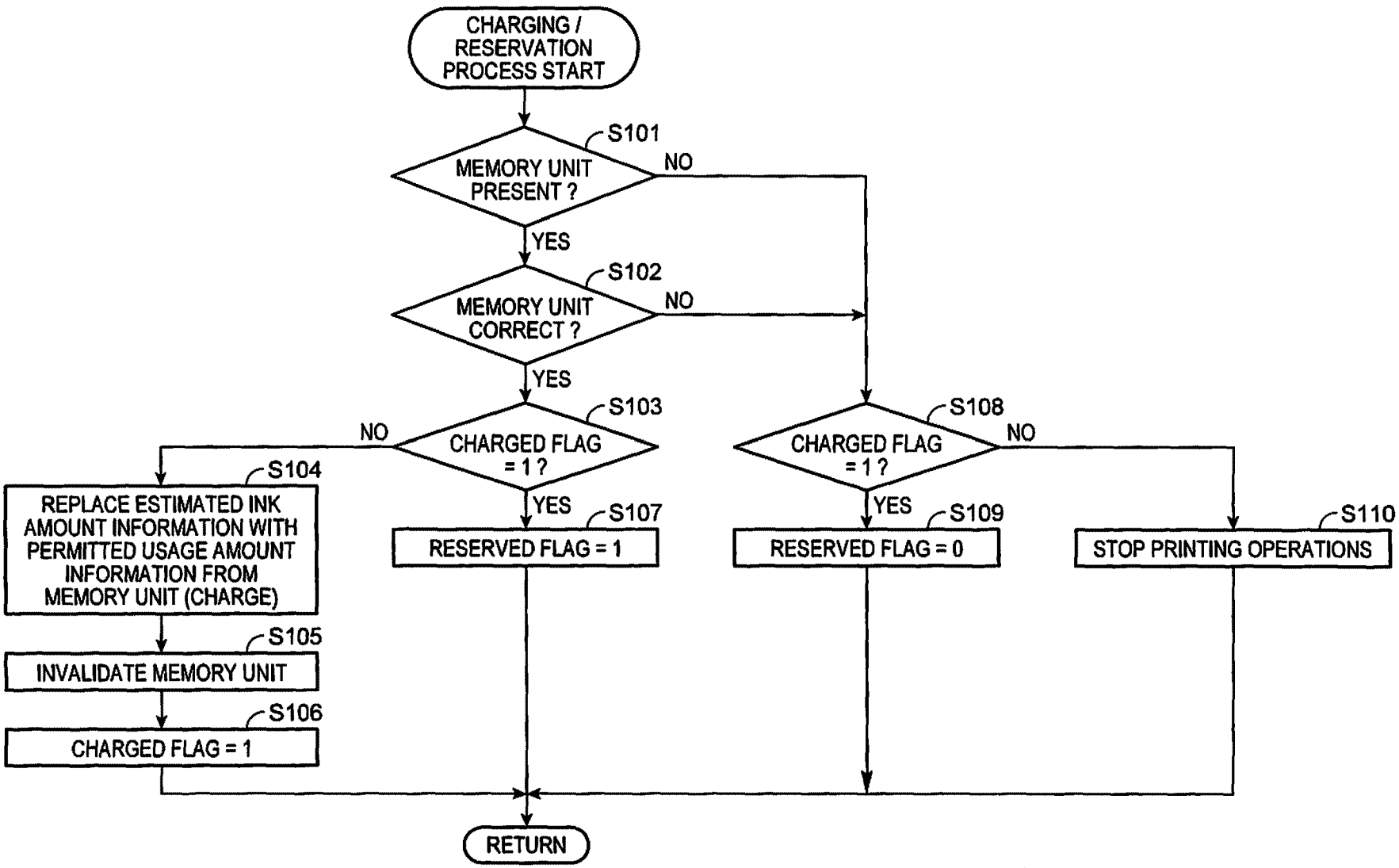
FIG. 17 is a flowchart illustrating a specific flow of the charging process and the reservation process according to the first embodiment.

FIG. 17 is a flowchart illustrating the charging process and the reservation process using flags based on the attachment state of the memory unit 100. The processes illustrated in FIG. 17 are processes executed by the processing unit 210. Note that each step illustrated in FIG. 17 can be rearranged in any desired order or executed in parallel as long as doing so does not cause conflict in the processing content.

Upon this process starting, first, the processing unit 210 determines whether or not a memory unit 100 is attached to the slot 230 (step S101). As described earlier, this is determined by the state of the terminal COa. In the case where a memory unit 100 is attached (step S101: YES), the processing unit 210 moves the process to step S102, and determines whether or not the memory unit 100 is correct (step S102).

In step S102, the processing unit 210 determines whether the memory unit 100 is valid or invalid. A memory unit 100 whose permitted usage amount information has already been replaced (that is, has been charged) cannot be reused, and is thus set to invalid by the processing unit 210. If the attached memory unit 100 is invalid, the processing unit 210 determines in step S102 that the memory unit 100 is incorrect (step S102: NO), and advances the process to step S108.

Note that in step S102, a correspondence relationship between the attached memory unit 100 and the slot 230 may be determined. For example, in the case where a memory unit 100 corresponding to a color that is not black (that is, cyan, magenta, or yellow) is attached to the black slot 230, the processing unit 210 determines that the memory unit 100 is incorrect. Meanwhile, in the case where printing apparatuses 200 with which the memory unit 100 is compatible are stored, the processing unit 210 determines a correspondence relationship with the printing apparatus 200. In the case where the printing apparatus 200 does not match the printing apparatuses 200 stored in the memory unit 100, or a printing apparatus 200 with which the memory unit 100 is compatible is not stored, the processing unit 210 determines that the memory unit 100 is incorrect.

In other words, the process for determining whether or not a unit is "correct" is in this embodiment a process of determining one or more conditions including at least a determination as to whether the unit is "valid" or "invalid". In the case where the determination is carried out based on a plurality of conditions, the processing unit 210 carries out a process for ultimately determining the unit is correct when basically all of the conditions are determined to be correct.

In the case where the memory unit 100 is determined to be correct (step S102: YES), the processing unit 210 moves the process to step S103, and makes a determination for the charged flag (step S103). In the case where the charged flag is set to 0 (step S103: NO), the processing unit 210 carries out the charging process using the attached correct memory unit 100 (the first memory unit 100-1). Specifically, the estimated ink amount information is updated using the permitted usage amount information from the memory unit 100 (step S104).

Additionally, because the permitted usage amount information from the memory unit 100 is moved to the printing apparatus 200 main unit side as a result, processing unit 210 stores the invalid state in the memory unit 100 (the first memory unit 100-1) in order to prevent the memory unit 100 from being reused (step S105). Then, because the charging process is complete, the processing unit 210 sets the charged flag to 1 (step S106).

Meanwhile, a case where the charged flag is set to 1 in step S103 (step S103: YES) corresponds to a state in which a valid memory unit 100 has been attached in a state where the charging process has already been carried out. Accordingly, the processing unit 210 sets the reserved flag to 1, assuming that the reservation process has been carried out for the charging process using the attached memory unit 100 (corresponding to the above-described second memory unit 100-2) (step S107).

On the other hand, in the case where no memory unit 100 is attached or the attached memory unit 100 is incorrect (step S101: NO or step S102: NO), the processing unit 210 makes a determination for the charged flag (step S108).

In the case where the charged flag is set to 1 (step S108: YES), the charging process has been carried out, and thus printing operations can be continued. This is because as described above, in this embodiment, the printing operations are not affected even if the charged memory unit 100 (the first memory unit 100-1) is removed. Meanwhile, in the case where the charging is complete but no memory unit 100 is attached, or a memory unit 100 is attached but is not a correct memory unit 100, the reservation process using the second memory unit 100-2 cannot be executed. Accordingly, because the reservation process is not complete, the processing unit 210 sets the reserved flag to 0 (step S109).

Note that while there are cases where step S109 is carried out in a state where the reserved flag is set to 1, there are also cases where step S109 is carried out while the reserved flag is set to 0. The reserved flag being set to 1 corresponds to a state in which a correct memory unit 100 has been attached and the process of step S107 has been carried out after the charging process, but that memory unit 100 has then been removed (and furthermore, depending on the situation, a different, incorrect memory unit 100 has then been attached). In this case, the memory unit 100 used for reservation purposes has been removed, and thus the state is not a reserved state; thus the process of step S109 is a process for returning the reserved flag, which was 1, to 0.

Meanwhile, a case where the process of step S109 is carried out in a state where the reserved flag is set to 0 corresponds to a situation where the reservation process has not been carried out and a valid memory unit 100 has not been attached thereafter. Accordingly, in step S109, the processing unit 210 keeps the reserved flag, which was set to 0, at 0.

Considering the display of information to the user, step S109 may be thought of as being divided into two processes, namely (1) a case where the reserved flag is set from 1 to 0 and (2) a case where the reserved flag is kept at 0. For example, in the case where the process of step S109 is carried out in a state where the reserved flag is set to 1 (the case (1)), the user is notified that the reservation already made has been canceled. Meanwhile, in the case where the process of step S109 is carried out in a state where the reserved flag is set to 0 (the case (2)), information for prompting the user to carry out the reservation process correctly, such as text reading "to make a reservation, please attach a correct memory unit", is displayed. The operations made by the user may be facilitated by displaying the information along with information specifying a color.

Meanwhile, in the case where the charged flag was set to 0 when the determination of step S108 was made (step S108: NO), the processing unit 210 stops the printing operations (step S110). As will be described later using FIGS. 18 and 19, the charged flag according to this embodiment is a flag set to 1 as a result of the charging process, and the flag is set to 0 in the case where the consumed ink amount (the total consumed ink amount information WD) has reached the second threshold WTH' (=WTH+α), which is greater than the prescribed threshold WTH.

This second threshold WTH' is a greater value than the ink amount corresponding to the permitted usage amount. The second threshold WTH' is set using, as a guideline, the estimated value of the total consumed ink amount information WD at which a printing apparatus 200 having the best ink consumption efficiency uses up an amount of ink equivalent to the initial fill amount of a single ink pack 310 (135%, for example). Doing so makes it possible to continue printing in the case where ink remains even after the prescribed threshold WTH is exceeded in the printing apparatus 200 having the best ink consumption efficiency. Furthermore, a case where ink remains despite 135% being reached is conceivable in the case where the prescribed threshold WTH is exceeded in a state where the reservation process has not been carried out, after operations for switching from the reserved state to automatic charging are continued at the prescribed threshold WTH. For this reason, the second threshold WTH' may be set to approximately 170%.

FIG. 18 is flowchart illustrating processing carried out in the case where the total consumed ink amount information WD has exceeded the prescribed threshold WTH. The processes illustrated in FIG. 18 are processes executed by the processing unit 210. Upon the processing being started, first, the processing unit 210 makes determinations for the charged flag and the reserved flag (step S201, step S202, and step S205).

A case where the reserved flag is set to 1 and the charged flag is set to 1 (step S201: YES and step S202: YES) indicates that a valid second memory unit 100-2 is attached and the total consumed ink amount information WD has exceeded the prescribed threshold WTH in a reserved state. Accordingly, the processing unit 210 carries out automatic charging using the attached memory unit 100.

In the automatic charging process, first, the processing unit 210 sets both the reserved flag and the charged flag to 0 (step S203), after which the process returns to step S104 in FIG. 17. The reserved flag is set to 0 in step S203 because the memory unit 100 for the reservation is now subject to the charging process, and the reserved state will be cancelled (in other words, the second memory unit 100-2 will become the first memory unit 100-1). Meanwhile, the charged flag is set to 0 because the amount of ink charged by the memory unit 100 attached before the memory unit 100 attached now has been used up.

Returning the process to FIG. 17 is preparation for the charging process using the reserved memory unit 100 (step S104). Additionally, the processes of step S105 and step S106 will be carried out in the case where the process returns to FIG. 17, and thus the second memory unit 100-2 (which at this point in time corresponds to the first memory unit 100-1 rather than the second memory unit 100-2) will be set to invalid and the charged flag will once again be set to 1.

Meanwhile, in the case where the reserved flag is set to 0 and the charged flag is set to 1 (step S201: NO and step S205: YES), the total consumed ink amount information WD has exceeded the prescribed threshold WTH but the reservation process has not been carried out, and thus the automatic charging is not carried out. If more ink is consumed after the prescribed threshold WTH corresponding to the permitted usage amount information, and the total consumed ink amount information WD exceeds the second threshold WTH', the printing cannot be continued any longer, and thus the processing unit 210 causes the display unit 260 to make a warning display to that effect (step S206).

Under these circumstances, the processing unit 210 makes a determination as to whether a correct memory unit 100 has been attached (step S207) and a determination as to whether the total consumed ink amount information WD has exceeded the second threshold WTH' (step S208). Note that step S207 is the same process as step S102. A determination of YES in step S208 corresponds to a state in which, without a correct memory unit 100 being attached, the consumed ink amount is too high for printing operations to continue.

Accordingly, in the case where a correct memory unit 100 has not been attached before the total consumed ink amount information WD exceeds the second threshold WTH' (step S207: NO and step S208: YES), the processing unit 210 sets both the charged flag and the reserved flag to 0 (step S209) and stops the printing operations (step S210). This is a process corresponding to a case where it is determined that no memory unit 100 is present in step S101 of FIG. 17, the charged flag is determined to be set to 0 in step S108 (with the charged flag determined to be set to 0 in step S108 as a result of the process of step S209), and the process moving to step S110.

On the other hand, in the case where a correct memory unit 100 has been attached before the total consumed ink amount information WD exceeds the second threshold WTH' (step S207: YES), the processing unit 210 sets the charged flag to 0 (step S211) and the process returns to FIG. 17. Step S211 is preparation for carrying out charging operations using a newly-attached memory unit 100 after the charged amount has already been consumed.

Note that a case where the reserved flag is set to 1 and the charged flag is set to 0 (step S201: YES and step S202: NO) is a state that cannot arise under the flag management according to this embodiment. This is because the reservation process is a process carried out under the condition that charging is complete, and it is not possible to enter a reserved state, with the reserved flag being set to 1, while remaining uncharged. Accordingly, in this case, the processing unit 210 carries out error processing (step S204). Various processes are conceivable for the specific details of the error processing, but for example, the processing unit 210 sets both the charged flag and the reserved flag to 0 and stops the printing operations.

Meanwhile, in the case where the reserved flag is set to 0 and the charged flag is set to 0 (step S201: NO and step S205: NO), the processing unit 210 stops the printing operations (step S212). Step S212 is the same process as step S110. Note that as described above, the charged flag is set to 0 in the case where the consumed ink amount has exceeded the second threshold WTH' (step S209) or in the case where preparations for the charging process are complete (step S203 or step S211). Accordingly, if the charged flag is set to 0, either the printing operations are stopped (step S210) or the charged flag is restored to 1 immediately (step S106), but a situation in which normal printing operations are continued while the charged flag remains set to 0 is not conceivable.

FIG. 19 is a state transition diagram corresponding to the processing described above. The four parameters in each state illustrated in FIG. 19 indicate, from the left, the attachment state of the memory unit 100, the state of the charged flag, the state of the reserved flag, and whether or not printing operations can be carried out. For example, if the four parameters are (none, 0, 0, unable), this indicates that no memory unit 100 is attached, the charged flag and the reserved flag are both set to 0, and printing operations cannot be carried out.

A state S0 corresponds to a state before an initial fill of the print head, or in other words, a state in which the user has purchased the printing apparatus 200 but has not yet used the printing apparatus 200 and the print head is therefore not yet filled with ink. In the state S0, the memory unit 100 is not attached, the charged flag and the reserved flag are both set to 0, and printing operations cannot be carried out. In this case, neither the charging process nor the printing operations have been started, the total consumed ink amount information WD (consumed ink amount) is 0%, and the apparatus is standing by for a correct memory unit 100 to be attached.

In the case where a correct memory unit 100 has been attached in the state S0, the state moves to a state S1, where the charging process is executed. In the state S1, a memory unit 100 (the first memory unit 100-1) is attached and that memory unit 100 is correct, and thus the charged flag is set to 1 by the charging process, and printing operations can be carried out. The reserved flag remains set to 0. Note that in order for printing operations to become possible here, it is necessary for the user to fill the ink tank 221 with ink and the sensor to detect that there is ink.

Although a correct memory unit 100 being attached is a prerequisite for state S1, the memory unit 100 can be removed following the charging process. Accordingly, after the charging process is executed as a result of the state S1, the state automatically moves to a state S2, which corresponds to the charging being complete.

In the state S2, the attachment state of the memory unit 100 is different, namely "ignore". In other words, in the state S2, the memory unit 100 may be attached or removed. Additionally, although the attachment state of the memory unit 100 is of no consequence in the state S2, whether a correct memory unit 100 has been attached is monitored as a condition for the state moving to a state S3.

In the case where a correct memory unit 100 has been attached in the state S2, the state moves to the state S3. The state S3 corresponds to a reserved state. Accordingly, in the state S3, the reservation process is carried out using the attached correct memory unit 100 (the second memory unit 100-2). Accordingly, in the state S3, the memory unit 100 is attached, the charged flag and the reserved flag are both set to 1, and printing operations can be carried out.

Meanwhile, in the case where the memory unit 100 is removed in the state S3, the memory unit 100 for the reservation is no longer present and thus the state returns to the state S2. In other words, the state S2 corresponds to a charged and unreserved state.

Furthermore, in the case where the consumed ink amount (total consumed ink amount information WD) managed on the main unit side has exceeded the prescribed threshold WTH in the state S3, the charging process (automatic charging) is carried out using the memory unit 100 used for the reservation (the second memory unit 100-2). As such, first, the state moves to a state S4. In the state S4, the charged flag and the reserved flag are both set to 0. The state S4 corresponds to step S203 in FIG. 18.

The state then automatically moves from the state S4 to the state S1, and furthermore automatically moves to the state S2, and the charging process using the memory unit 100 that has been reserved is executed as a result.

On the other hand, in the case where the total consumed ink amount information WD has exceeded the prescribed threshold WTH in the state S2, the state moves to a state S5. The state S5 is a state in which a correct memory unit 100 is not attached and thus the charging process cannot be executed, despite it being necessary to carry out a charging process using a new memory unit 100. However, because the total consumed ink amount information WD has not reached the second threshold WTH', printing operations can be continued in the state S5. In the case where a correct memory unit 100 has been attached in the state S5, the state moves to a state S6. The state S6 is a stage of preparation for a charging process executed manually by the user, and thus the charged flag is set from 1 to 0, and the state moves to the state S1. In this case as well, the state automatically moves to the state S2 and the charging process is completed.

In other words, transitions of state S3→state S4→state S1→state S2 correspond to a transition from reservation to automatic charging, whereas transitions of state S2→state S5→state S6→state S1→state S2 correspond to a manual switch resulting from the user attaching a memory unit 100.

Meanwhile, in the case where, in the state S5, the total consumed ink amount information WD exceeds the second threshold WTH' (=WTH+$\alpha$) without a correct memory unit 100 being attached, the state moves to a state S7, which corresponds to a count exceeded error. In the state S7, the charged flag and the reserved flag are both set to 0, and printing operations cannot be carried out, regardless of the attachment state of the memory unit 100. Although a transition from a state aside from the state S5 to the state S7 is inconceivable during normal operations, a transition from a state aside from the state S5 to the state S7 may be permitted in consideration of some sort of error. In other words, the state may move to the state S7 regardless of the current state in the case where the total consumed ink amount information WD has exceeded the second threshold WTH'.

In the embodiment described above, as illustrated in FIG. 10, the printing apparatus 200 includes the storage unit 212 that stores the charged flag and the reserved flag. In the case where the processing unit 210 has carried out the charging process using the first memory unit 100-1, the processing unit 210 sets the charged flag to on (sets the flag to a value of 1, in the above-described example), and sets the reserved flag to on (to a value of 1) in the case where the second memory unit 100-2 has been attached to the slot 230 before the consumed ink amount reaches the prescribed threshold WTH. Specifically, this corresponds to step S106 and step S107 of FIG. 17.

By doing so, the processing of this embodiment, namely carrying out the charging process by attaching a correct first memory unit 100-1 in an uncharged state, and carrying out the reservation process by attaching the next correct second memory unit 100-2 after the charge is complete but before the consumed ink amount exceeds the prescribed threshold WTH, can be realized using the two flags.

Additionally, the processing unit 210 sets the reserved flag to off (to a value of 0) in the case of carrying out the charging process using the second memory unit 100-2. Specifically, this corresponds to part of the process in step S203 of FIG. 18.

By doing so, the reserved flag can be set to off in the case where the charging process has been executed using the second memory unit 100-2 in the reserved state (automatic charging). During automatic charging, the second memory unit 100-2 that was in the reserved state is invalidated by the charging process, and thus a correct memory unit 100 is not attached and a reservation for automatic charging is incomplete. In other words, the appropriate charging process and reservation process can be carried out by carrying out such flag management.

Additionally, in the case where the consumed ink amount expressed by the estimated ink amount information (the total consumed ink amount information WD) has exceeded the prescribed threshold WTH in a state where a valid second memory unit 100-2 is attached to the slot 230, the processing unit 210 carries out the charging process using the second memory unit 100-2. Then, in the case where the consumed ink amount expressed by the estimated ink amount information (the total consumed ink amount information WD) has exceeded the prescribed threshold WTH in a state where an invalid second memory unit 100-2 is attached to the slot 230, the processing unit 210 does not carry out the charging process using the second memory unit 100-2. To describe using the example of FIG. 17, this corresponds to the charging process (step S104 to step S106) not being executed unless a determination of "correct" was made in step S102.

As a result, the second memory unit 100-2 for reservation purposes being valid can be used as a condition for carrying out automatic charging. To rephrase, it is possible to suppress the inappropriate reuse of an invalid memory unit 100.

In the foregoing descriptions, the determination as to whether the memory unit 100 is valid or invalid (more broadly, the determination as to whether or not the memory unit 100 is correct) is carried out regardless of the timing of the charging process, as indicated by step S102 in FIG. 17. For example, an embodiment is also possible in which whether a memory unit 100 is valid or invalid is determined upon the memory unit 100 being attached, and the determination is not carried out again during the automatic charging. However, the timing of the determination is not limited thereto, and rather than determining whether the memory unit 100 is valid or invalid upon the memory unit 100 being attached, the determination may be carried out during the charging process.

To suppress the improper reuse of the memory unit 100, the processing unit 210 sets the memory unit 100 to invalid in the case where the charging process has been carried out using the memory unit 100. This corresponds to step S105 in FIG. 17.

Permitting a memory unit 100 that has been used once to be reused makes proper ink management impossible. In this embodiment, "using" the memory unit 100 needs only be thought of as the timing at which the main unit-side estimated ink amount information is updated (replaced) with the permitted usage amount information, or in other words, the timing at which the charging process is carried out, and thus carrying out such state management makes it possible to use the printing apparatus 200 properly.

Second Embodiment

Figure 20:
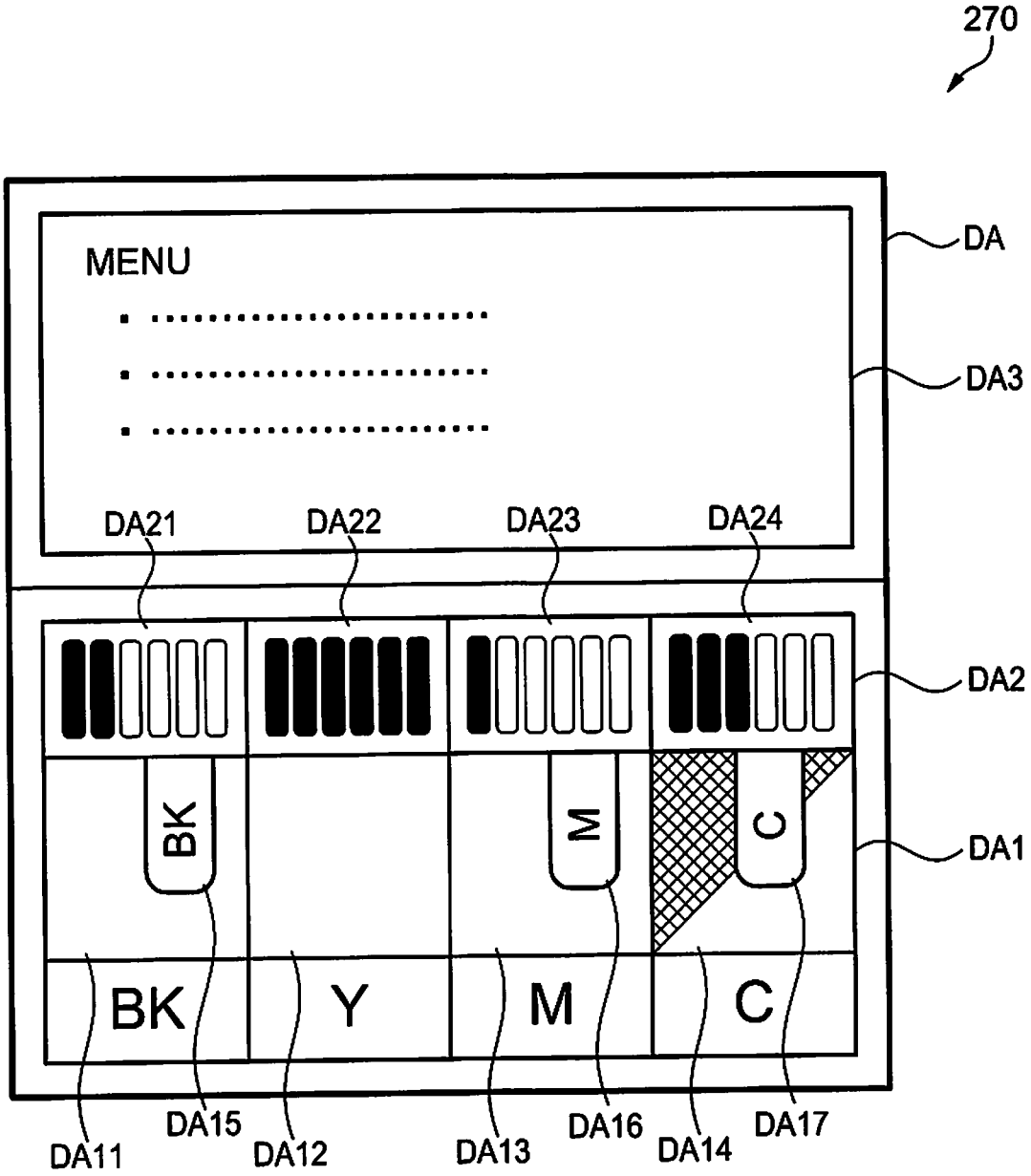
FIG. 20 is a diagram illustrating an example of the configuration of a display unit and a screen displayed therein, according to a second embodiment.

Next, a printing apparatus according to a second embodiment will be described with reference to FIG. 20. The printing apparatus according to the second embodiment has the same configuration as the printing apparatus according to the first embodiment aside from the configuration of the display unit and that part of the processing carried out by the processing unit for displaying the state information in the display unit is different. FIG. 20 is a diagram illustrating an example of the configuration of a display unit and a screen displayed therein, according to the second embodiment. Here, the points of the second embodiment that differ from the first embodiment will be described with reference to FIG. 20, and constituent elements that are the same as in the first embodiment will be given the same reference numerals, with descriptions thereof omitted.

As illustrated in FIG. 20, a display unit 270 according to the second embodiment has the first display region DA1 (also called a "state display region"), the second display region DA2 (also called a "remainder display region"), and a third display region DA3 (also called a "menu display region") in the display region DA. The display unit 270 according to the second embodiment differs from the display unit 260 according to the first embodiment in that the details of the display screens of the first display region DA1 and the second display region DA2 are different, and furthermore, in that the third display region DA3 is also provided.

The first display region DA1 and the second display region DA2 are, for each color of ink held in the ink tanks 221, divided into a region DA11 and a region DA21 corresponding to black (BK), a region DA12 and a region DA22 corresponding to yellow (Y), a region DA13 and a region DA23 corresponding to magenta (M), and a region DA14 and a region DA24 corresponding to cyan (C). Accordingly, with the display unit 270 according to the second embodiment, the state information of a plurality of ink tanks 221 can be displayed in the single screen illustrated in FIG. 20.

The state information of the permitted usage amount information of the memory unit 100, or in other words, the charged state or reserved state from the memory unit 100, is displayed corresponding to each ink in the four regions DA11 (BK), DA12 (Y), DA13 (M), and DA14 (C), respectively, of the first display region DA1. The state information of the estimated ink amount information (the remaining ink amount) updated by the processing unit 210 is displayed corresponding to each ink in the four regions DA21 (BK), DA22 (Y), DA23 (M), and DA24 (C), respectively, of the second display region DA2.

In the example illustrated in FIG. 20, the state of the consumed ink amount estimated on the basis of the estimated ink amount information charged by the memory unit 100 (the initial fill amount) and the consumed ink amount estimated through the counting process (the estimated consumed ink amount) (that is, the amount of ink remaining in the ink tank 221) is displayed in each of the four regions DA21 to DA24 by six blocks. In the example illustrated in FIG. 20, of the six blocks, white blocks represent blocks that are not lit, and black blocks represent blocks that are lit.

The black blocks are displayed so as to correspond to the remaining ink amount estimated through the counting process (an estimated remaining ink amount), and will be referred to as "charge blocks" hereinafter. A greater number of charge blocks displayed in the four regions DA21 to DA24 indicates a greater estimated remaining ink amount (that is, a lower estimated consumed ink amount). The number of the white blocks increases and the number of the charge blocks decreases as ink is consumed by printing and the estimated remaining ink amount decreases (the estimated consumed ink amount increases).

In this embodiment, two or more charge blocks are displayed in the case where the estimated consumed ink amount is less than 100% of the estimated ink amount information charged using the memory unit 100 (the initial fill amount), and one charge block is displayed when the estimated consumed ink amount reaches 100%. As such, a case where only a single charge block is displayed in the four regions DA21 to DA24 corresponds, with respect to the counting process, to a state where a single ink pack 310's worth of ink (1 L) has been consumed by a printing apparatus 200 having the worst ink consumption efficiency.

A "BK" information bar DA15 is displayed in the region DA11 corresponding to black (BK) ink. This indicates that for the black (BK) ink, the charging process is complete, and after the first memory unit 100-1 used in the charging process has been removed from the slot 230, the second memory unit 100-2 has been attached and the reservation process is complete. When the second memory unit 100-2 is removed in this state, the reservation process is canceled and nothing is displayed in the region DA11. The second memory unit 100-2 removed in this state has not yet undergone the charging process and can therefore be used.

Meanwhile, two charge blocks are displayed in the region DA21. This indicates that for the black (BK) ink, the estimated consumed ink amount is less than 100% relative to the estimated ink amount information charged by the first memory unit 100-1.

Nothing is displayed in the region DA12 corresponding to yellow (Y) ink. In other words, no information bar is displayed in the region DA12. Note that the overall region DA12 may be filled with a gray color or the like and made darker than the region DA11 in order to make it easier for the user to identify the region DA11 in which the information bar DA15 is displayed and the region DA12 in which no information bar is displayed. Alternatively, the background of the region DA11 in which the information bar DA15 is displayed may be made lighter than the region DA12.

Nothing being displayed in the region DA12 (the first display region DA1) indicates that the yellow (Y) ink has been charged by the first memory unit 100-1 and the first memory unit 100-1 remains attached, or has been removed but a reservation process based on the second memory unit 100-2 has not yet been carried out. The first memory unit 100-1 removed in this state has undergone the charging process and is thus invalidated. Additionally, in this state, the reservation process can be carried out by attaching the second memory unit 100-2.

Six charge blocks are displayed in the region DA22. Accordingly, with respect to the yellow (Y) ink, the estimated consumed ink amount is extremely low relative to the estimated ink amount information charged by the first memory unit 100-1, and it is estimated that a sufficient remaining ink amount is present.

A "M" information bar DA16 is displayed in the region DA13 corresponding to magenta (M) ink. This indicates that like the black (BK) ink, the second memory unit 100-2 is attached and the reservation process is complete for the magenta (M) ink as well.

Meanwhile, only one charge block is displayed in the region DA23. In this case, it is estimated that an amount of ink equivalent to a single ink pack 310 will be almost completely consumed. In the case where the charge blocks displayed in the region DA23 (the second display region DA2) have disappeared, the estimated consumed ink amount has reached or exceeded 120% of the initial fill amount, and the remaining ink is estimated to be low. In this case, it is desirable to refill the ink from the ink pack 310. In the case where printing is continued in such a state, there is a risk that the ink in the ink tank 221 will run out and the printing operations will stop.

Note that the automatic charging process using the attached second memory unit 100-2 is carried out when, in the reserved state in which the "M" information bar DA16 is displayed in the region DA13 (the first display region DA1), the initial fill amount of ink charged using the first memory unit 100-1 is consumed and the estimated ink amount information exceeds the prescribed threshold WTH. When the automatic charging process is carried out, the second memory unit 100-2 is invalidated and nothing is displayed in the region DA13, in the same manner as with the region DA12. Six charge blocks are displayed in the region DA23.

With the region DA14 corresponding to cyan (C) ink, half of the region is filled with a gray color, for example (indicated by hatching in FIG. 20), and a "C" information bar DA17 is displayed. This indicates that the second memory unit 100-2 is attached and the reservation process is complete, but the attached second memory unit 100-2 is not a new unit (that is, may have been partially used).

With normal use, a new (unused) memory unit 100 included with an ink pack set 300 is used, but it is also possible for a memory unit 100 that is not new to be attached as well.

In the case where the attached memory unit 100 is not new, there is a risk of increased error between the estimated ink amount information based on the permitted usage amount information of the ink updated by the charging process (or the estimated remaining ink amount) and the actual consumed ink amount (or the actual remaining ink amount). Accordingly, in such a case, it is desirable to have the user prepare a new memory unit 100 (ink pack set 300) in advance.

Accordingly, in this embodiment, half of the first display region DA1 (the region DA14) is filled with a gray color or the like in the case where the reservation process has been carried out with a memory unit 100 that is not new having been attached. In other words, by using a different display from the display carried out in the first display region DA1 (the region DA11 and the region DA13) in the case where the reservation process is carried out with a new memory unit 100 attached, the user can be notified that the attached memory unit 100 is not new.

Although half of the first display region DA1 (the region DA14) is filled with gray or the like regardless of the permitted usage amount information (or backup information) of the ink stored in the memory unit 100 that is not new, this display is not limited thereto. A ratio of the area of the region, in the first display region DA1 (the region DA14), that is filled with the gray color or the like may be varied in accordance with the permitted usage amount information (or backup information) of the ink stored in the memory unit 100.

Note that even in the case where the automatic charging process has been carried out using a memory unit 100 that is not new, charge blocks corresponding to the estimated ink amount information updated on the basis of the permitted usage amount information (or backup information) of the ink are displayed in the second display region DA2 (the region DA24).

The third display region DA3 of the display unit 270 will be described next. Although graphical information such as information bars and blocks are displayed in the first display region DA1 and the second display region DA2, text information is displayed in the third display region DA3. A menu of items selectable by the user, information regarding the refilling of ink, and so on is displayed in the third display region DA3. The third display region DA3 is constituted of, for example, a display such as a liquid crystal display or an organic EL display, and a touch panel. Accordingly, the third display region DA3 of the display unit 270 can accept operational inputs from the user.

By selecting an option from the menu displayed in the third display region DA3 (that is, by pressing the touch panel), the user can cause the printing apparatus 200 to execute a desired operation. Additionally, the processing unit 210 can present necessary information to the user by displaying, in the third display region DA3, a message indicating the operation state of the printing apparatus 200 in response to a user operation, a message (warning) prompting the user to refill ink, a message notifying the user of the occurrence of an error, and the like.

According to the configuration of the second embodiment, the state information of a plurality of ink tanks 221, namely black (BK), yellow (Y), magenta (M), cyan (C), and the like, can be displayed side-by-side in the first display region DA1 and the second display region DA2 of the display unit 270. Additionally, a menu for operation inputs from the user, information for the user, and so on can be presented by displaying various types of text information in the third display region DA3 of the display unit 270.

Note that in the second embodiment, the configuration may be such that the display unit 270 does not have the third display region DA3 in the display region DA. The state information of the permitted usage amount information and the state information of the estimated ink amount information can be presented to the user in the same manner as in the first embodiment as long as the display unit 270 has the first display region DA1 and the second display region DA2.

Third Embodiment

Figure 21:
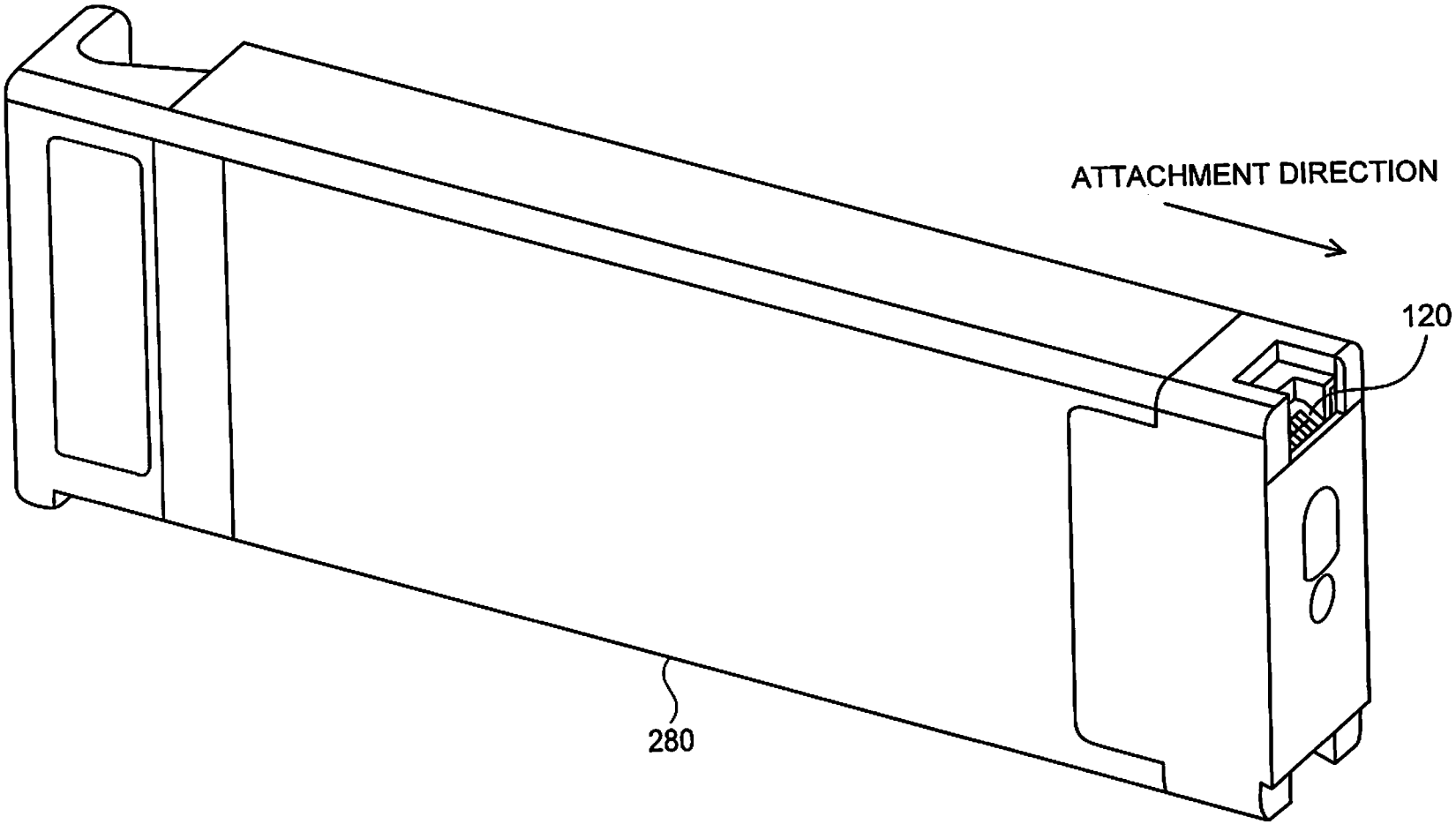
FIG. 21 is a perspective view illustrating an example of the configuration of an ink tank for maintenance according to a third embodiment.

Next, a printing apparatus according to a third embodiment will be described with reference to FIG. 21. The printing apparatus according to the third embodiment has almost the same configuration as the printing apparatus according to the first embodiment, aside from the addition of elements for cases where a service engineer performs maintenance. Here, the points of the third embodiment that differ from the first embodiment will be described, and constituent elements that are the same as in the above embodiments will be given the same reference numerals, with descriptions thereof omitted.

In the third embodiment, an ink tank used in the case where a service engineer carries out maintenance operations is prepared as an ink holding unit 220, separate from the ink tanks 221. FIG. 21 is a perspective view illustrating an example of the configuration of an ink tank for maintenance according to the third embodiment. An ink tank 280 according to the third embodiment, illustrated in FIG. 21, is, for example, brought by the service engineer and used when the service engineer carries out periodic maintenance on the printing apparatus 200, makes repairs when a problem has occurred, and so on.

The ink tank 280 is smaller than the ink tank 221 (see FIG. 4). The ink tank 280 is, for example, approximately the same size as the part of the ink tank 221 on the side of the slider attachment direction (the right side in FIG. 4). A memory unit 120 for maintenance is provided on one end side (the attachment direction side) of the ink tank 280. The side of the ink tank 280 to which the memory unit 120 is attached is attached to the slot 230 of the printing apparatus 200. Note that the memory unit 120 may be fixed to the ink tank 280, or a storage device (not shown) having the memory unit 120 may be incorporated into the ink tank 280 directly.

When the service engineer carries out maintenance operations on the printing apparatus 200, the ink tank 221 used by the user is removed from the printing apparatus 200, and the ink tank 280 is attached to the printing apparatus 200 instead. The service engineer then carries out maintenance on the printing apparatus 200 with the ink tank 280 attached thereto. After the maintenance operations are finished, the service engineer removes the ink tank 280 and re-attaches the ink tank 221 used by the user to the printing apparatus 200.

In the third embodiment, the printing apparatus 200 has, in the storage unit 212, a region to which the estimated ink amount information is saved (also called a "region 212B" hereinafter), separate from the region that stores the estimated ink amount information (also called a "region 212A" hereinafter). In a state where the user is using the printing apparatus 200, the estimated ink amount information charged by the memory unit 100 used by the user is stored in the region 212A of the storage unit 212.

Upon starting the maintenance operations, the service engineer removes the ink tank 221 used by the user from the printing apparatus 200 and attaches the ink tank 280 he or she has brought to the printing apparatus 200. Then, through the UI unit 250, the service engineer inputs a command for causing the processing unit 210 to recognize the memory unit 120 provided in the ink tank 280 (called simply a "recognition command" hereinafter).

The recognition command can be inputted, for example, through a maintenance menu displayed in the third display region DA3 (the menu display region) of the display unit 270 illustrated in FIG. 20. The maintenance menu is displayed in response to a specific operation, such as a plurality of buttons of the UI unit 250 being pressed simultaneously, in order to prevent careless execution by the user. Other processes executed at the time of maintenance operations may also be carried out in response to inputs made through the maintenance menu.

Upon the recognition command being inputted, the processing unit 210 saves (copies) the estimated ink amount information charged by the memory unit 100 used by the user, which is stored in the region 212A, into the region 212B. The processing unit 210 then stores, in the region 212A, the estimated ink amount information stored in the memory unit 120 provided in the ink tank 280. Note that a charging process is not carried out using the memory unit 120. Accordingly, the memory unit 120 is not invalidated and can be reused along with the ink tank 280.

Ink in the ink tank 280 is consumed while the service engineer carries out the maintenance operations. As the ink is consumed, the estimated ink amount information stored in the region 212A and the memory unit 120 is updated. The estimated ink amount information charged using the memory unit 100 is saved in the region 212B and is not updated while the maintenance operations are being carried out, even if ink is consumed.

Once the maintenance operations are finished, the service engineer inputs, through the UI unit 250 (the maintenance menu), a command for canceling the recognition of the memory unit 120 (called simply a "cancel command" hereinafter). Upon the cancel command being inputted, the processing unit 210 stores the estimated ink amount information stored in the region 212A in the memory unit 120. The estimated ink amount information charged by the memory unit 100 used by the user, which has been saved in the region 212B, is then returned to the region 212A.

The service engineer then removes the ink tank 280 from the printing apparatus 200 and attaches the ink tank 221 used by the user. As a result, the user can continue to use the ink tank 221 being used before the maintenance operations were carried out, and can continue to update the estimated ink amount information charged using the memory unit 100.

In this manner, by attaching the ink tank 280 for maintenance, maintenance operations can be carried out on the printing apparatus 200 without consuming ink from the ink tank 221 used by the user. Additionally, because the estimated ink amount information charged using the memory unit 100 used by the user is not updated during the maintenance, maintenance operations can be carried out on the printing apparatus 200 without consuming the estimated remaining ink amount, which corresponds to the user's rights.

Note that in addition to the above-described region 212A and region 212B, the storage unit 212 may have a region 212C that stores information regarding maintenance. An ID of the memory unit 120, the estimated ink amount information of the ink tank 280 in which the memory unit 120 is provided, and the like can be given as examples of the information regarding maintenance. For example, upon the cancel command being inputted after the maintenance operations are finished, the processing unit 210 may store the estimated ink amount information during the maintenance operations, which had been stored in the region 212A, in the region 212C as well. Doing so makes it possible to restore the storage of the memory unit 120 in the case where an error has occurred in the estimated ink amount information stored in the memory unit 120 due to some sort of problem.

Additionally, information enabling the date on which the maintenance operations were carried out to be specified (for example, a year, month, and day) may be stored in the region 212C as the information regarding maintenance. Doing so makes it possible to identify the day on which the service engineer performed maintenance, repairs, or the like on the printing apparatus 200, and thus it is possible to track the occurrence of problems in the printing apparatus 200, whether or not the user has misused the printing apparatus 200, or the like as necessary.

Variations

Several variations will be described hereinafter.

Although the embodiment describes an example in which there is an area for storing whether the memory unit 100 is valid or invalid in the storage device 110 thereof, a variety of methods for setting the memory unit 100 to invalid can be considered. For example, in the case where the charging process has been carried out using the memory unit 100, the processing unit 210 may invalidate the memory unit 100 by writing invalidating data into a region, of the storage region in the memory unit 100, where the permitted usage amount information is stored. For example, in the case where the memory unit 100-side consumed ink amount (information indicating 0% when in an unused state) is stored as the permitted usage amount information, a value at which the value corresponding to the initial fill amount (117%) will be exceeded may be written into that storage region. Doing so makes it possible to invalidate the memory unit 100 using the storage region for the permitted usage amount information. However, the method of invalidation is not limited thereto, and rather than the region (address) where the permitted usage amount information is stored, a region that stores a valid flag (invalid flag) may be provided, and the memory unit 100 may be invalidated by overwriting the data in that region with a value corresponding to the invalid state.

Note that the storage region of the memory unit 100 may be managed using addresses. For example, ID information of the memory unit 100 is stored using 8 bits of a storage region corresponding to an address ad1 (for example, a region that takes ad1 as a starting address), color information expressing the color of the ink is stored using 2 bits of a storage region corresponding to an address ad2, and the permitted usage amount information is stored using 8 bits of a storage region corresponding to an address ad3. In the case where the permitted usage amount information is expressed by the initial fill amount and the consumed ink amount relative to the initial fill amount, the region for storing the permitted usage amount information is divided into two regions, with the first region storing the initial fill amount and the second region storing the consumed ink amount.

Additionally, although the embodiment describes the permitted usage amount information of the memory unit 100 as including the initial fill amount and the consumed ink amount relative to the initial fill amount, and describes the estimated ink amount information of the printing apparatus 200 as including the total consumed ink amount information WD and the initial fill amount, these pieces of information are not limited thereto. For example, information regarding a remaining amount may be employed instead of information regarding a consumed amount. Specifically, an amount of ink, from the initial fill amount, that is estimated to remain without being used may be employed. In the case where the remaining ink amount is employed instead of the consumed ink amount information, content reading "exceeds the prescribed threshold" in the embodiment can be thought of as being replaced with "drops below the prescribed threshold".

Here, the remaining ink amount is, for example, information expressed as a volume. In this case, the amount of ink that can be used can be directly understood as a volume, a weight, or the like simply by referring to the remaining ink amount, without needing to refer to the initial fill amount. Accordingly, updating the estimated ink amount information using the permitted usage amount information (that is, the charging process) is realized using the remaining ink amount indicated by the permitted usage amount information, through a process for replacing the remaining ink amount indicated by the permitted usage amount information.

Meanwhile, the remaining ink amount may be information expressing a percentage of the remaining amount relative to the initial fill amount. In this case, the charging process is a process that updates the estimated ink amount information in the printing apparatus 200 using both the initial fill amount and the remaining ink amount in the permitted usage amount information.

Additionally, the initial fill amount in the embodiment may be expressed as a volume or as a weight. Likewise, the consumed ink amount and the remaining ink amount are not limited to being expressed as percentages or volumes, and can instead be expressed as weights.

Additionally, in the embodiment, the consumed ink amount estimated for when the initial fill amount is consumed is expressed as 100% assuming that the ink consumption efficiency is a lower limit value of a predetermined range and the printing apparatus is used in a usage environment recommended by the printing apparatus vendor. However, the reference in the case where the consumed ink amount is expressed as a percentage is not limited thereto, and many variations are possible. For example, the reference is set to a lower value than the initial fill amount in the case where a warning display is carried out sufficiently in advance.

Additionally, a variety of forms of information can be used with respect to the information used by the processing unit 210 when finding the estimated ink amount information (consumed ink amount). The processing unit 210 may use a soft counting process to count the number of ink ejections and then take the counted number as the estimated ink amount information, or information obtained by multiplying the count number by the amount of ink assumed to be consumed in a single ejection, or in other words, information expressing the volume of the ejected ink, may be used as the estimated ink amount information. In either case, the estimated ink amount information is information expressing how much of the ink in question is consumed.

In addition, in the embodiment, information of the initial fill amount is held in the memory unit 100 and the printing apparatus 200 in consideration of situations where there is variation in the amounts of ink held in the ink packs 310, multiple sizes of ink packs 310 (for example, 1 L, 2 L, and so on) are present, and so on. However, the initial fill amount may be taken as a fixed value in the case where the ink packs 310 have only a predetermined volume and there is no need to take such a variation into consideration. In this case, storing the initial fill amount, which is a fixed value, in all of the memory units 100 included with the ink packs 310 has no great meaning. Accordingly, the initial fill amount and a percentage corresponding to the initial fill amount can be stored in the storage unit 212 of the printing apparatus 200 in advance. As a result, the initial fill amount can be left out of the permitted usage amount information of the memory unit 100. In this case, it is not necessary to consider the update (replacement) of the initial fill amount in the charging process, and the update (replacement) may be carried out using the consumed ink amount (remaining ink amount).

Additionally, a situation in which a partially-used memory unit 100, specifically a memory unit 100 in which the consumed ink amount is greater than an unused state (0%) but is less than the value corresponding to the initial fill amount (WTH %, for example), is attached can also be considered in the embodiment. Such a memory unit 100 can arise in the case where, for example, the technique according to JP-A-2014-46545 is also employed. In the embodiment, the consumed ink amount from the memory unit 100 is used in the charging process, and thus the correct processing is possible regardless of whether the memory unit 100 is unused or is partially used.

However, there are also cases where it is assumed that new, valid memory units 100 will always be used. For example, with the technique according to the embodiment, a memory unit 100 that has undergone the charging process is invalidated, and thus there are no memory units 100 that are both valid and for which the consumed ink amount is between 0% and WTH %. In other words, only two types of memory unit 100 can be considered, namely one that is both new and valid, and one that is invalid. In this case, the consumed ink amount for a valid memory unit 100 will always reach 0%, and thus there is no great meaning in storing the consumed ink amount in all of the memory units 100 included with the ink packs 310. Accordingly, the consumed ink amount may be omitted from the permitted usage amount information, and only the initial fill amount may be used, in the embodiment.

It is also possible to omit both the initial fill amount and the consumed ink amount in the case where the initial fill amount is set in the printing apparatus 200 in advance and it is assumed that a new, valid memory unit 100 will always be used. As long as the memory unit 100 can be confirmed as valid, the estimated ink information may be charged (that is, the consumed ink amount may be reset), and thus the permitted usage amount information in this case may be any information enabling the memory unit 100 to be confirmed as valid.

Additionally, as described above using FIG. 2, a plurality of ink tanks 221, slots 230, memory units 100, and sliders 240 have been described, assuming a printing apparatus 200 carries out color printing. However, if the printing apparatus 200 carries out black-and-white printing, only a single ink tank 221, slot 230, memory unit 100, and slider 240 may be provided.

Additionally, although the embodiment describes stopping printing operations upon the sensor that detects the presence/absence of ink detecting that there is no ink, the invention is not limited thereto, and the printing operations may be stopped in the case where the processing unit 210 has carried out a predetermined number of counting processes after the sensor has detected that there is no ink (that is, in the case where the soft count has exceeded a prescribed threshold). Meanwhile, after the printing operations have been stopped on the basis of the sensor detecting that there is no ink, the printing apparatus 200 restores the printing operations to the pre-stopped state upon the sensor detecting that there is ink. For example, the charged flag and the reserved flag are set to the values present before the printing operations were stopped. In the example illustrated in the state transition diagram of FIG. 19, the sensor detects that there is no ink during printing operations, and it is thus possible that the printing operations will be stopped by the sensor in each of the states from S1 to S6. In this case, the state moves from a state Si (where i is an integer fulfilling the relationship $1 \leq i \leq 6$) to a printing operation stopped state (not shown), and the state Si, which is the state before the stop, is held (for example, stored in the storage unit 212); then, a process for moving from the printing operation stopped state to the state Si is carried out when ink is detected.

Additionally, the method for detecting the attachment of the memory unit 100 is not limited to that illustrated in FIG. 9. For example, the memory unit 100 may be provided with two attachment detection terminals that are electrically connected, and the attachment may be detected by the processing unit 210 detecting electrical conduction between two main unit-side (slot 230-side) attachment detection terminals corresponding to the stated two attachment detection terminals.

Additionally, the method through which the processing unit 210 selects the memory unit 100 to be accessed is not limited to that described in the embodiment above. For example, if a configuration in which the processing unit 210 outputs the clock signal SCK to each slot 230 individually is employed, a prescribed memory unit 100 can be selected by outputting the clock signal SCK only to that memory unit 100. Alternatively, if a configuration in which the processing unit 210 inputs and outputs the data signal SDA to and from the slots 230 individually is employed, a prescribed memory unit 100 can be selected by outputting the data signal SDA (for example, a readout command or the like) only to that memory unit 100.

Additionally, the ink refill receptacle is not limited to the ink pack 310. For example, the ink refill receptacle may be a receptacle that uses a hard member formed from a resin or the like. Even in such a case, it is sufficient that the ink refill receptacle last until being used to refill the ink tank 221 with ink, and there is no difference with respect to the ability to lower the requirements for durability or the like compared to the ink tank 221. Note that in the case where the ink pack 310 (a pouch) is used, it is assumed to be necessary to use all of the ink contained therein to fill the ink tank 221 once the pack has been opened. To rephrase, once the ink pack 310 is opened, it is difficult to use the ink pack 310 to properly store ink. However, in the case where a hard member is used for the ink refill receptacle and a cap can be provided in the refilling receptacle itself, the ink can be refilled in multiple instances.

Although the foregoing has described embodiments of the invention in detail, one skilled in the art will easily recognize that many variations can be made thereon without departing from the essential spirit of the novel items and effects of the invention. Such variations should therefore be taken as being included within the scope of the invention. For example, in the specification or drawings, terms that have broader or the same definitions as terms that have been used once and that are denoted along with the stated terms can be replaced with those terms in all areas of the specification or drawings. Furthermore, the configurations and operations of the printing apparatus are not intended to be limited to the embodiment, and many variations thereon are possible as well.

This application claims the benefit of foreign priority to Japanese Patent Applications No. JP2015-238447, filed Dec. 7, 2015, No. 2015-238448, filed Dec. 7, 2015, and No. JP2015-238449, filed Dec. 7, 2015, which are incorporated by reference in their entirety.

What is claimed is:

1. A printing apparatus comprising:

a slot to and from which a memory unit storing permitted usage amount information of ink held in an ink holding unit can be attached and removed; and a processing unit that carries out a process for updating estimated ink amount information that is information for estimating an amount of the ink in the ink holding unit, wherein in the case where a first memory unit is attached to the slot, the processing unit carries out a charging process that updates the estimated ink amount information using the permitted usage amount information in the first memory unit; and in the case where a second memory unit is attached to the slot after the charging process, the processing unit does not carry out the charging process using the second memory unit until a consumed ink amount expressed by the estimated ink amount information exceeds a prescribed threshold, and in the case where the consumed ink amount has exceeded the prescribed threshold, the processing unit carries out the charging process using the second memory unit.

2. The printing apparatus according to claim 1, wherein the processing unit carries out a process for displaying state information of the permitted usage amount information of the memory unit in a first display region of a display unit and carries out a process for displaying state information of the estimated ink amount information updated by the processing unit in a second display region of the display unit.

3. The printing apparatus according to claim 2, wherein the processing unit carries out a process for displaying information expressing that the second memory unit is in a reserved state in the display unit until the consumed ink amount expressed by the estimated ink amount information exceeds the prescribed threshold.

4. The printing apparatus according to claim 3, wherein the processing unit carries out the process for displaying information expressing that the second memory unit is in the reserved state in the first display region of the display unit.

5. The printing apparatus according to claim 3, wherein the processing unit carries out a process for displaying information identifying whether or not a reservation by the second memory unit succeeded in the display unit.

6. The printing apparatus according to claim 2, wherein the processing unit carries out a process for displaying information identifying whether or not the charging process succeeded in the display unit.

7. The printing apparatus according to claim 2, wherein in the case where the memory unit is not attached to the slot, the processing unit displays information expressing that the memory unit is not attached in the display unit.

8. The printing apparatus according to claim 1, further comprising:

a storage unit that stores a charged flag and a reserved flag, wherein in the case where the charging process using the first memory unit is carried out, the processing unit sets the charged flag to on; and in the case where the second memory unit is attached to the slot before the consumed ink amount exceeds the prescribed threshold, the processing unit sets the reserved flag to on.

9. The printing apparatus according to claim 8, wherein in the case where the charging process using the second memory unit is carried out, the processing unit sets the reserved flag to off.

10. The printing apparatus according to claim 1, wherein in the case where the consumed ink amount expressed by the estimated ink amount information exceeds the prescribed threshold in a state where the second memory unit set to a valid state is attached to the slot, the processing unit carries out the charging process using the second memory unit; and in the case where the consumed ink amount expressed by the estimated ink amount information exceeds the prescribed threshold in a state where the second memory unit set to an invalid state is attached to the slot, the processing unit does not carry out the charging process using the second memory unit.

11. The printing apparatus according to claim 1, wherein the ink holding unit is an ink tank that can be filled with ink from the exterior.

12. The printing apparatus according to claim 11, wherein the ink tank is a tank that can be filled with ink from an ink refill receptacle; and the memory unit is packaged with the ink refill receptacle.

13. The printing apparatus according to claim 1, wherein in the case where the charging process using the memory unit is carried out, the processing unit sets the memory unit to an invalid state.

14. The printing apparatus according to claim 1, wherein the processing unit carries out a process for writing the estimated ink amount information as backup information into a region, of storage regions in the first memory unit, that is different from a region in which the permitted usage amount information is stored, after the charging process using the first memory unit.

15. The printing apparatus according to claim 14, wherein in the case where the first memory unit that is attached to the slot is removed and it is detected that the second memory unit is attached to the slot, the processing unit carries out a process for writing the estimated ink amount information as backup information into a region, of storage regions in the second memory unit, that is different from a region in which the permitted usage amount information is stored.

16. The printing apparatus according to claim 15, wherein in the case where the charging process using the memory unit is carried out, the processing unit sets the memory unit to an invalid state by writing invalidating data into a region, of storage regions in the memory unit, in which the permitted usage amount information is stored.

17. The printing apparatus according to claim 14, further comprising:

a storage unit that stores the estimated ink amount information, wherein the backup information is information used to restore the estimated ink amount information in the case where an error has arisen in the estimated ink amount information in the storage unit.

18. The printing apparatus according to claim 13, wherein the processing unit carries out a process for displaying information expressing that the memory unit becomes invalid in the first display region.

19. A printing apparatus comprising:

a slot to and from which a memory unit storing permitted usage amount information of ink held in an ink holding unit can be attached and removed; and a processing unit that carries out a process for updating estimated ink amount information that is information for estimating an amount of the ink in the ink holding unit, wherein in the case where a first memory unit is attached to the slot, the processing unit carries out a charging process that updates the estimated ink amount information using the permitted usage amount information in the first memory unit;

in the case where a second memory unit is attached to the slot after the charging process, the processing unit does not carry out the charging process using the second memory unit until a consumed ink amount expressed by the estimated ink amount information exceeds a prescribed threshold, and in the case where the consumed ink amount exceeds the prescribed threshold, the processing unit carries out the charging process using the second memory unit; and the processing unit carries out a process for displaying information expressing that the second memory unit is in a reserved state in the display unit until the consumed ink amount expressed by the estimated ink amount information exceeds the prescribed threshold.

* * * * *